US006468720B1

(12) United States Patent
Hirabayashi et al.

(10) Patent No.: US 6,468,720 B1
(45) Date of Patent: Oct. 22, 2002

(54) PROCESSING METHOD OF PHOTOTHERMOGRAPHIC MATERIAL

(75) Inventors: Kazuhiko Hirabayashi; Kenji Goto, both of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/691,309

(22) Filed: Oct. 18, 2000

(30) Foreign Application Priority Data

Oct. 21, 1999 (JP) ..... 11-299899
Oct. 26, 1999 (JP) ..... 11-303779
Aug. 2, 2000 (JP) ..... 2000-234410

(51) Int. Cl.[7] ..... G03C 5/16; G03C 1/498

(52) U.S. Cl. ..... 430/350; 430/619; 396/575; 396/577

(58) Field of Search ..... 430/350, 617, 430/619, 531, 264; 396/575, 577; 219/216, 388

(56) References Cited

U.S. PATENT DOCUMENTS 4,395,484 A 7/1983 McCarney
5,279,928 A 1/1994 Dedio et al.

FOREIGN PATENT DOCUMENTS

| | | |
|---|---|---|
| EP | 803766 | 10/1997 |
| EP | 864944 | 9/1998 |
| EP | 933672 | 8/1999 |

*Primary Examiner*—Thorl Chea
(74) *Attorney, Agent, or Firm*—Bierman, Muserlian and Lucas

(57) ABSTRACT

A method for processing a heat developable photothermographic material by the use of an automatic processor is disclosed, wherein the photothermographic material comprises a support, a light sensitive silver halide, an organic silver salt, a reducing agent and a contrast-increasing agent; and in the step of heat-developing, the photothermographic material passes at a transport speed of 22 to 40 mm/sec. through an atmosphere of not less than 117° C. in not less than 10 sec., and further passing, while being brought into contact with the surface of a heating member exhibiting a surface temperature of 90 to 115° C. or in the vicinity of the surface of the heating member.

10 Claims, 1 Drawing Sheet

PROCESSING METHOD OF PHOTOTHERMOGRAPHIC MATERIAL

FIELD OF THE INVENTION

The present invention relates to a processing method of photothermographic materials, which results in reduced in variation of photographic performance and dimensional change, and is also superior in productivity, and further to a photothermographic material and an automatic thermal processor.

BACKGROUND OF THE INVENTION

In the field of printing-plate making and medical diagnosis, waste liquor produced in wet-processing of image forming material results in problems and in addition reduction of processing effluent is strongly desired in terms of environmental protection and space saving. Accordingly, a method for photothermographic materials is required which enables efficient exposure by means of a laser image setter or a laser imager and formation of black images exhibiting high resolution and clearness.

As such a technique is known a thermally developable photothermographic material which comprises on a support an organic silver salt, light sensitive silver halide grains, reducing agent and a binder, as described in U.S. Pat. Nos. 3,152,904 and 3,487,075, and D. Morgan "Dry Silver Photographic Materials" in Handbook of Imaging Materials, page 48 (Marcel Dekker Inc., 1991). Photothermographic materials are stable at ordinary temperatures and after exposure to light, they are developed by heating to a higher temperature (e.g., 80 to 140° C.). Upon heating, silver is formed through an oxidation-reduction reaction between an organic silver salt (which functions as an oxidizing agent) and a reducing agent.

Such photothermographic materials have been employed mainly as a microphotographic material and for radiographic use, and partially as a photographic material for graphic arts use. The obtained images which exhibit a relatively low maximum density (hereinafter, also denoted as Dmax) and contrast are inferior as a photographic material for graphic arts use. Recently, on the other hand, scanners and image setters employing a laser or a light-emitting diode have become popular and a photothermographic material suitable for an outputting machine and exhibiting higher sensitivity, Dmax and contrast have been urgently sought.

With regard to such a photothermographic material, a technique for increasing contrast with a contrast-increasing agent such as hydrazine derivatives is known in the art, as described in U.S. Pat. Nos. 5,545,505 and 5,545,515; and JP-A 9-90550 (hereinafter, the term, JP-A refers to an unexamined and published Japanese Patent Application).

In processing photothermographic materials, the photothermographic material is gradually heated to provide an overall uniform temperature to reduce a variation of photographic performance and a dimensional change, resulting in a slower processing speed, relative to the wet-processing system, thereby lowering productivity. Therefore, an enhancement of productivity is desired. Further, reduction of fluctuation in image density or dot percentage for use in printing plate making is also desired.

SUMMARY OF THE INVENTION

In processing photothermographic materials, increasing the speed or raising the temperature results in uneven development, leading to more fluctuation in density within the imaging area. Specifically, incorporation of a contrast-increasing agent results in such a problem. Although such contrast-increasing agent is required to improve dot quality, development stability is markedly deteriorated. Supposing a photothermographic material containing a contrast-increasing agent and giving an intended image upon developing at 120° C. for 30 sec., for example, if it is developed at 120° C. for 45 sec. or at 125° C. for 30 sec., development becomes so active that unexposed areas are also developed. In the formation of halftone dots of 90% or more (so-called large dots), slightly excessive heating results in blocking of dots. In the case of halftone dots of 10% or less (so-called small dots), development proceeds so quickly that it is difficult to obtain the intended dot percentage. Thus, improvement of dot quality results in development unevenness.

PET is generally employed as a support for photographic materials. However, photothermographic materials are thermally processed at a temperature higher than the glass transition temperature (Tg) of PET and increasing the transport speed results in increased tension on the photothermographic material or further fluctuation in tension, leading to an increased dimensional change, which deteriorates reproducibility.

The present invention was achieved in response to the foregoing, and it is therefore an object of the invention to provide a processing method of photothermographic materials, thereby enabling to obtaining high contrast images without increased fogging, reducing variation of photographic performance and dimensional change, fluctuation in image density and dot percentage, and also enhancing productivity.

The object of the invention can be accomplished by the following constitution:

1. A method of processing a photothermographic material comprising the step of:
   heat-developing the photothermographic material in an automatic thermal processor,
   wherein the photothermographic material comprises a support, a light sensitive silver halide, an organic silver salt, a reducing agent and a contrast-increasing agent,
   and wherein in the step of heat-developing, the photothermographic material is allowed to be transported at a speed of 22 to 40 mm/sec.; and the photothermographic material is allowed to pass through an atmosphere of not less than 117° C. in not less than 10 sec., and then to pass while being brought into contact with the surface of a heating member exhibiting a surface temperature of 90 to 115° C. or in the vicinity of the surface of the heating member;
2. The method described in 1, wherein the heating member exhibiting a surface temperature of 90 to 115° C. is a final temperature-controlled heating member in the thermal processor;
3. The method described in 1, wherein the photothermographic material is allowed to pass through an atmosphere of not less than 117° C. in not less than 10 sec., and then to pass within 10 sec., while being brought into contact with the surface of a heating member exhibiting a surface temperature of 90 to 115° C., or in the vicinity of the surface of the heating member;
4. The method described in 1, wherein the thermal processor comprises a heat-developing section, the heat-developing section being provided with a napped material;

5. The method described in 1, wherein the support exhibits a thermal dimensional change under 125° C. for 25 sec. of 0.001 to 0.04%;
6. The method described in 1, wherein the support has a thickness of 110 to 150 μm;
7. The method described in 1, wherein when the photothermographic material is heated from 25° C. to 115° C. in 8 to 12 sec. and then heat-developed at 115° C. in not less than 10 sec., the photothermographic material exhibits a contrast of 6 or more;
8. The method described in 1, wherein when the photothermographic material is transported in an atmosphere of a temperature of 60 to 130° C. at a speed of 22 to 40 mm/sec. and developed for a period of 25 sec., the photothermographic material exhibits a contrast of 6 or more;
9. An automatic thermal processor for heat-developing an exposed photothermographic material comprising a heat-developing section, wherein a transport speed of the photothermographic material in the heat-developing section is 22 to 40 mm/sec. and the heat-developing section is under an atmosphere of a temperature of not less than 117° C.; the photographic material is allowed to pass through the atmosphere of not less than 117° C. in not less than 10 sec., and then to pass, while being brought into contact with the surface of a heating member exhibiting a surface temperature of 90 to 115° C. or in the vicinity of the surface of the heating member;
10. The thermal processor described in 9, wherein the heating member exhibiting a surface temperature of 90 to 115° C. is a final temperature-controlled heating member in the thermal processor;
11. The thermal processor described in 9, wherein the photothermographic material is allowed to pass through an atmosphere of not less than 117° C. in not less than 10 sec., and then to pass while being brought into contact with the surface of a heating member exhibiting a surface temperature of 90 to 115° C. or in the vicinity of the surface of the heating member within 10 sec.;
12. The thermal processor described in 9, wherein the thermal processor comprises a heat-developing section, the heat-developing section being provided with a napped material;
13. A method for processing a photothermographic material comprising a support having thereon a light sensitive silver halide grains, a reducing agent and a contrast-increasing agent by the use of a thermal processor, wherein in the thermal processor, a transport speed is 22 to 40 m/sec. and a final temperature-controlled heat source in the processing step exhibits a temperature of 90 to 115° C.;
14. A method for processing a photothermographic material comprising a support having thereon a light sensitive silver halide grains, a reducing agent and a contrast-increasing agent by the use of a thermal processor, wherein the thermal processor comprises the steps of transporting the photothermographic material in an atmosphere of 117° C. or higher at a transport speed of 22 to 40 mm/sec for a period of 10 sec. or longer, and then bringing the photothermographic material into contact with the surface of a heating member exhibiting a surface temperature of 90 to 115° C., and the photothermographic material is brought into contact with the surface of the heating member within 10 sec. after passing through the step of transporting in an atmosphere of 117° C. or higher for a period of 10 sec or longer;

15. A method for processing a photothermographic material comprising a support having thereon light sensitive silver halide grains, a reducing agent and a contrast-increasing agent by the use of a thermal processor, wherein in the thermal processor, a transport speed is 22 to 40 m/sec. and a heat-developing section is provided with a napped material; and in 13, 14 or 15 described above, the support of the photothermographic material exhibits a thermal dimensional change at 125° C. for 25 sec. of 0.001 to 0.045 and a thickness of 110 to 150 μm;
16. A method for processing a photothermographic material comprising a support having thereon a light sensitive silver halide grains, a reducing agent and a contrast-increasing agent in a thermal processor, wherein in the thermal processor, a transport speed is 22 to 40 m/sec. and a final temperature-controlled heat source in the processing step exhibits a temperature of 90 to 115° C.;
17. A method for processing a photothermographic material comprising a support having thereon light sensitive silver halide grains, a reducing agent and a contrast-increasing agent by the use of a thermal processor, wherein in the thermal processor, a transport speed is 22 to 40 m/sec. and a heat-developing section is provided with a napped material; and
18. the method described in 16 or 17, wherein the support of the photothermographic material exhibits a thermal dimensional change at 125° C. for 25 sec. of 0.001 to 0.04%.

Assuming that fluctuations in image density caused by an increase in processing speed are ascribed to a cooling history after development, the inventors of the present invention found that development reaction of an organic silver salt as a silver source scarcely proceeds at a temperature lower than 115° C. and therefore the reaction could be stopped by changing to this temperature. Thus, the invention described in 1 above was achieved by controlling the region of changing from the developing temperature to a temperature lower than 115° C.

In heat development of a photothermographic material in which an intended developed image can be obtained by heating at not less than 117° C. for a period of not less than 10 sec., temperature control is indispensable to obtain the intended image. In the commonly known thermal processing process, various attempts have been made to prevent development unevenness caused by non-uniform temperature wit respect to the step of raising a photothermographic material from room temperature to a developing temperature. Although temperature control prior to development is important, it was proved that the step of lowering the temperature after development greatly affects photographic performance, that is, photographic performance was markedly variable by temperature-lowering pattern after heat-developing step, i.e., after passing through an atmosphere of 117° C. or higher. Thus, it was found that fluctuation in density of developed portions, fluctuation in dot percentage of halftone dot images, linearity and reproducibility of dimensional change can be improved by bringing the photothermographic material into contact with a member exhibiting a surface temperature of 90 to 115° C. after the developing step at 117° C. or higher.

Further, considering that increasing the transport speed increases tension applied to a photothermographic material, tension applied to a photothermographic sheet is different between the center and side portions and tension is also different between the transport positions, uneven development and dimensional change were improved by using a napped material in the developing section to make uniform tension applied to the photothermographic material. The invention described in 2. above was thus achieved.

The present invention found pronounced effects in improvements of density unevenness, linearity and reproducibility of dimensional change.

Figure 1:
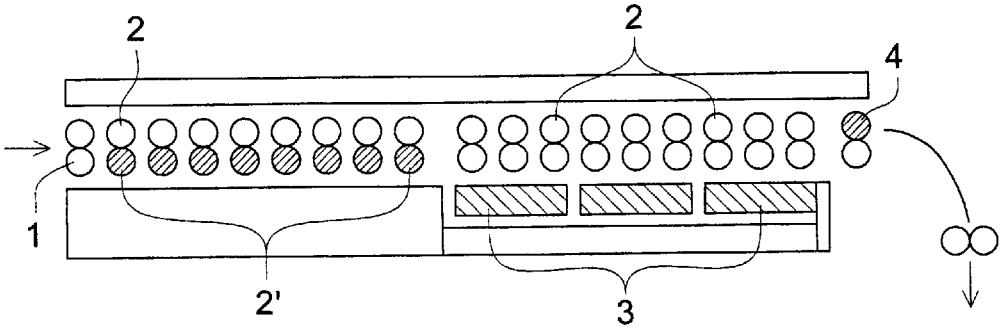
FIG. 1 illustrates a thermal processor used in the invention.

Explanation of numeral:

1: Insertion roller

2: Transport roller pair

3: Block heater

4: Roller containing a ceramic heater.

DETAILED DESCRIPTION OF THE INVENTION

The photothermographic material used in this invention comprises a support, a light sensitive silver halide, an organic silver salt, a reducing agent for a silver ion and a contrast-increasing agent. The photographic material preferably comprises a support provided thereon with an image forming layer (hereinafter, also denoted as a light sensitive layer). The image forming layer preferably contains a binder, a light sensitive silver halide and an organic silver salt. The photothermographic material may be provided with at least a component layer other than the image forming layer. Examples of such component layer include a sublayer, an antihalation layer, a protective layer, an antistatic layer and so on. The reducing agent or contrast-increasing agent may be contained in the image forming layer or a component layer adjacent to the image forming layer.

Processing of photothermographic materials according to this invention is conducted by heat-developing (or thermally developing) a light-exposed photothermographic material in an automatic thermal processor. In the heat-developing step, the photothermographic material is transported at a speed of 22 to 40 mm/sec (and preferably 22 to 26 mm/sec). In the processing method of this invention, the photothermographic material is allowed to pass through an atmosphere of 117° C. or higher in at least 10 sec. Thereafter, the photothermographic material further passes through an atmosphere of 90 to 115° C., for example, the photothermographic material is allowed to pass while being brought into contact with the surface of a heating member exhibiting a surface temperature of 90 to 115° C., or to pass in the vicinity of the surface of the heating member, without being in contact with the heating member. Herein, the expression "in the vicinity of the surface of the heating member" refers to the location close to the surface of the heating member, and preferably the location within 1 cm from the surface of the heating member. The surface temperature of the heating member is preferably 100 to 110° C. According to this invention, images exhibiting little fluctuation in density and halftone dot percentage and also superior linearity can be obtained.

The heating member exhibiting a surface temperature of 90 to 115° C. preferably is the final temperature-controlled heating member in the thermal processor. The final heating member refers to a heating member situated at the end position in the transporting direction of the transport route of the photothermographic material, among temperature-controlled heating member(s) provided in the thermal processor used in this invention. The temperature-control of the heating member includes not only controlling the temperature to a precision of a 1° C. unit or 0.1° C. unit but also controlling the temperature roughly in such a way that it is operated to on whereupon exceeding a given temperature or to off whereupon falling below a given temperature. The heating member exhibiting a surface temperature of 90 to 115° C. may be provided at the end of the heat-developing step, at the top of the cooling step, or between the heat-developing and cooling steps.

The transport speed of the photothermographic material is preferably constant in the heat-developing step. In cases where a cooling step is provided, the transport speed in the first half of the cooling step is preferably 22 to 40 mm/sec., more preferably, the transport speed in the overall cooling step is 22 to 40 mm/sec., and still more preferably, the transport speed in the overall steps of the thermal processor is 22 to 40 mm/sec.

The photothermographic material passes through an atmosphere of 117° C. or higher taking a time of at least 10 sec.; thereafter, the photothermographic material passes through an atmosphere of 90 to 115° C., e.g., the photothermographic material passes while being brought into contact with a heating member exhibiting a surface temperature of 90 to 115° C., or passes near the heating member without being brought into contact with the heating member, within 10 sec. (preferably 1 to 10 sec., and more preferably 1 to 5 sec.).

The automatic thermal processor used in this invention comprises a heat-developing section. The heat-developing section is preferably provided with a napped material. In cases where the heat-developing section comprises at least a transport roller and an opposed planar heating member and the photothermographic material is transported by the transport roller between the transport roller and the planar heating member, for example, the planar heating member is preferably provided with the napped material. In cases where the heat-developing section comprises a transport belt, the transport belt is preferably provided with the napped material.

After being heated from 25° C. to 115° C. in 8 to 12 sec. and then heat-developed at 115° in at least 10 sec., the photothermographic material preferably exhibits a contrast ($\gamma$) of not less than 6. Alternatively, after being transported in an atmosphere of 60 to 130° C. at a speed of 22 to 40 mm/sec. and heat-developed for a period of 25 sec., the photothermographic material preferably exhibits a contrast of not less than 6. Specifically, when the photothermographic material is allowed to pass through an atmosphere of 117° C. or higher at a transport speed of 22 to 40 mm/sec. in at least 10 sec. and then allowed to pass through an atmosphere of 90 to 115° (e.g., the photothermographic material is allowed to pass while being in contact with a heating member exhibiting a surface temperature of 90 to 115° C. or to pass through near the heating member without being in contact with the heating member), the photothermographic material preferably exhibits a contrast of not less than 6.

One feature of this invention is that, after the photothermographic material is brought into contact with a final temperature-controllable heat source maintained at a temperature of 90 to 115° C. or a heating member exhibiting a surface temperature of 90 to 115° C., at the end of heat-developing step or after heat-developing. Thus, the photothermographic material which has completed the developing step is immediately introduced to the cooling step. The transport roller temperature is affected by the amount of material being processed and environment under the influence of the ambient temperature and the heat emitted from the developing section. In this case, variation of photographic performance and dimensional change can be improved by controlling the temperature of a heat source heating the first roller in the cooling section to the range as claimed in the invention. The temperature is preferably controlled to 90 to 115° C., and more preferably 100 to 110° C. The lower temperature more efficiently inhibits development. However, in cases where the temperature is excessively lowered, the temperature gradient becomes larger, producing unsuitable temperature fluctuation within the image area. For example, development of silver behenate hardly proceeds at a temperature of less than 110° C. so that it is preferred to control the temperature to 110 to 110° C. Abrupt cooling deteriorates reproducibility of dimensional change, so that gradual cooling is preferred and a temperature of 90 to 110° C. is preferred in terms of suppression of dimensional change. After passing through the step of 117° C. or higher, it is preferred to contact with a heating member exhibiting a surface temperature of 90 to 115° C. within 10 sec. The contact within 10 sec. (preferably to 10 sec,. and more preferably 1 to 5 sec.) leads to improvements in density fluctuation and dimension reproducibility.

The napped material used in the developing section refers to velvet-like cloth and any such materials exhibiting a glass transition point higher than the developing temperature is applicable. The length of fibers on the surface of the cloth is preferably 0.5 to 5 mm. A length of less than 0.5 mm exhibits no napping effect. In the case of being more than 5 mm, the photothermographic material often meanders, causing transport trouble. Examples of raw materials for the napping material include velvet, glass cloth, carbon cloth and aramid cloth.

When heated at 125° C. for 25 sec., the thermal dimensional change of a support used in a photothermographic material is preferably 0.001 to 0.04%, more preferably 0.002 to 0.03%, and still more preferably 0.003 to 0.02%. It is preferred that the thermal dimensional change meet the above-described requirement with respect to both of the longitudinal and width directions.

Polymeric material providing such a dimensional change to a support are one having a high Tg, including a polyester type polymer, polycarbonate type polymer, polyacrylate type polymer, polyetherimide type polymer, polysufon type polymer, polyethersulfon type polymer and syndiotactic polystyrene type polymer. Of these polymers, polyester type polymer, polycarbonate type polymer and polyacrylate type polymer are preferred and a polyester type polymer is specifically preferred. Specifically preferred supports include supports of resin of polyethylene terephthalate (hereinafter, also denoted as PET) and styrene type polymer having a syndiotactic structure (also denoted as SPS). The thicker support exhibits a higher heat capacity and is preferable to reduce a dimensional change. In the case of being excessively thick, however, a transport trouble easily occurs and heat absorption by the support results in insufficient heating of the photosensitive layer, leading to deteriorated photographic performance. In the case of being excessively thin, the photothermographic material is excessively heated to increase a dimensional change or cause transport troubles. Accordingly, the thickness of a support is preferably 110 to 150 μm.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, the ligand of which has a total stability constant to a silver ion of 4.0 to 10.0 are preferred. Exemplary preferred complex salts are described in Research Disclosure 17029 and 29963. Preferred silver source is silver behenate, silver arachidate or silver stearate.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed.

Organic silver salts preferably have an average grain diameter of 0.2 to 1.2 μm, and more preferably 0.35 to 1.0 μm. The organic silver salt particles preferably are monodisperse, and the monodispersibility as defined below is preferably 1 to 30%:

Monodispersibility=(standard deviation of grain diameter)/(average grain diameter)×100(%).

Silver halide grains function as a light sensor. In order to minimize cloudiness after image formation and to obtain excellent image quality, the less the average grain size, the more preferred, and the average grain size is preferably less than 0.1 μm, more preferably between 0.01 and 0.1 μm, and still more preferably between 0.02 and 0.08 μm. The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain. Furthermore, silver halide grains are preferably monodisperse grains. The monodisperse grains as described herein refer to grains having a monodispersibility obtained by the formula described above of less than 40%; more preferably less than 30%, and most preferably from 0.1 to 20%.

The silver halide grain shape is not specifically limited, but a high ratio accounted for by a Miller index [100] plane is preferred. This ratio is preferably at least 50%; is more preferably at least 70%, and is most preferably at least 80%. Furthermore, another preferred silver halide shape is a tabular grain. The tabular grain as described herein is a grain having an aspect ratio represented by r/h of at least 3, wherein r represents a grain diameter in μm defined as the square root of the projection area, and h represents thickness in μm in the vertical direction. of these, the aspect ratio is preferably between 3 and 50. The grain diameter is preferably not more than 0.1 μm, and is more preferably between 0.01 and 0.08 μm.

The composition of silver halide may be any of silver chloride, silver chlorobromide, silver iodochlorobromide, silver bromide, silver iodobromide, or silver iodide. Silver halide emulsions used in the invention can be prepared according to any method known in the art. Thus, any one of acidic precipitation, neutral precipitation and ammoniacal precipitation is applicable and the reaction mode of aqueous soluble silver salt and halide salt includes single jet addition, double jet addition and a combination thereof. Silver halide may be incorporated into the image forming layer by any means so that the silver halide is arranged so as to be close to reducible silver source. Silver halide may be mixed with a previously-prepared organic silver salt. Silver halide may be prepared by converting at least a part of the organic silver salt to silver halide through reaction of an organic acid with a halide ion silver halide, alternatively, silver halide which has been prepared may be added into a solution used for preparing an organic silver salt, and the latter is preferred. Silver halide is contained preferably in an amount of 0.75 to 30% by weight, based on an organic silver salt.

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au. Silver halide grain emulsions used in the invention may be desalted after the grain formation, using the methods known in the art, such as the noodle washing method and flocculation process. The photosensitive silver halide grains used in the invention is preferably subjected to a chemical sensitization. As preferable chemical sensitizations, well known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available.

To prevent hazing of the photosensitive material, the total amount of silver halide and organic silver salt is preferably 0.5 to 2.2 g in equivalent converted to silver per $m^2$, leading to high contrast images.

Reducing agents are preferably incorporated into the thermally developable photosensitive material of the present invention. Examples of suitable reducing agents are described in U.S. Pat. Nos. 3,770,448, 3,773,512, and 3,593,863, and Research Disclosure Items 17029 and 29963. Of these, particularly preferred reducing agents are hindered phenols. As hindered phenols, compounds represented by the following formula (A) are preferred:

Formula (A)

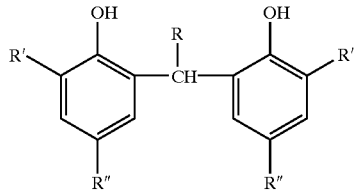

wherein R represents a hydrogen ato(e.g., —$C_4H_9$, 2,4,4-trimethylpentyl), and R' and R" each represents an alkyl group having from 1 to 5 carbon atoms (for example, methyl, ethyl, t-butyl).

Exemplary examples of the compounds represented by the formula (A) are shown below.

A-1

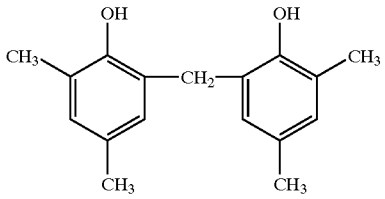

-continued

A-2

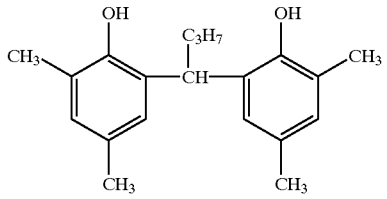

A-3

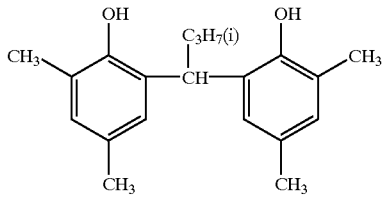

A-4

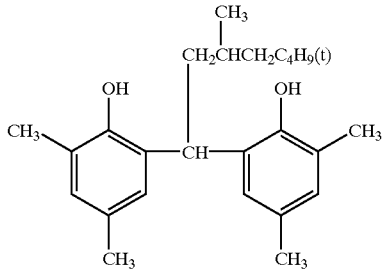

A-5

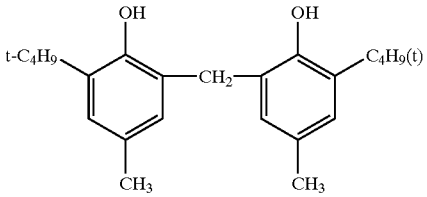

A-6

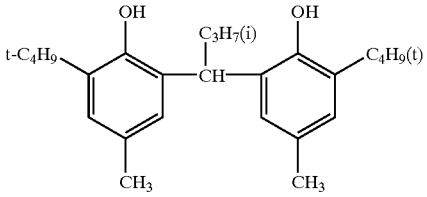

A-7

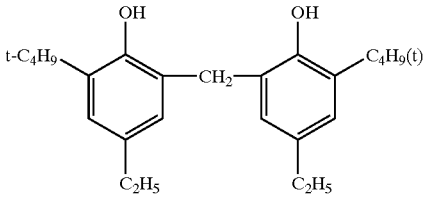

Further, compounds represented by the following formula (B) are also preferred as a reducing agent:

Formula (B)

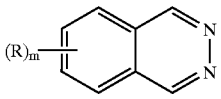

wherein R is an alkyl group and m is an integer of 1 to 4, provided that when m is 2 or more, the R may be the same or different from each other.

The used amount of reducing agents represented by the above-mentioned general formula (A) or (B) is preferably between $1\times10^{-2}$ and 10 moles, and is more preferably between $1\times10^{-2}$ and 1.5 moles per mole of silver.

Exemplary preferred examples of the contrast-increasing agent include hydrazine derivatives, quaternary onium compounds and vinyl type compounds.

Preferred hydrazine derivatives are represented by the following formula (H):

Formula (H)

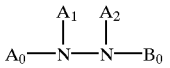

In the formula, $A_0$ is an aliphatic group, aromatic group, heterocyclic group, each of which may be substituted, or —$G_0$—$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=N$G_1D_1$)—, —SO—, —$SO_2$— or —P(O)($G_1D_1$)— group, in which $G_1$ is a linkage group, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and Do is an aliphatic group, aromatic group, heterocyclic group, amino group, alkoxy group, aryloxy group, alkylthio group or arylthio group.

In Formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfooxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ of formula (H) is preferably a monocyclic or condensed-polycyclic one containing at least one hetero-atom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. In the —$G_0$—$D_0$ group represented by $A_0$, $G_0$ is a —CO—, —COCO—, —CS—, —C(=N$G_1D_1$)—, —SO—, —$SO_2$— or —P(O)($G_1D_l$)— group, in which $G_1$ is a linkage group, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is an aliphatic group, aromatic group, heterocyclic group, amino group, alkoxy group,. aryloxy group, alkylthio group or arylthio group, and preferred $D_0$ is a hydrogen atom, or an alkyl, alkoxyl or amino group. The aromatic group, heterocyclic group or —$G_0$—$D_0$ group represented by $A_0$ each may be substituted.

Specifically preferred $A_0$ is an aryl group or —$G_0$—$D_0$ group. $A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439. In Formula (H), $B_0$ is a blocking group, and preferably —$G_0$—$D_0$, wherein $G_0$ is a —CO—, —COCO—, —CS—, —C(=N$G_1D_1$)—, —SO—, —$SO_2$— or —P(O)($G_1D_1$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxyl or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxalyl).

A compound represented by formula [H] is exemplified as below, but the present invention is not limited thereto.

H-1

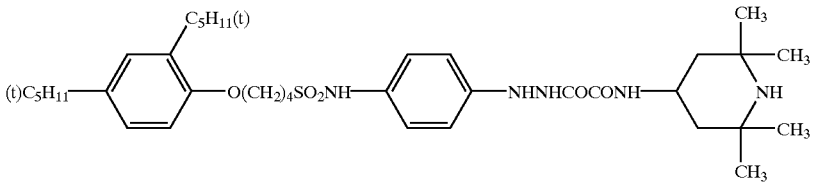

-continued
H-2
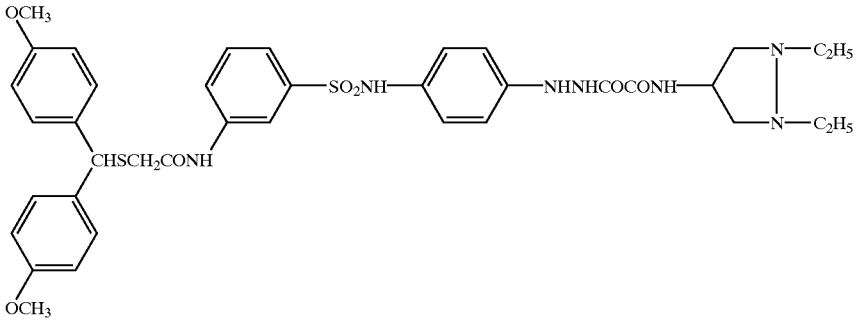
H-3
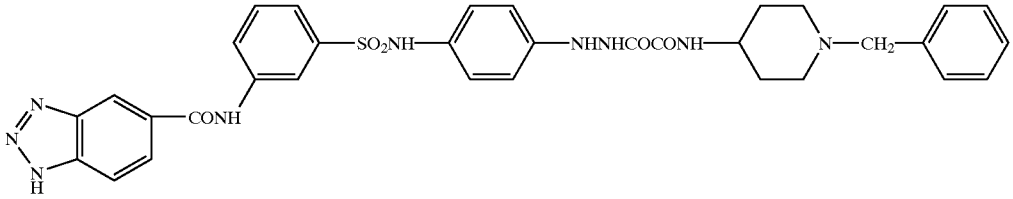
H-4
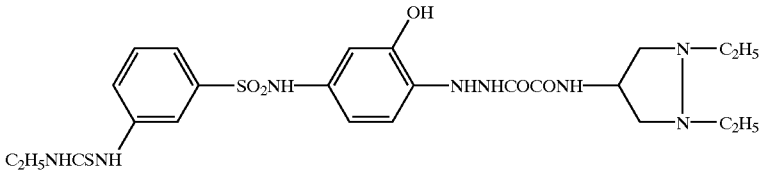
H-5
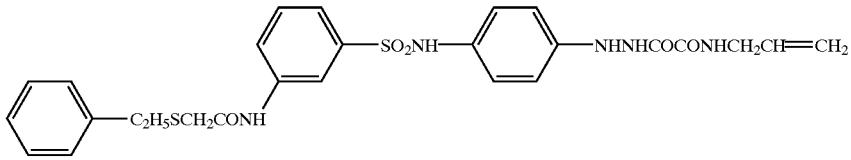
H-6
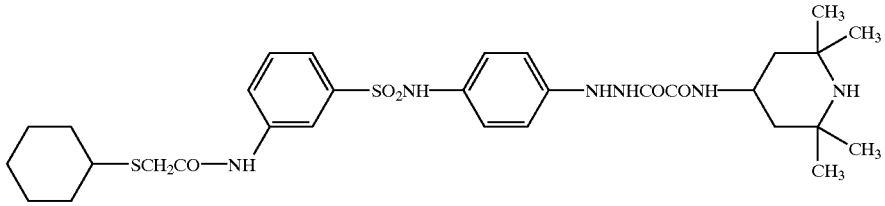
H-7
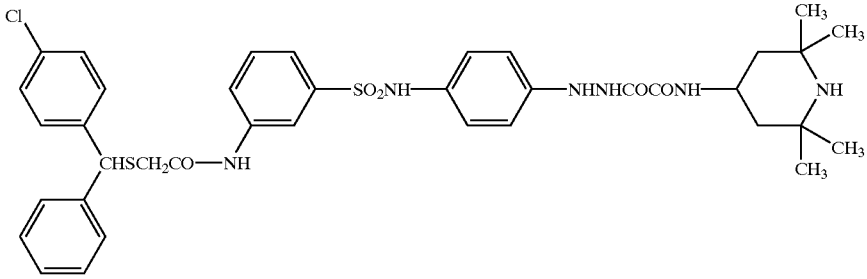
H-8
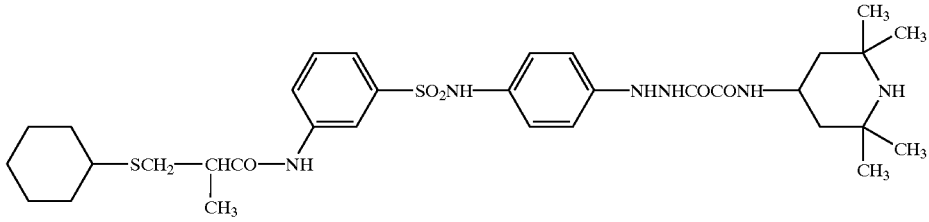

-continued
H-9
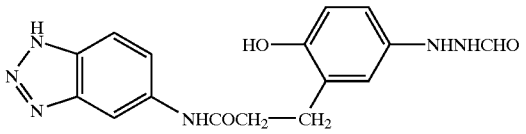
H-10
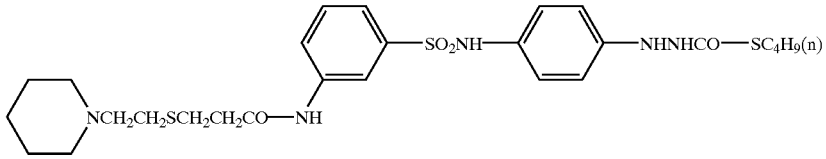
H-11
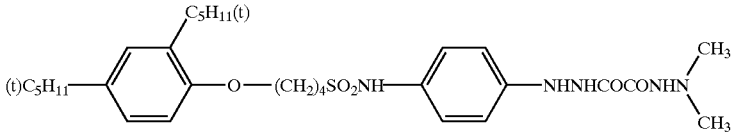
H-12
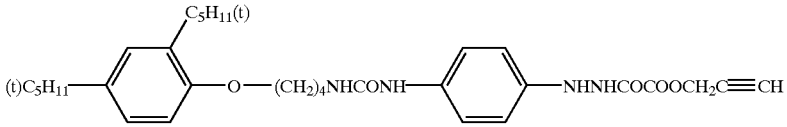
H-13
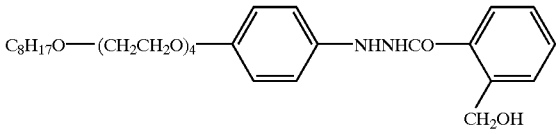
H-14
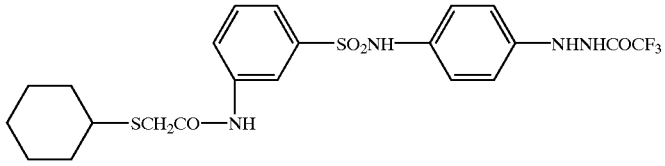
H-15
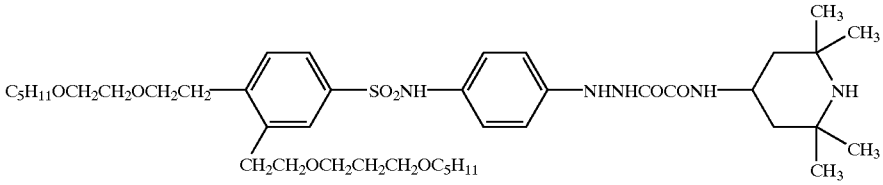
H-16
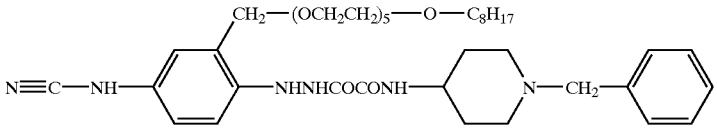
H-17
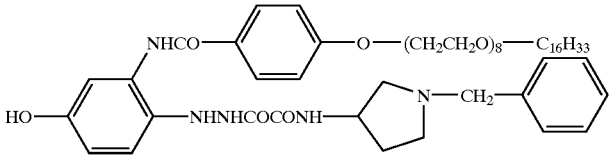
H-18
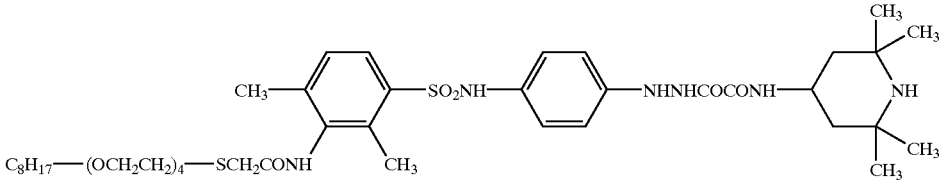

-continued
H-19
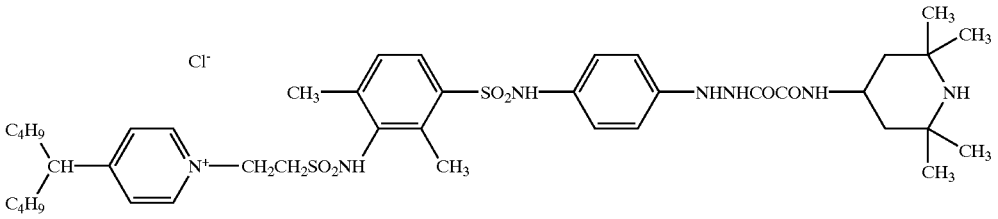
H-20
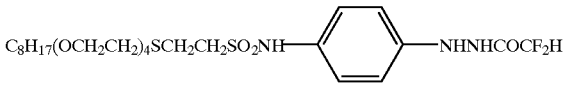
H-21
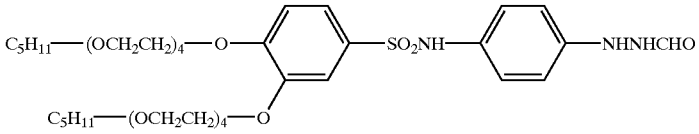
H-22
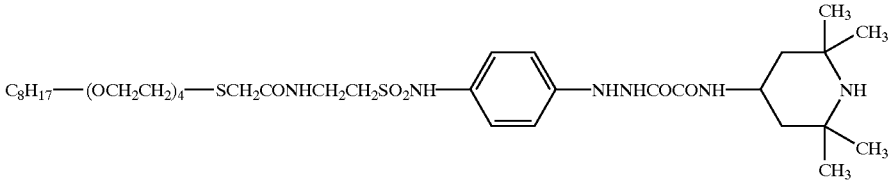
H-23
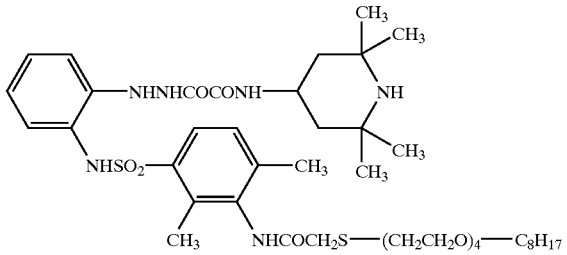
H-24
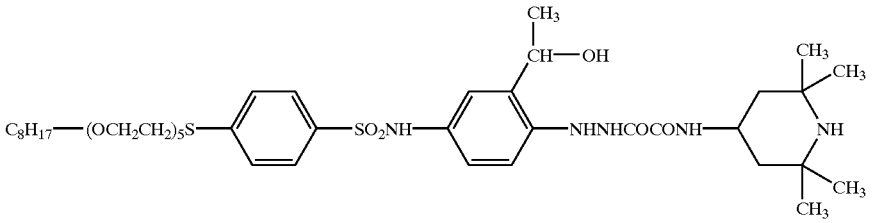
H-25
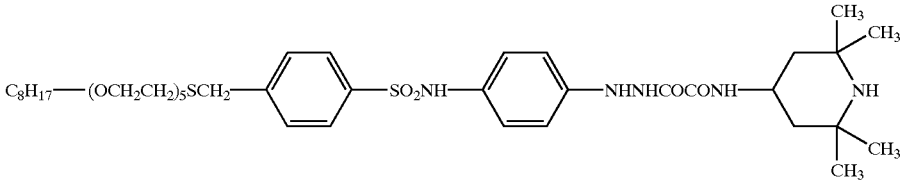

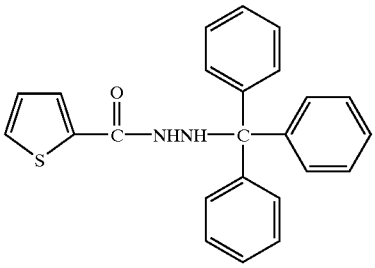

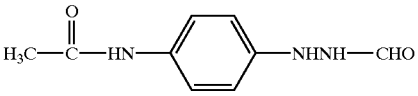

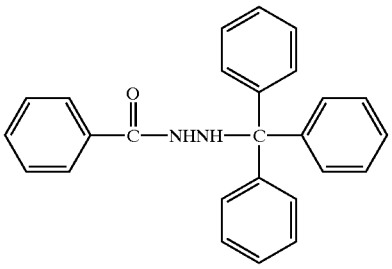

More preferred hydrazine derivatives are those which are represented by the following formulas (h-1), (H-2), (H-3), (H-4) and (H-5):

formula (H-1)

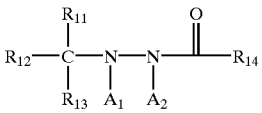

wherein $R_{11}$, $R_{12}$ and $R_{13}$ are each a substituted or unsubstituted ary group or substituted or unsubstituted heteroary group (or an aromatic heterocyclic group); $R_{14}$ is heterocyclic-oxy group or a heteroarylthio group; $A_1$ and $A_2$ are both hydrogen atoms, or one of them is a hydrogen atom and the other is an acyl group, alkylsulfonyl group or oxalyl group;

formula (H-2)

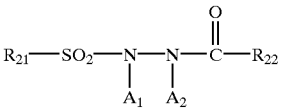

wherein $R_{21}$ is a substituted or unsubstituted alkyl group, aryl group or heteroaryl group; $R_{22}$ is a hydrogen atom, an alkylamino group, an arylamino group, or heteroarylamino group; A1 and A2 are the same as defined in formula (H-1);

-continued

H-26

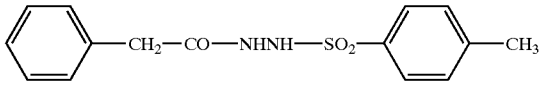

H-27

H-28

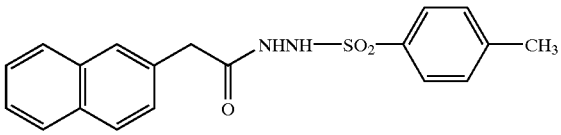

H-29

H-30 formula (H-3)

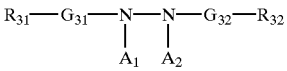

wherein $G_{31}$ and $G_{32}$ are each a —(CO)p— or —C(═S)— group, a sulfonyl group, a sulfoxy group, a —P(═O)$R_{33}$— group, or an iminomethylene group, in which p is 1 or 2, and $R_{33}$ is an alkyl group, an alkenyl group, an alkynyl group, an aryl group, an alkoxy group, an alkenyloxy group, an alkynyloxy group, an arylamino group or an amino group, provided that when $G_{31}$ is a sulfonyl group, $G_{32}$ is not a carbonyl group; $R_{31}$ and $R_{32}$ are each a univalent substituent group; and $A_1$ and $A_2$ are each the same as defined in formula (H-1);

formula (H-4)

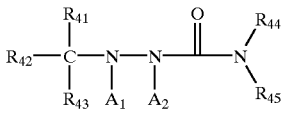

wherein $R_{41}$, $R_{42}$ and $R_{43}$ are each a substituted or unsubstituted aryl group or a substituted or unsubstituted heteroaryl group;$R_{44}$ and $R_{45}$ a substituted or unsubstituted alkyl group; and $A_1$ and $A_2$ are the same as defined in formula (H-1);

formula (H-5)

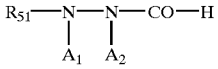

wherein $R_{51}$ is an alkyl group, an alkenyl group, an alkynyl group, an aralkyl group, a heterocyclic group, a substituted amino group, an alkylamino group, an arylamino group, heterocyclic-amino group, a hydrazine group, an alkoxy group, an aryloxy group, a heterocyclic-oxy group, an alkylthio group, an arylthio group, a heterocyclic-thio group, an alkoxycarbonyl group, an aryloxycarbonyl group, a heterocyclic-oxycarbonyl group, an alkylthiocarbonyl group, an arylthiocarbonyl group, a heterocyclic-thiocarbonyl group, a carbamoyl group, a carbamoyloxy group, a carbamoylthio group, a carbazoyl group, anoxalyl group, an alkoxyureido group, an aryloxyureido group or a heterocyclic-oxyureido group; and $A_1$ and $A_2$ are the same as defined in formula (H-1).

In formula (H-1), examples of the aryl group represented by $R_{11}$, $R_{12}$ or $R_{13}$ include phenyl, p-methylphenyl and naphthyl and examples of the heteroaryl group include a triazole residue, imidazole residue, pyridine residue, furan residue and thiophene residue. $R_{11}$, $R_{12}$ or $R_{13}$ may combine together with each other through a linkage group. Substituents which $R_{11}$, $R_{12}$ or $R_{13}$ each may have include, for example, an alkyl group, an alkenyl group, an alkynyl group, an aryl group, a heterocyclic group, a quaternary nitrogen containing heterocyclic group (e.g., pyridionyl), hydroxy, an alkoxy group (including containing a repeating unit of ethyleneoxy or propyleneoxy), an aryloxy group, an acyloxy group, an acyl group, an alkoxycarbonyl group, an aryloxycarbonyl group, a carbamoyl group, a urethane group, carboxy, an imodo group, an amino group, a carbonamido group, a sulfonamido group, a ureido group, a thioureido group, a sulfamoylamino group, semicarbazido group, thiosemocarbaido group, hydrazine group, a quaternary ammonio group, an alkyl-, aryl- or heterocyclic-thio group, mercapto group, an alkyl- or aryl-sufonyl group, an alkyl- or aryl-sulfinyl group, sulfo group, sulfamoyl group, an acylsufamoyl group, an alkyl or aryl-sulfonylureido group, an alkyl- or aryl-sulfonylcarbamoyl group, a halogen atom, cyano, nitro, and phosphoric acid amido group. All of $R_{11}$, $R_{12}$ and $R_{13}$ are preferably phenyl groups and more preferably unsubstituted phenyl groups.

Examples of the heteroaryl group represented by $R_{14}$ include a pyridyloxy group, benzimidazolyl group, benzothiazolyl group, benzimidazolyloxy group, furyloxy group, thienyloxy group, pyrazolyloxy group, and imidazolyloxy group; and examples of the heteroarylthio group include a pyridylthio group, pyrimidylthio group, indolylthio group, benzothiazolylthio, benzoimidazolylthio group, furylthio group, thienylthio group, pyrazolylthio group, and imidazolylthio group. $R_{14}$ is preferably a pyridyloxy or thenyloxy group.

Examples of the acyl group represented by $A_1$ and $A_2$ include acety, trifluoroacetyl and benzoyl; examples of the sulfonyl group include methanesulfonyl and toluenesulfonyl; and examples of the oxalyl group include ethoxalyl. $A_1$ and $A_2$ are preferably both hydrogen atoms.

In formula (H-2), examples of the alkyl group represented by R21 include methyl, ethyl, t-butyl, 2-octyl, cyclohexyl, benzyl, and diphenylmethyl; the aryl group, the heteroaryl group and the substituent groups are the same as defined in $R_{11}$, $R_{12}$ and $R_{13}$. $R_{21}$ is preferably an aryl group or a heterocyclic group, and more preferably a phenyl group. Examples of the alkylamino group represented by $R_{22}$ include methylamino, ethylamino, propylamino, butylamino, dimethylamino diethylamino, and methylethylamino; examples of the arylamino group include anilino; and examples of the heteroaryl group include thiazolylamino, benzimidazolylamino, and benzthiazolylamino. $R_{22}$ is preferably dimethylamino or diethylamino.

In formula (H-3), the univalent substituent groups represented by $R_{31}$ and $R_{32}$ are the same as defined in formula (H-1), preferably an alkyl group, an aryl group, a heteroaryl group, an alkoxy group and an amino group, more preferably an aryl group or an alkoxy group, and specifically preferably, $R_{31}$ is phenyl and $R_{32}$ t-butoxycarbonyl. G31 and G32 are preferably —CO—, —COCO—, a sulfonyl group or —CS—, and are more preferably both —CO— groups or sulfonyl groups.

In formula (H-4), $R_{41}$, $R_{42}$ and $R_{43}$ are the same as defined in $R_{11}$, $R_{12}$ and $R_{13}$ of formula (H-1). $R_{41}$, $R_{42}$ and $R_{43}$ are all phenyl groups, and are more preferably all unsubstituted phenyl groups. The substituted or unsubstituted alkyl groups represented by $R_{44}$ and $R_{45}$ include, for example, methyl, ethyl, t-butyl, 2-octyl, cyclohexyl, benzyl, and diphenylmethyl, and are preferably both ethyl groups.

In formula (H-5), $R_{51}$ is the same as defined $R_{11}$, $R_{21}$, $R_{31}$ and $R_{41}$; and $A_1$ and $A_2$ are the same as defined in formula (H-1).

Exemplary examples of the compounds represented by formulas (H-1) through (H-5) are shown below, but are not limited to these.

H-1-1

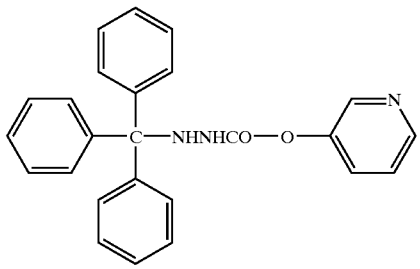

H-1-2

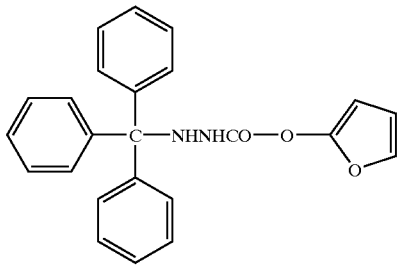

-continued
H-1-3
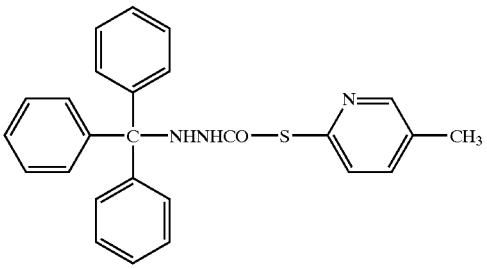
H-1-4
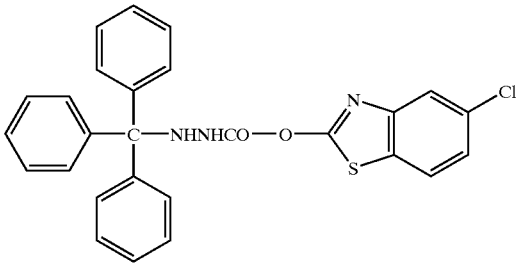
H-1-5
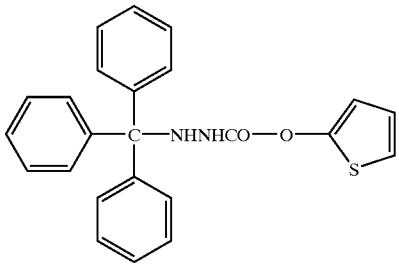
H-1-6
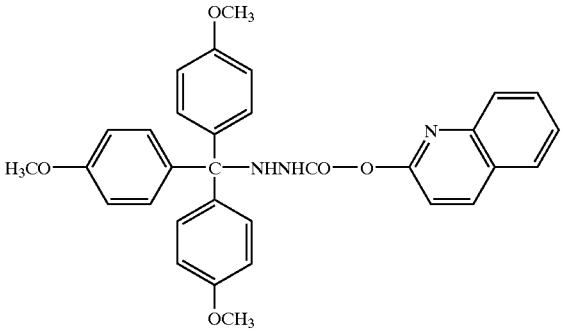
H-1-7
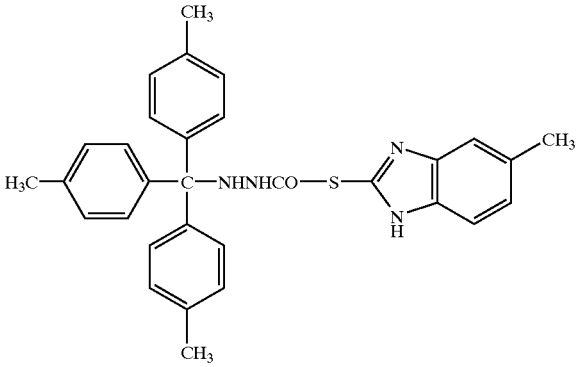
-continued
H-1-8
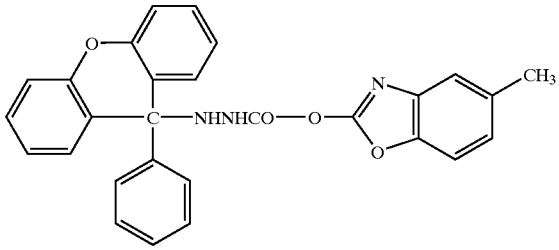
H-1-9
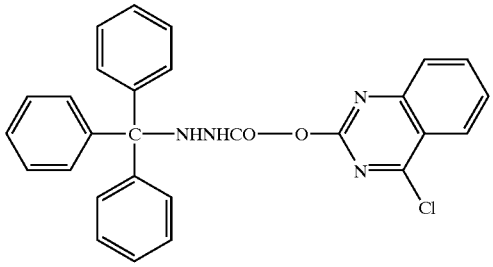
H-1-10
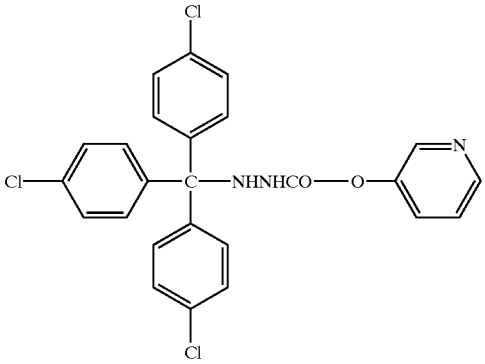
H-1-11
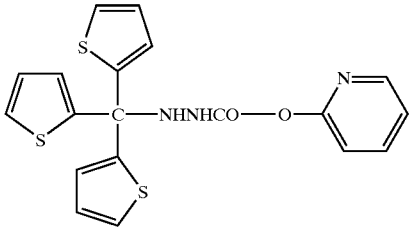
H-1-12
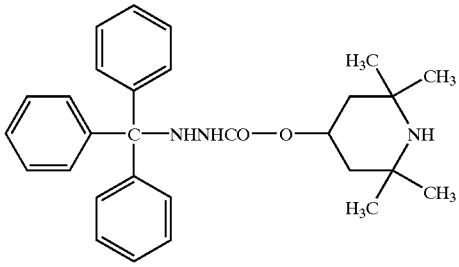
H-2-1
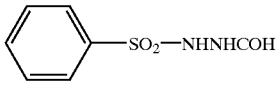

-continued
H-2-2
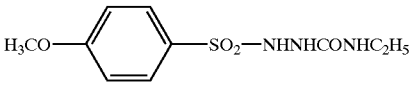
H-2-3
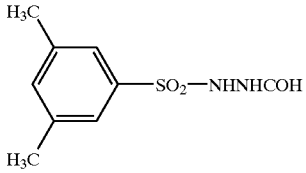
H-2-4
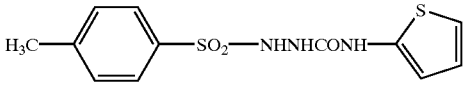
H-2-5
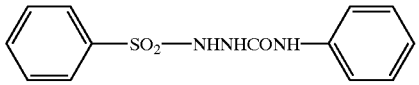
H-2-6
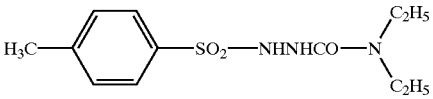
H-2-7
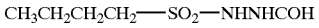
H-2-8
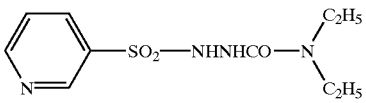
H-2-9
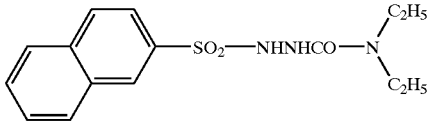
H-3-1
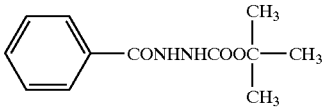
H-3-2
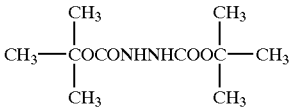
H-3-3
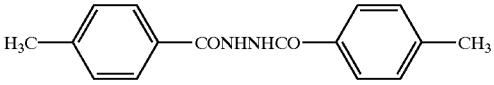
H-3-4
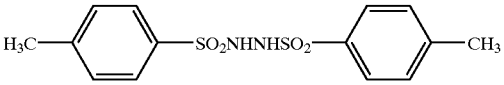
H-3-5
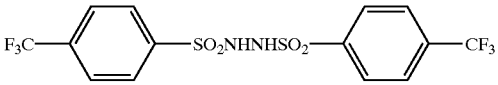
-continued
H-3-6
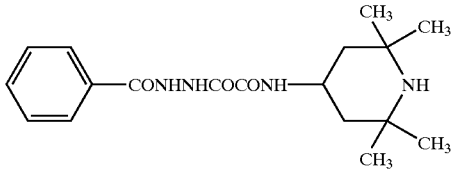
H-3-7
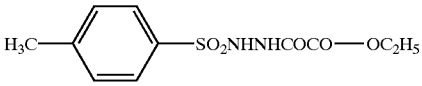
H-3-8
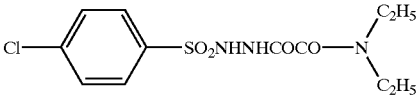
H-3-9
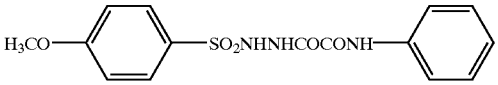
H-3-10
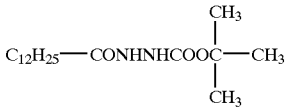
H-3-11
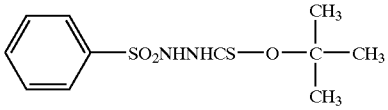
H-3-12
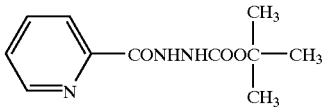
H-4-1
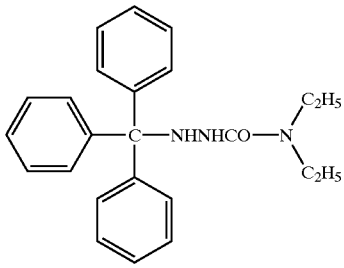
H-4-2
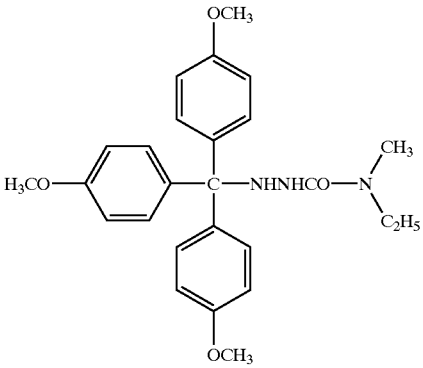

-continued
H-4-3
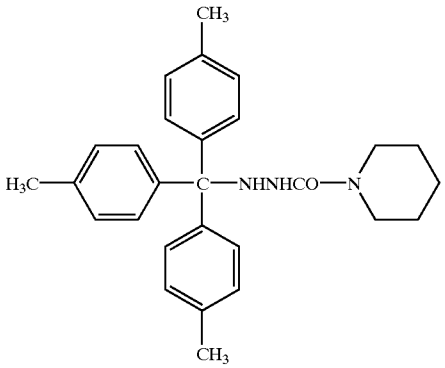
H-4-4
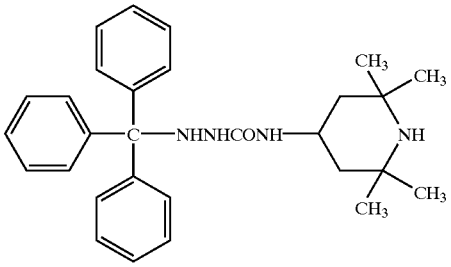
H-4-5
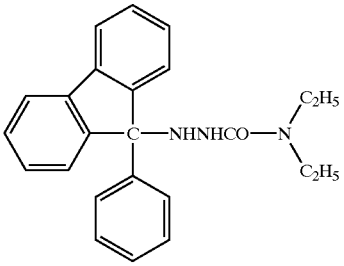
H-31
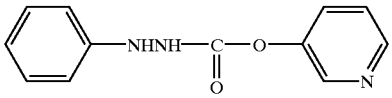
H-32
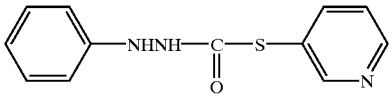
H-33
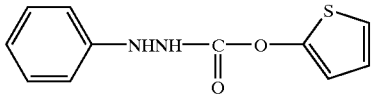
H-34
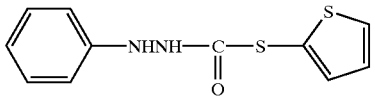
H-35
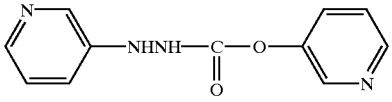
H-36
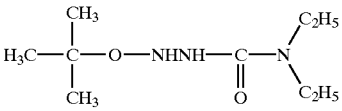
-continued
H-37
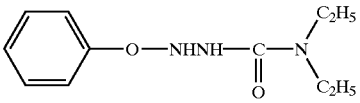
H-38
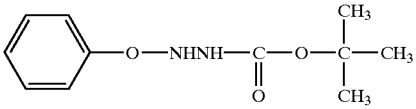
H-39
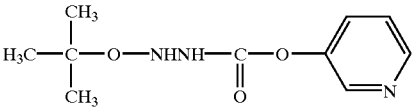
H-40
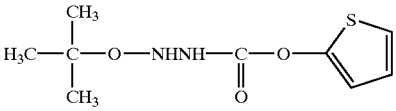
H-41
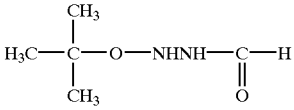
H-42
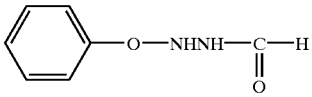
H-43
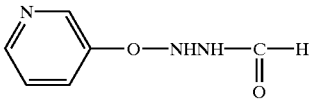
H-44
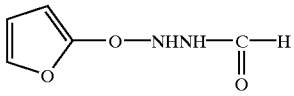
H-45
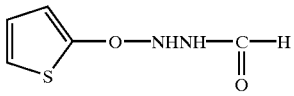
H-46
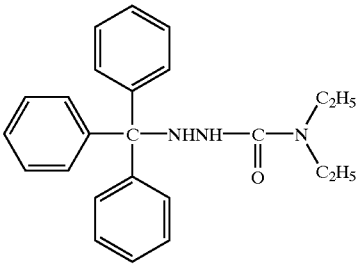
H-47
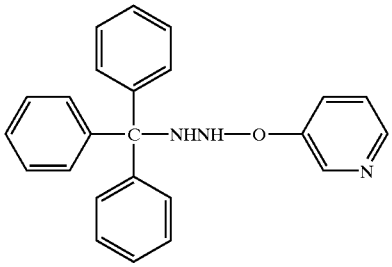

-continued
H-48
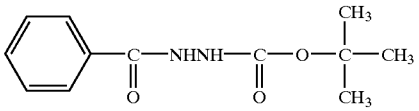
H-49
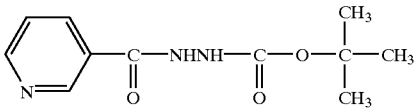
H-50
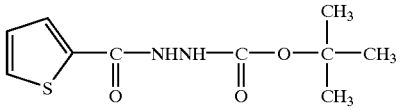
H-51
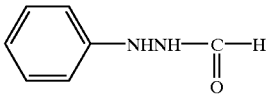
H-52
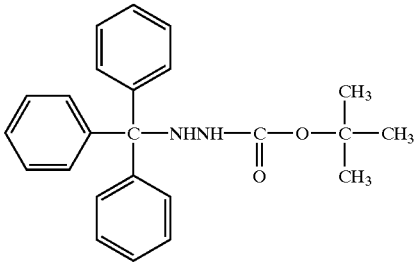
H-53
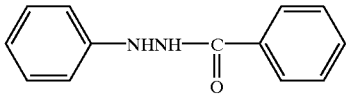
H-54
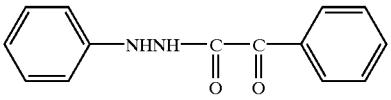
-continued
H-55
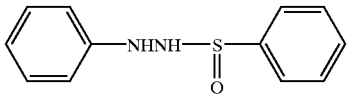
H-56
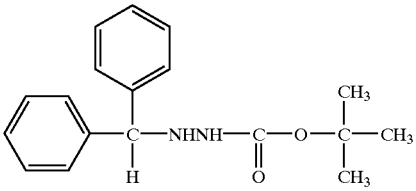
H-57
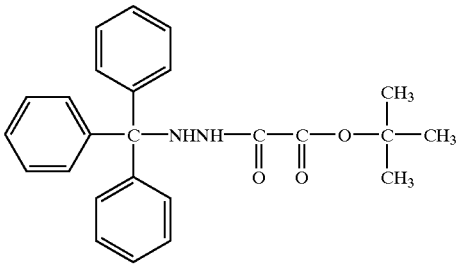
H-58
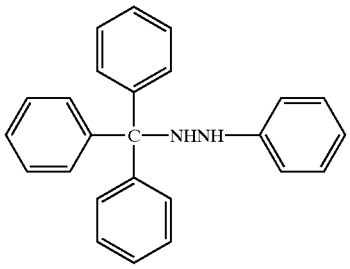
Further, examples of preferred hydrazine derivatives are shown below.
H-59
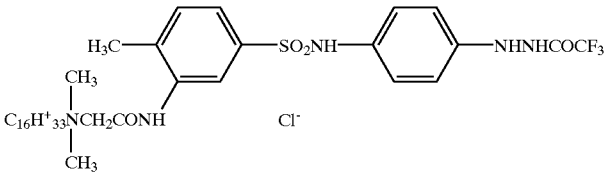
H-60
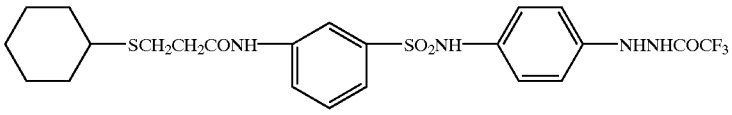
H-61
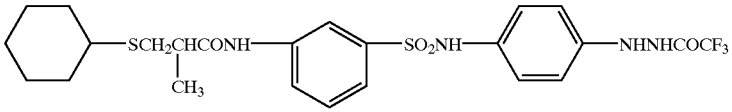

-continued

H-62

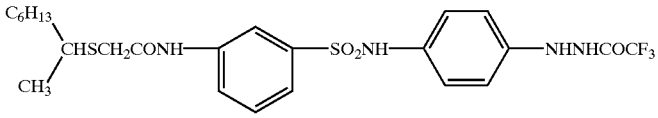

H-63

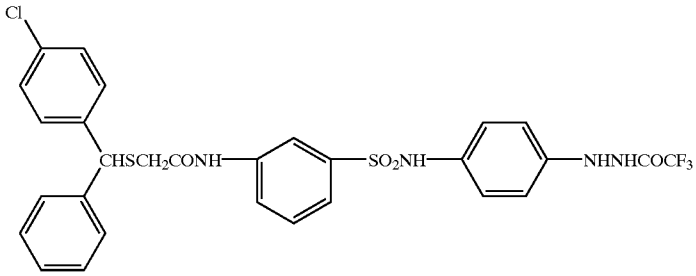

H-64

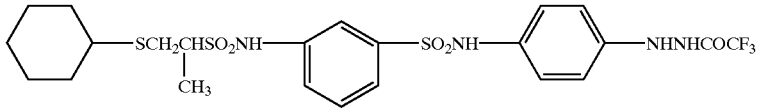

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

The hydrazine derivative is incorporated into a photosensitive layer containing a silver halide emulsion and/or a layer adjacent thereto. The amount to be incorporated, depending of a silver halide grain size, halide composition, a degree of chemical sensitization and the kind of an antifoggant, is preferably $10^{-6}$ to $10^{-1}$, and more preferably $10^{-5}$ to $10^{-2}$ mole per mole of silver halide.

The quaternary onium compound is preferably a compound represented by formula (P):

formula (P)

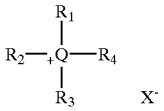

wherein Q is a nitrogen atom or a phosphorus atom; $R_1$, $R_2$, $R_3$ and $R_4$ each are a hydrogen atom or a substituent, provided that $R_1$, $R_2$, $R_3$ and $R_4$ combine together with each other to form a ring; and $X^-$ is an anion.

Examples of the substituent represented by $R_1$, $R_2$, $R_3$ and $R_4$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g.,piperidyl, piperazinyl, morpholinyl, pyridyl, furyl, thienyl, tetrahydrofuryl, tetrahydrothienyl, sulforanyl), and amino group. Examples of the ring formed by $R_1$, $R_2$, $R_3$ and $R_4$ include a piperidine ring, morpholine ring, piperazine ring, pyrimidine ring, pyrrole ring, imidazole ring, triazole ring and tetrazole ring. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group. Examples of the anion of $X^-$ include a halide ion, sulfate ion, nitrate ion, acetate ion and p-toluenesulfonic acid ion.

Further, quaternary onium salt compounds usable in this invention include compounds represented by formulas (Pa), (Pb) and (Pc), or formula (T):

formula (Pa)

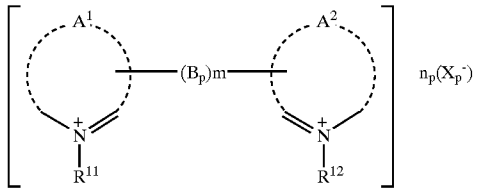

formula (Pb)

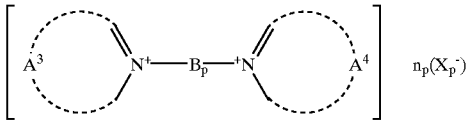

formula (Pc)

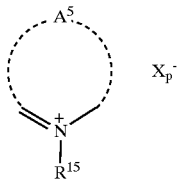

wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$ may be substituted by a substituent. Examples of the substituent include an alkyl group, an aryl group, an aralkyl group, alkenyl group, alkynyl group, a halogen atom, an acyl group, an alkoxycarbonyl group, an aryloxycarbonyl group, a sulfo group, hydroxy, an alkoxyl group, an aryloxy group, an amido group, a sulfamoyl group, a carbamoyl group, a ureido group, an amino group, a sulfonamido group, cyano, nitro, a mercapto group, an alkylthio group, and an arylthio group. Exemplary preferred $A^1$, $A^2$, $A^3$, $A^4$ and $A^5$ include a 5- or 6-membered ring (e.g., pyridine, imidazole, thiazole, oxazole, pyrazine, pyrimidine) and more preferred is a pyridine ring.

Bp is a divalent linkage group, and m is 0 or 1. Examples of the divalent linkage group include an alkylene group, arylene group, alkenylene group, —$SO_2$—, —SO—, —O—, —S—, —CO—, —N($R^6$)—, in which $R^6$ is a hydrogen atom, an alkyl group or aryl group. These groups may be included alone or in combination. Of these, Bp is preferably an alkylene group or alkenylene group.

$R^1$, $R^2$ and $R^5$ are each an alkyl group having 1 to 20 carbon atoms, and $R^1$ and $R^2$ may be the same. The alkyl group may be substituted and substituent thereof are the same as defined in $A^1$, $A^2$, $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted. $X_p^-$ is a counter ion necessary to counterbalance overall charge of the molecule, such as chloride ion, bromide ion, iodide ion, sulfate ion, nitrate ion and p-toluenesulfonate ion; np is a counter ion necessary to counterbalance overall charge of the molecule and in the case of an intramolecular salt, $n_p$ is 0.

formula (T)

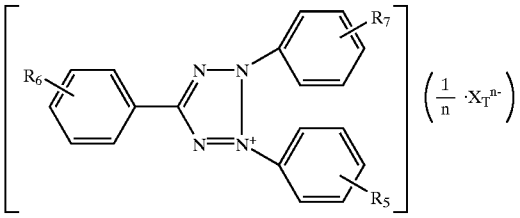

Substituent groups $R_5$, $R_6$ and $R_7$, substituted on the phenyl group are preferably a hydrogen atom or a group, of which Hammett's σ-value exhibiting a degree of electron attractiveness is negative.

The σ values of the substituent on the phenyl group are disclosed in lots of reference books. For example, a report by C. Hansch in "The Journal of Medical Chemistry", vol.20, on page 304(1977), etc. can be mentioned. Groups showing particularly preferable negative σ-values include, for example, methyl group ($\sigma_p$=−0.17, and in the following, values in the parentheses are in terms of $\sigma_p$ value), ethyl group(−0.15), cyclopropyl group(−0.21), n-propyl group(−0.13), iso-propyl group(−0.15), cyclobutyl group(−0.15), n-butyl group(−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the formula T according to the present invention; n is 1 or 2, and as anions represented by $X_T^{n-}$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, including lower alkyl benzenesulfonic acid anions such as p-toluenesulfonic anion, etc.; higher alkylbenzene sulfonic acid anions such as p-dodecyl benzenesulfonic acid anion, etc.; higher alkyl sulfate anions such as lauryl sulfate anion, etc.; Boric acid-type anions such as tetraphenyl borone, etc.; dialkylsulfosuccinate anions such as di-2-ethylhexylsulfo succinate anion, etc.; higher fatty acid anions such as cetyl polyethenoxysulfate anion, etc.; and those in which an acid radical is attached to a polymer, such as polyacrylic acid anion, etc. can be mentioned.

Exemplary examples of the quaternary onium compounds are shown below, but are not limited to these.

P-1

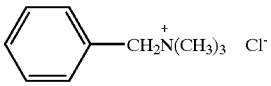

P-2

$C_{16}H_{33}\overset{+}{N}(CH_3)_3$ $Br^-$

P-3

$\overset{+}{N}(C_4H_9)_4$ $Cl^-$

P-4

$(CH_3)_3\overset{+}{N}CH_2CH_2OH$ $Cl^-$

P-5

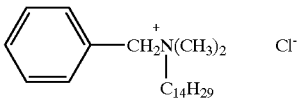

P-6

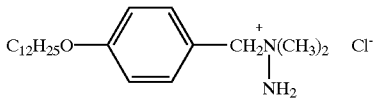

P-7

$(C_2H_5)_2N(CH_2)_4N(C_2H_5)_2$ 2$Cl^-$ $(C_2H_5)_3N(CH_2)_8N(C_2H_5)_3$ 2$Cl^-$

P-8

$(C_4H_9)_3\overset{+}{N}CH_2CH_2\overset{+}{N}(C_4H_9)_3$ $SO_4^{2-}$

P-9

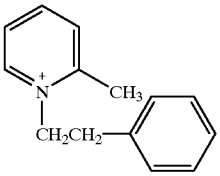

P-10

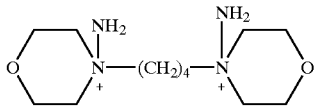

P-11

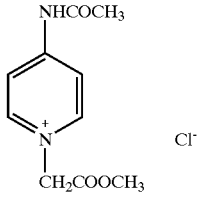

P-12

-continued
P-13
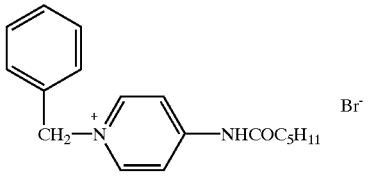
P-14
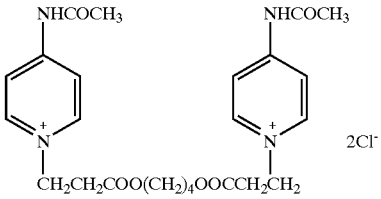
P-15
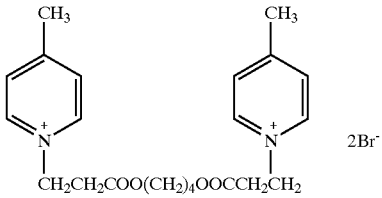
P-16
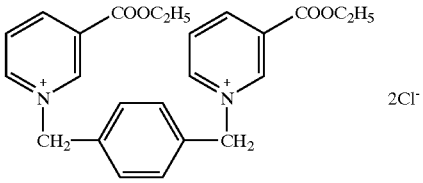
P-17
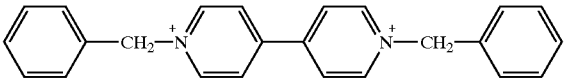
P-18
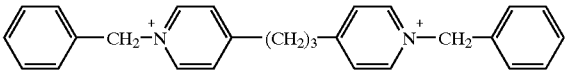
P-19
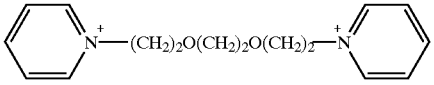
P-20
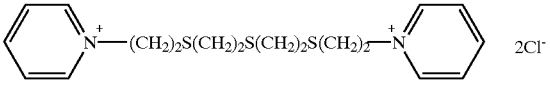
P-21
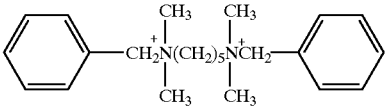
P-22
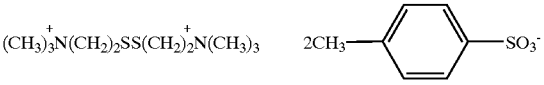
P-23
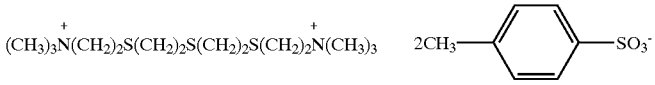
P-24
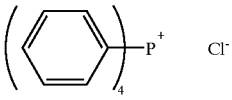
P-25
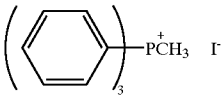
P-26
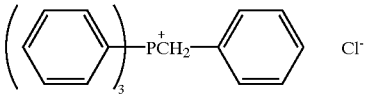
P-27
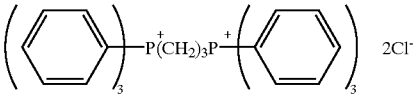
P-28
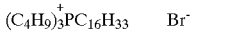
P-29
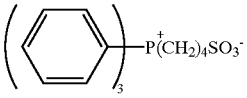
P-30
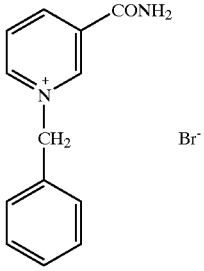
P-31
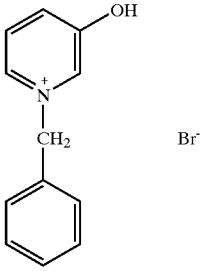

-continued
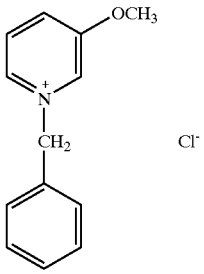
P-32
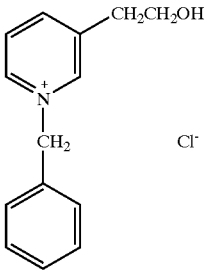
P-33
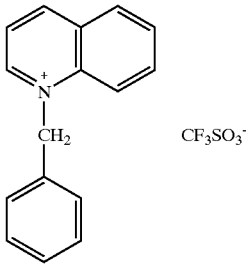
P-34
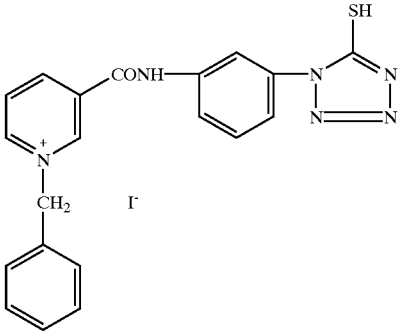
P-35
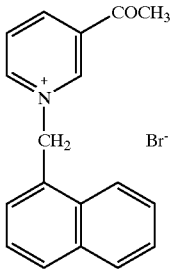
P-36
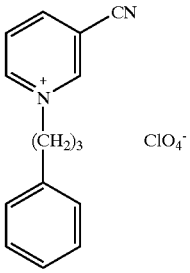
P-37
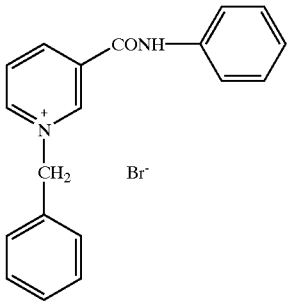
P-38
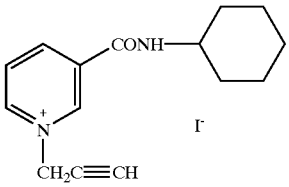
P-39
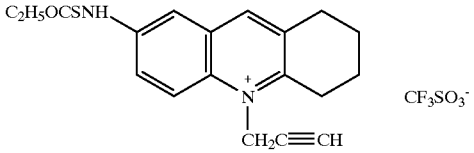
P-40
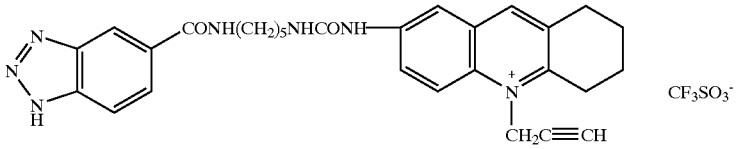
P-41

-continued
P-42
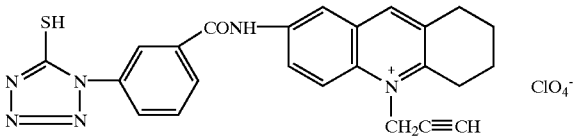
P-43
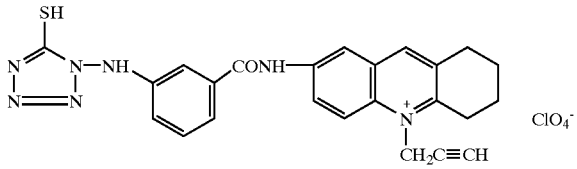
P-44
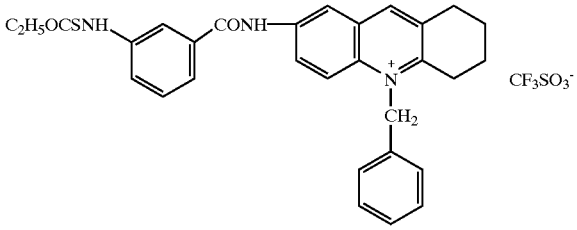
P-45
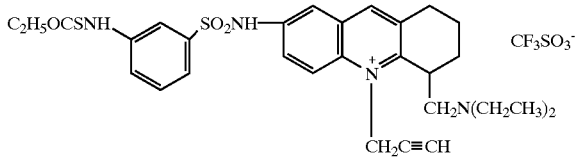
P-46
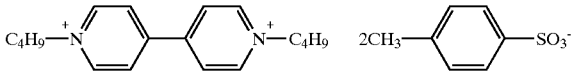
P-47
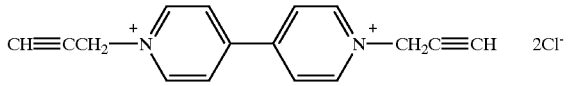
P-48
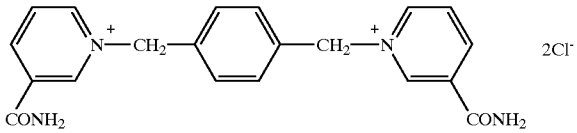
P-49
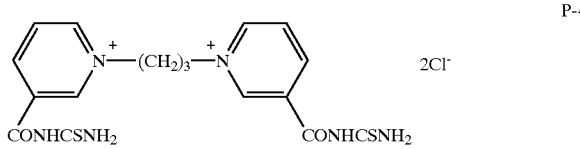
P-50
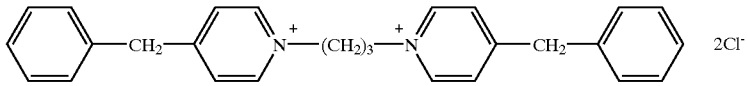
P-51
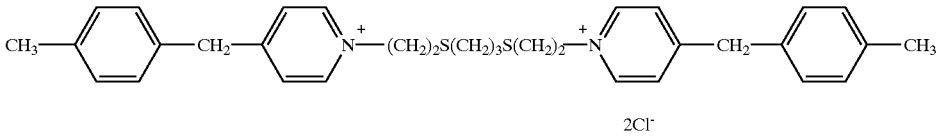
P-52
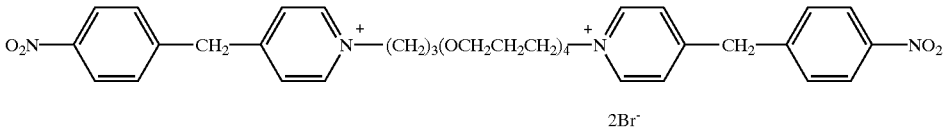
P-53
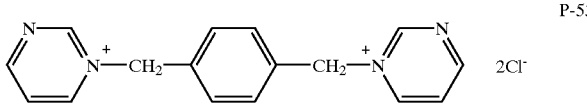
P-54
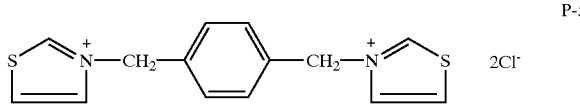

-continued

P-55

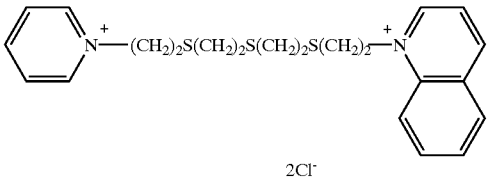

2Cl⁻

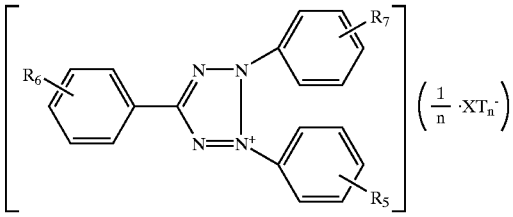

| Compd. No. | $R_5$ | $R_6$ | $R_7$ | $X_T^{n-}$ |
|---|---|---|---|---|
| T-1 | H | H | p-$CH_3$ | — |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The quaternary onium salt compounds described above can be readily synthesized according to the methods commonly known in the art. For example, the tetrazolium compounds described above may be referred to Chemical Review 55, page 335–483.

The quaternary onium compound is incorporated preferably in an amount of $1\times10^{-8}$ to 1 mole, and $1\times10^{-7}$ to $1\times10^{-3}$ mole per mole of silver halide, which may be incorporated to a photothermographic material at any time from during silver halide grain formation and to coating.

The contrast-increasing agents such as hydrazine derivatives, quaternary onium compounds and vinyl compounds, which may be used alone or in combination can be incorporated into any one of constituting layers of the photothermographic material, preferably at least one of the constituting layers of the light-sensitive layer side, and more preferably a light-sensitive layer or a layer adjacent thereto.

Vinyl type compounds preferably are those represented by the following formula (G):

formula (G)

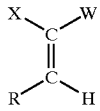

In formula (G), X and R are represented as a cis-form, but X and R in a trans-form are also included in the formula (G). This is the same in exemplary compounds described later. The vinyl type compound is contained preferably in an amount of $1\times10^{-6}$ to 1 mol per mol of silver halide, and more preferably $1\times10^{-5}$ to $5\times10^{-2}$ mol per mol of silver halide.

In the formula, X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyaxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the rinf formed by X and W include pyrazolone, pyrazolidinone, cyclopentadione, β-ketolactone, and β-ketolactam.

In formula (G), the electron-withdrawing group refers to a substituent group exhibiting a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonnium group, a phophonium group, pyrilium group and inmonium group, and further including a group of a heterocyclic ring formed by an ammonium group, sulfonium group, phosphonium group or immonium group. Of these group, groups exhibiting σp of 0.3 or more are specifically preferred.

Examples of the alkyl group represented by W include methyl, ethyl and trifluoromethyl; examples of the alkenyl include vinyl, halogen-substituted vinyl and cyanovinyl;

examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive σp is preferred and the group exhibiting σp of 0.3 or more is specifically preferred.

Of the groups represented by R, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

Exemplary examples of the compounds represented by formula (G) are shown below, but are not limited to these.

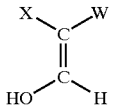

| X | W | | | | |
|---|---|---|---|---|---|
| | —$COCH_3$ | —$COCF_3$ | —CO—C$_6$H$_3$(CN)$_2$ (CN at ortho position) | —CHO | —$COCH_2SCH_3$ |
| —$COOC_2H_5$ | B1-1 | B2-1 | B3-1 | B4-1 | B5-1 |
| —$COCOOC_2H_5$ | B1-2 | B2-2 | B3-2 | B4-2 | B5-2 |
| —$COCF_3$ | B1-3 | B2-3 | B3-3 | B4-3 | B5-3 |
| —$SO_2CH_3$ | B1-4 | B2-4 | B3-4 | B4-4 | B5-4 |
| —CHO | B1-5 | — | B3-5 | B4-5 | B5-5 |
| —$COCH_3$ | B1-6 | — | B3-6 | — | B5-6 |
| —$COCH_2SCH_3$ | — | — | B3-7 | — | B5-7 |
| —$SO_2CF_3$ | B1-7 | B2-5 | B3-8 | B4-6 | B5-8 |
| 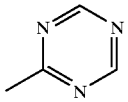 | B1-8 | B2-6 | B3-9 | B4-7 | B5-9 |
| —$COOC_2H_4SCH_3$ | B1-9 | B2-7 | B3-10 | B4-8 | B5-10 |
| —$COCOOC_2H_4SCH_3$ | B1-10 | B2-8 | B3-11 | B4-9 | B5-11 |
| —$COCONHC_2H_4SCH_3$ | B1-11 | B2-9 | B3-12 | B4-10 | B5-12 |

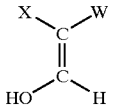

| X | W | | |
|---|---|---|---|
| | —$COCOCH_3$ | —$COCOOC_2H_5$ | —$COCOSC_2H_5$ |
| —$COOC_2H_5$ | B6-1 | B7-1 | B8-1 |
| —$COCOOC_2H_5$ | B6-2 | B7-2 | B8-2 |
| —$COCH_3$ | B6-3 | — | B8-3 |

-continued

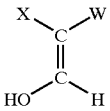

| X | W: —COCOCH$_3$ | —COCOOC$_2$H$_5$ | —COCOSC$_2$H$_5$ |
|---|---|---|---|
| —COCF$_3$ | B6-4 | — | B8-4 |
| —SO$_2$CH$_3$ | B6-5 | B7-3 | B8-5 |
| —SO$_2$CF$_3$ | B6-6 | B7-4 | B8-6 |
| —CHO | B6-7 | — | B8-7 |
| —COCH$_2$SCH$_3$ | B6-8 | — | B8-8 |
| 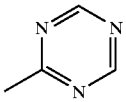 | B6-9 | B7-5 | B8-9 |
| —COOC$_2$H$_4$SCH$_3$ | B6-10 | B7-6 | B8-10 |
| —COCOOC$_2$H$_4$SCH$_3$ | B6-11 | B7-7 | B8-11 |
| —COCONHC$_2$H$_4$SCH$_3$ | B6-12 | B7-8 | B8-12 |

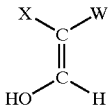

| X | W: —COCONHC$_2$H$_4$SCH$_3$ | —C(=S)—CH$_3$ | —COOC$_2$H$_5$ | —COSC$_2$H$_5$ |
|---|---|---|---|---|
| —COOC$_2$H$_5$ | B9-1 | B10-1 | B11-1 | B12-1 |
| —COCOOC$_2$H$_5$ | B9-2 | B10-2 | — | B12-2 |
| —COCH$_3$ | — | B10-3 | — | B12-3 |
| —COCF$_3$ | — | B10-4 | — | B12-4 |
| —SO$_2$CH$_3$ | B9-3 | B10-5 | B11-2 | B12-5 |
| —SO$_2$CF$_3$ | B9-4 | B10-6 | B11-3 | B12-6 |
| —CHO | — | B10-7 | — | B12-7 |
| —COCH$_2$SCH$_3$ | — | B10-8 | — | B12-8 |
| 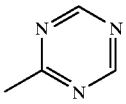 | B9-5 | B10-9 | B11-4 | B12-9 |
| —COOC$_2$H$_4$SCH$_3$ | B9-6 | B10-10 | B11-5 | B12-10 |
| —COCOOC$_2$H$_4$SCH$_3$ | B9-7 | B10-11 | B11-6 | B12-11 |
| —COCONHC$_2$H$_4$SCH$_3$ | B9-8 | B10-12 | — | B12-12 |

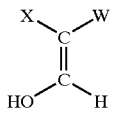

| X | W | | |
|---|---|---|---|
| | —CONH— 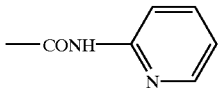 | —CSNH— 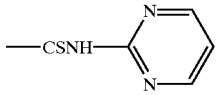 | —$SO_2CH_3$ |
| —$COOC_2H_4SO_2CH_3$ | B13-1 | B14-1 | B15-1 |
| —$COCOOC_2H_5$ | B13-2 | B14-2 | B15-2 |
| —$COCH_3$ | B13-3 | B14-3 | — |
| —$COCF_3$ | B13-4 | B14-4 | — |
| —$SO_2CH_3$ | B13-5 | B14-5 | B15-3 |
| —$SO_2CF_3$ | B13-6 | B14-6 | B15-4 |
| —CHO | B13-7 | B14-7 | — |
| —$COCH_2SCH_3$ | B13-8 | B14-8 | — |
| 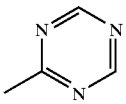 | B13-9 | B14-9 | B15-5 |
| —$COOC_2H_4SCH_3$ | B13-10 | B14-10 | B15-6 |
| —$COCOOC_2H_4SCH_3$ | B13-11 | B14-11 | B15-7 |
| —$COCONHC_2H_4SCH_3$ | B13-12 | B14-12 | B15-8 |

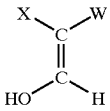

| X | W | | | | |
|---|---|---|---|---|---|
| | —$SO_2CF_3$ | —$SOCH_3$ | —$SO_2OCH_3$ | —$SO_2SCH_3$ | —$SO_2NH_2$ |
| —$COOC_2H_5$ | — | B17-1 | B18-1 | B19-1 | B20-1 |
| —$COCOOC_2H_5$ | — | B17-2 | B18-2 | B19-2 | B20-2 |
| —$COCH_3$ | — | B17-3 | B18-3 | B19-3 | B20-3 |
| —$COCF_3$ | — | B17-4 | B18-4 | B19-4 | B20-4 |
| —$SO_2CH_3$ | — | B17-5 | B18-5 | B19-5 | B20-5 |
| —$SO_2CF_3$ | — | B17-6 | B18-6 | B19-6 | B20-6 |
| —CHO | — | B17-7 | B18-7 | B19-7 | B20-7 |
| —$COCH_2SCH_3$ | — | B17-8 | B18-8 | B19-8 | B20-8 |
| 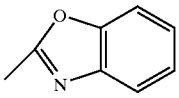 | B16-1 | B17-9 | B18-9 | B19-9 | B20-9 |
| —$COOC_2H_4SCH_3$ | — | B17-10 | B18-10 | B19-10 | B20-10 |
| —$COCOOC_2H_4SCH_3$ | — | B17-11 | B18-11 | B19-11 | B20-11 |
| —$COCONHC_2H_4SCH_3$ | B16-2 | B17-12 | B18-12 | B19-12 | B20-12 |

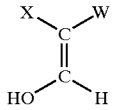
| X | W | | | | |
|---|---|---|---|---|---|
| | $-S(=O)-O-CH_3$ | $-S(=O)-S-C_2H_5$ | $-S(=O)-NHCH_3$ | $-P(=O)(OC_2H_5)-OC_2H_5$ | $-NO_2$ |
| $-COOC_2F_4H$ | B21-1 | B22-1 | B23-1 | B24-1 | B25-1 |
| $-COCOOCH_2C_2F_4H$ | B21-2 | B22-2 | B23-2 | B24-2 | B25-2 |
| $-COCH_3$ | B21-3 | B22-3 | B23-3 | B24-3 | B25-3 |
| $-COCF_3$ | B21-4 | B22-4 | B23-4 | B24-4 | B25-4 |
| $-SO_2CH_3$ | B21-5 | B22-5 | B23-5 | B24-5 | B25-5 |
| $-SO_2CF_3$ | B21-6 | B22-6 | B23-6 | B24-6 | B25-6 |
| $-CHO$ | B21-7 | B22-7 | B23-7 | B24-7 | B25-7 |
| $-COCH_2SCH_3$ | B21-8 | B22-8 | B23-8 | B24-8 | B25-8 |
| 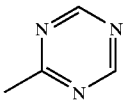 | B21-9 | B22-9 | B23-9 | B24-9 | B25-9 |
| $-COOC_2H_4SCH_3$ | B21-10 | B22-10 | B23-10 | B24-10 | B25-10 |
| $-COCOOC_2H_4SCH_3$ | B21-11 | B22-11 | B23-11 | B24-11 | B25-11 |
| $-COCONHC_2H_4SCH_3$ | B21-12 | B22-12 | B23-12 | B24-12 | B25-12 |
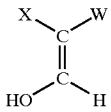
| X | W | | | | |
|---|---|---|---|---|---|
| | 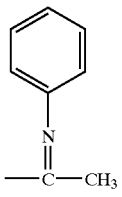 | 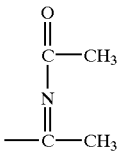 | 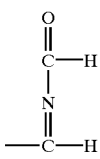 | 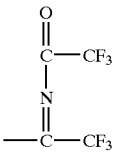 | 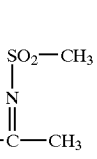 |
| $-COOC_2H_5$ | B26-1 | B27-1 | B28-1 | B29-1 | B30-1 |
| $-COCOOC_2H_5$ | B26-2 | B27-2 | B28-2 | B29-2 | B30-2 |
| $-COCH_3$ | B26-3 | B27-3 | B28-3 | B29-3 | B30-3 |
| $-COCF_3$ | B26-4 | B27-4 | B28-4 | B29-4 | B30-4 |
| $-SO_2CH_3$ | B26-5 | B27-5 | B28-5 | B29-5 | B30-5 |
| $-SO_2CF_3$ | B26-6 | B27-6 | B28-6 | B29-6 | B30-6 |
| $-CHO$ | B26-7 | B27-7 | B28-7 | B29-7 | B30-7 |
| 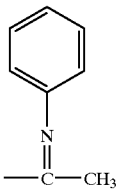 | B26-8 | B27-8 | B28-8 | B29-8 | B30-8 |

-continued
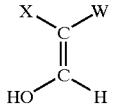
| X | W | | | | |
|---|---|---|---|---|---|
| | 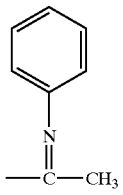 | 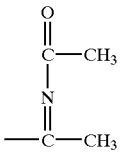 | 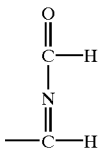 | 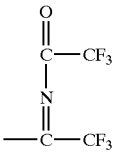 | 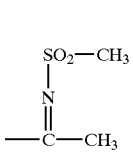 |
| 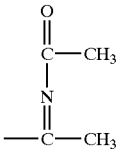 | — | B27-9 | B28-9 | B29-9 | B30-9 |
| 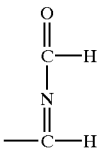 | — | — | B28-10 | B29-10 | B30-10 |
| 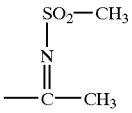 | — | — | — | B29-11 | B30-11 |
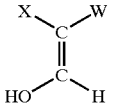
| X | W | | | | |
|---|---|---|---|---|---|
| | 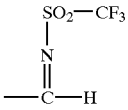 | 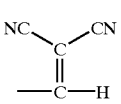 | 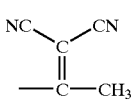 | 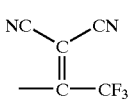 | 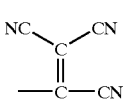 |
| $—COOC_2H_5$ | B31-1 | B32-1 | B33-1 | B34-1 | B35-1 |
| $—COCOOC_2H_5$ | B31-2 | B32-2 | B33-2 | B34-2 | B35-2 |
| $—COCH_3$ | B31-3 | B32-3 | B33-3 | B34-3 | B35-3 |
| $—COCF_3$ | B31-4 | B32-4 | B33-4 | B34-4 | B35-4 |
| —CHO | B31-5 | B32-5 | B33-5 | B34-5 | B35-5 |
| $—SO_2CH_3$ | B31-6 | B32-6 | B33-6 | B34-6 | B35-6 |
| $—SO_2CF_3$ | B31-7 | B32-7 | B33-7 | B34-7 | B35-7 |
| 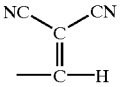 | B31-8 | B32-8 | B33-8 | B34-8 | B35-8 |
| 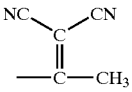 | B31-9 | — | B33-9 | B34-9 | B35-9 |

-continued
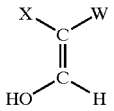
| X | W | | | | |
|---|---|---|---|---|---|
| | 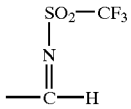 | 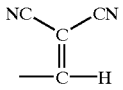 | 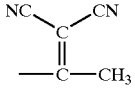 | 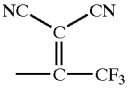 | 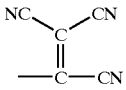 |
| 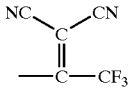 | B31-10 | — | — | B34-10 | B35-10 |
| 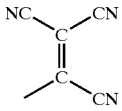 | B31-11 | — | — | — | B35-11 |
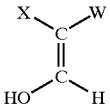
| X | W | | | | |
|---|---|---|---|---|---|
| | $—CF_3$ | —CH═CH—CN | —CH═CH—CHO | —C≡C—$CF_3$ | —C≡C—CN |
| $—COOC_2H_5$ | B36-1 | B37-1 | B38-1 | B39-1 | B40-1 |
| $—COCOOC_2H_5$ | B36-2 | B37-2 | B38-2 | B39-2 | B40-2 |
| $—COCF_3$ | B36-3 | B37-3 | B38-3 | B39-3 | B40-3 |
| $—SO_2CH_3$ | B36-4 | B37-4 | B38-4 | B39-4 | B40-4 |
| $—COCH_3$ | B36-5 | B37-5 | B38-5 | B39-5 | B40-5 |
| $—SO_2CF_3$ | B36-6 | B37-6 | B38-6 | B39-6 | B40-6 |
| —CHO | B36-7 | B37-7 | B38-7 | B39-7 | B40-7 |
| $—COCH_2SCH_3$ | B36-8 | B37-8 | B38-8 | B39-8 | B40-8 |
| 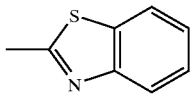 | B36-9 | B37-9 | B38-9 | B39-9 | B40-9 |
| $—COOC_2H_4SCH_3$ | B36-10 | B37-10 | B38-10 | B39-10 | B40-10 |
| $—COCOOC_2H_4SCH_3$ | B36-11 | B37-11 | B38-11 | B39-11 | B40-11 |
| $—COCONHC_2H_4SCH_3$ | B36-12 | B37-12 | B38-12 | B39-12 | B40-12 |
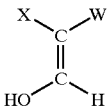
| X | W | | | | |
|---|---|---|---|---|---|
| | 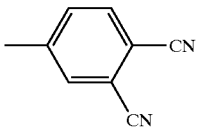 | 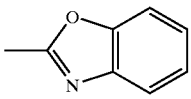 | 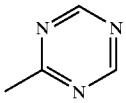 | Cl | H |
| $—COOC_2H_5$ | B41-1 | B42-1 | B43-1 | B44-1 | B45-1 |
| $—COCOOC_2H_5$ | B41-2 | B42-2 | B43-2 | B44-2 | B45-2 |

-continued
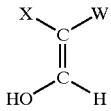
| X | W | | | | |
|---|---|---|---|---|---|
| | 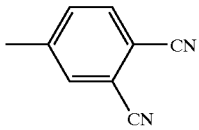 | 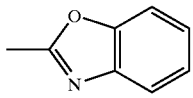 | 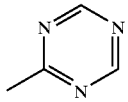 | Cl | H |
| —$COCH_3$ | B41-3 | B42-3 | — | B44-3 | B45-3 |
| —$COCF_3$ | B41-4 | B42-4 | — | B44-4 | B45-4 |
| —$SO_2CH_3$ | B41-5 | B42-5 | B43-3 | B44-5 | B45-5 |
| —$SO_2CF_3$ | B41-6 | — | B43-4 | B44-6 | B45-6 |
| —CHO | B41-7 | B42-6 | — | B44-7 | B45-7 |
| —$COCH_2SCH_3$ | B41-8 | B42-7 | — | B44-8 | B45-8 |
| 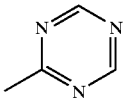 | B41-9 | B42-8 | B43-5 | B44-9 | B45-9 |
| —$COOC_2H_4SCH_3$ | B41-10 | B42-9 | B43-6 | B44-10 | B45-10 |
| —$COCOOC_2H_4SCH_3$ | B41-11 | B42-10 | B43-7 | B44-11 | B45-11 |
| —$COCONHC_2H_4SCH_3$ | B41-12 | B42-11 | B43-8 | B44-12 | B45-12 |
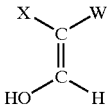
| X | W | | | | |
|---|---|---|---|---|---|
| | 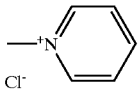 | 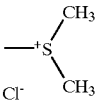 | 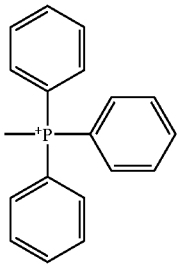 | 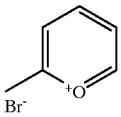 | 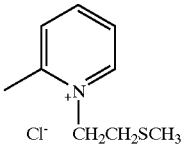 |
| —$COOC_2H_5$ | B46-1 | B47-1 | B48-1 | B49-1 | B50-1 |
| —$COCOOC_2H_5$ | B46-2 | B47-2 | B48-2 | B49-2 | B50-2 |
| —$COCH_3$ | B46-3 | B47-3 | B48-3 | B49-3 | B50-3 |
| —$COCF_3$ | B46-4 | B47-4 | B48-4 | B49-4 | B50-4 |
| —$SO_2CH_3$ | B46-5 | B47-5 | B48-5 | B49-5 | B50-5 |
| —$SO_2CF_3$ | B46-6 | B47-6 | B48-6 | B49-6 | B50-6 |
| —CHO | B46-7 | B47-7 | B48-7 | B49-7 | B50-7 |
| —$COCH_2SCH_3$ | B46-8 | B47-8 | B48-8 | B49-8 | B50-8 |
| 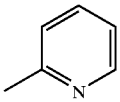 | B46-9 | B47-9 | B48-9 | B49-9 | B50-9 |
| —$COOC_2H_4SCH_3$ | B46-10 | B47-10 | B48-10 | B49-10 | B50-10 |
| —$COCOOC_2H_4SCH_3$ | B46-11 | B47-11 | B48-11 | B49-11 | B50-11 |
| —$COCONHC_2H_4SCH_3$ | B46-12 | B47-12 | B48-12 | B49-12 | B50-12 |

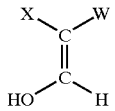
| X | W | |
|---|---|---|
| | 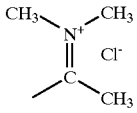 | 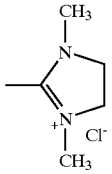 |
| —$COOC_2H_5$ | B51-1 | B52-1 |
| —$COCOOC_2H_5$ | B51-2 | B52-2 |
| —$COCH_3$ | B51-3 | B52-3 |
| —$COCCl_3$ | B51-4 | B52-4 |
| —$SO_2CH_3$ | B51-5 | B52-5 |
| —$SO_2CF_3$ | B51-6 | B52-6 |
| —CHO | B51-7 | B52-7 |
| —$COCH_2S$ 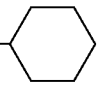 | B51-8 | B52-8 |
-continued
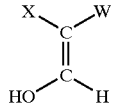
| X | W | |
|---|---|---|
| | 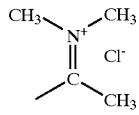 | 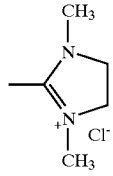 |
| 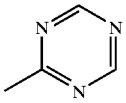 | B51-9 | B52-9 |
| —$COOC_2H_4SC_2H_5$ | B51-10 | B52-10 |
| —$COCOOC_2H_4SC_2H_5$ | B51-11 | B52-11 |
| —$COCONHC_2H_4S$ 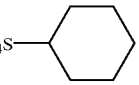 | B51-12 | B52-12 |
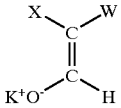
| X | W | | | | |
|---|---|---|---|---|---|
| | —$COCH_3$ | —$COCF_3$ | —CHO | —$COCH_2SCH_3$ | —$SO_2CH_3$ |
| —$COOC_2H_5$ | B53-1 | B54-1 | B55-1 | B56-1 | B57-1 |
| —$COCOOC_2H_5$ | B53-2 | B54-2 | B55-2 | B56-2 | B57-2 |
| —$COCH_3$ | B53-3 | B54-3 | B55-3 | B56-3 | B57-3 |
| —$COCF_3$ | — | B54-4 | B55-4 | B56-4 | B57-4 |
| —CHO | — | — | B55-5 | B56-5 | B57-5 |
| —$SO_2CH_3$ | — | — | — | B56-6 | B57-6 |
| —$SO_2CF_3$ | B53-4 | B54-5 | B55-6 | B56-7 | B57-7 |
| —$COCH_2SCH_3$ | — | — | — | B56-8 | — |
| 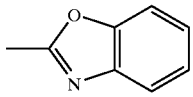 | B53-5 | B54-6 | B55-7 | B56-9 | B57-8 |
| —$COOC_2H_4SCH_3$ | B53-6 | B54-7 | B55-8 | B56-10 | B57-9 |
| —$COCOOC_2H_4SCH_3$ | B53-7 | B54-8 | B55-9 | B56-11 | B57-10 |
| —$COCONHC_2H_4SCH_3$ | B53-8 | B54-9 | B55-10 | B56-12 | B57-11 |

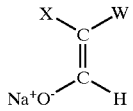
| X | W | | | | |
|---|---|---|---|---|---|
| | —$SO_2CF_3$ | 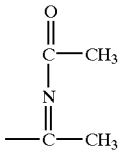 | 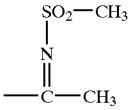 | 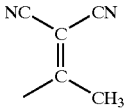 | 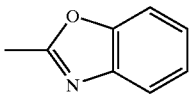 |
| —$COOC_2H_5$ | B58-1 | B59-1 | B60-1 | B61-1 | B62-1 |
| —$COCOOC_2H_5$ | B58-2 | B59-2 | B60-2 | B61-2 | B62-2 |
| —$COCH_3$ | — | B59-3 | B60-3 | B61-3 | — |
| —$COCF_3$ | — | B59-4 | B60-4 | B61-4 | — |
| —CHO | — | B59-5 | B60-5 | B61-5 | — |
| —$SO_2CH_3$ | — | B59-6 | B60-6 | B61-6 | — |
| —$SO_2CF_3$ | B58-3 | B59-7 | B60-7 | B61-7 | B62-3 |
| —$COCH_2SCH_3$ | B58-4 | B59-8 | B60-8 | B61-8 | — |
| 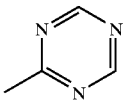 | B58-5 | B59-9 | B60-9 | B61-9 | B62-4 |
| —$COOC_2H_4SCH_3$ | B58-6 | B59-10 | B60-10 | B61-10 | B62-5 |
| —$COCOOC_2H_4SCH_3$ | B58-7 | B59-11 | B60-11 | B61-11 | B62-6 |
| —$COCONHC_2H_4SCH_3$ | B58-8 | B59-12 | B60-12 | B61-12 | B62-7 |
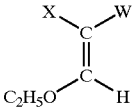
| X | W | | | |
|---|---|---|---|---|
| | —$COCCl_3$ | —$COC_2F_4H$ | —CHO | —$COCH_2SCH_3$ |
| —$COOC_2H_4SCH_3$ | B63-1 | B64-1 | B65-1 | B66-1 |
| —$COCOOC_2H_4SCH_3$ | B63-2 | B64-2 | B65-2 | B66-2 |
| —$COCF_3$ | B63-3 | B64-3 | B65-3 | B66-3 |
| —CHO | B63-4 | B64-4 | B65-4 | B66-4 |
| —$SO_2CH_3$ | B63-5 | B64-5 | B65-5 | B66-5 |
| —$SO_2CF_3$ | B63-6 | B64-6 | B65-6 | B66-6 |
| —$COCH_2SCH_3$ | B63-7 | B64-7 | B65-7 | B66-7 |
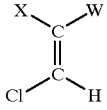
| X | W | | | | | |
|---|---|---|---|---|---|---|
| | —$COCF_3$ | —CHO | —$COCH_2SCH_3$ | 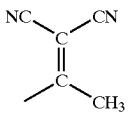 | 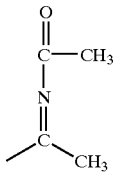 | 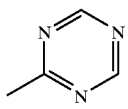 |

-continued
| | | | | | | |
|---|---|---|---|---|---|---|
| —$COOC_2H_5$ | B67-1 | B67-2 | — | B67-4 | B67-6 | — |
| —$COCH_2SCH_3$ | — | — | B67-3 | — | — | |
| —$COCH_3$ | — | — | — | — | — | B67-5 |
B68-1
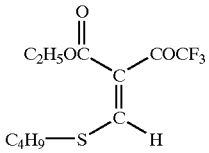
B68-2
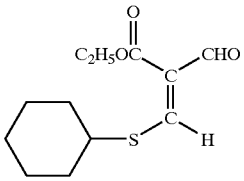
B68-3
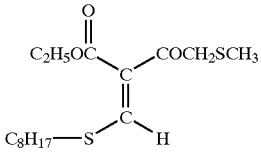
B68-3
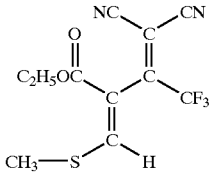
B68-3
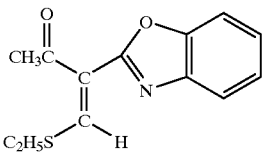
B68-6
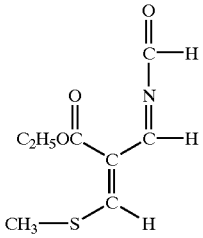
B69-1
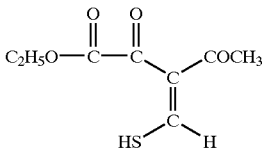
B69-2
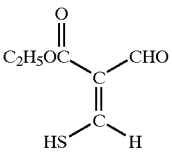
B70-1
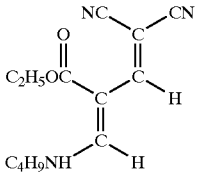
B71-1
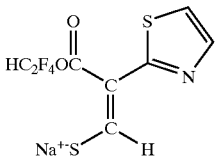
B71-2
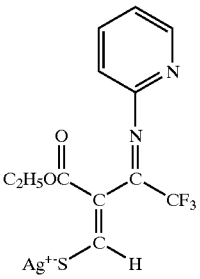
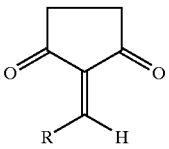
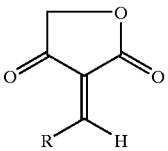
| R: | | | R: | | |
|---|---|---|---|---|---|
| | —OH | B72-1 | | —OH | B72-2 |
| | —$OC_2H_5$ | B72-4 | | —$O^-Na^+$ | B72-3 |
| | —$SCH_3$ | B72-7 | | —$OCH_3$ | B72-5 |
| | | | | —$O^-Ag^+$ | B72-6 |
| | | | | —$SC_4H_9$ | B72-8 |
| | | | | —$S^-K^+$ | B72-9 |
| | | | | —Cl | B72-11 |
| | | | | 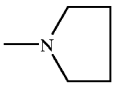 | B72-10 |

-continued
| B72-13 | B72-14 | B72-15 | B72-16 |
|---|---|---|---|
| 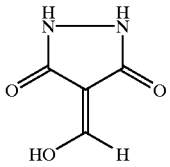 | 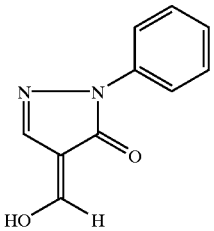 | 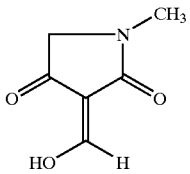 | 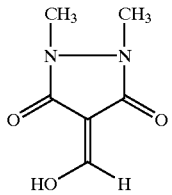 |
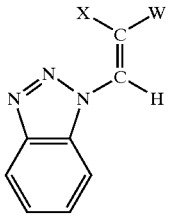
| X | W | | | | |
|---|---|---|---|---|---|
| | —$COCH_3$ | —$COCF_3$ | —CHO | —$COCH_2SCH_3$ | —$SO_2CH_3$ |
| —$COOC_2H_5$ | B73-1 | B74-1 | B75-1 | B76-1 | B77-1 |
| —$COCOOC_2H_5$ | B73-2 | B74-2 | B75-2 | B76-2 | B77-2 |
| —$COCH_3$ | B73-3 | B74-3 | B75-3 | B76-3 | B77-3 |
| —$COCF_3$ | — | B74-4 | B75-4 | B76-4 | B77-4 |
| —CHO | — | — | B75-5 | B76-5 | B77-5 |
| —$SO_2CH_3$ | — | — | — | B76-6 | B77-6 |
| —$SO_2CF_3$ | B73-4 | B74-5 | B75-6 | B76-7 | B77-7 |
| —$COCH_2SCH_3$ | — | — | — | B76-8 | — |
| 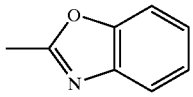 | B73-5 | B74-6 | B75-7 | B76-9 | B77-8 |
| —$COOC_2H_4SCH_3$ | B73-6 | B74-7 | B75-8 | B76-10 | B77-9 |
| —$COCOOC_2H_4SCH_3$ | B73-7 | B74-8 | B75-9 | B76-11 | B77-10 |
| —$COCONHC_2H_4SCH_3$ | B73-8 | B74-9 | B75-10 | B76-12 | B77-11 |
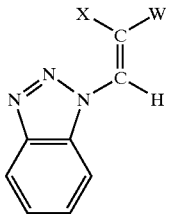
| X | W | | | | |
|---|---|---|---|---|---|
| | —$SO_2CF_3$ | 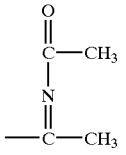 | 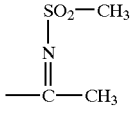 | 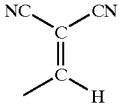 | 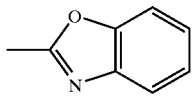 |
| —$COOC_2H_5$ | B78-1 | B79-1 | B80-1 | B81-1 | B82-1 |
| —$COCOOC_2H_5$ | B78-2 | B79-2 | B80-2 | B81-2 | B82-2 |

-continued
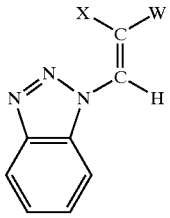
| X | W | | | | |
|---|---|---|---|---|---|
| | —$SO_2CF_3$ | 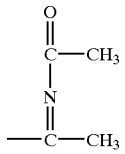 | 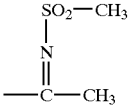 | 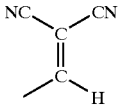 | 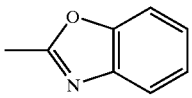 |
| —$COCH_3$ | — | B79-3 | B80-3 | B81-3 | — |
| —$COCF_3$ | — | B79-4 | B80-4 | B81-4 | — |
| —CHO | — | B79-5 | B80-5 | B81-5 | — |
| —$SO_2CH_3$ | — | B79-6 | B80-6 | B81-6 | — |
| —$SO_2CF_3$ | B78-3 | B79-7 | B80-7 | B81-7 | B82-3 |
| —$COCH_2SCH_3$ | B78-4 | B79-8 | B80-8 | B81-8 | — |
| 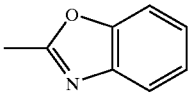 | B78-5 | B79-9 | B80-9 | B81-9 | B82-4 |
| —$COOC_2H_4SCH_3$ | B78-6 | B79-10 | B80-10 | B81-10 | B82-5 |
| —$COCOOC_2H_4SCH_3$ | B78-7 | B79-11 | B80-11 | B81-11 | B82-6 |
| —$COCONHC_2H_4SCH_3$ | B78-8 | B79-12 | B80-12 | B81-12 | B82-7 |
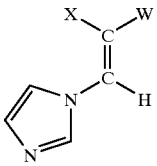
| X | W | | | | |
|---|---|---|---|---|---|
| | —$COCH_3$ | —$COCF_3$ | —CHO | —$COCH_2SCH_3$ | —$SO_2CH_3$ |
| —$COOC_2H_5$ | B83-1 | B84-1 | B85-1 | B86-1 | B87-1 |
| —$COCOOC_2H_5$ | B83-2 | B84-2 | B85-2 | B86-2 | B87-2 |
| —$COCH_3$ | B83-3 | B84-3 | B85-3 | B86-3 | B87-3 |
| —$COCF_3$ | — | B84-4 | B85-4 | B86-4 | B87-4 |
| —CHO | — | — | B85-5 | B86-5 | B87-5 |
| —$SO_2CH_3$ | — | — | — | B86-6 | B87-6 |
| —$SO_2CF_3$ | B83-4 | B84-5 | B85-6 | B86-7 | B87-7 |
| —$COCH_2SCH_3$ | — | — | — | B86-8 | — |
| 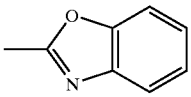 | B83-5 | B84-6 | B85-7 | B86-9 | B87-8 |
| —$COOC_2H_4SCH_3$ | B83-6 | B84-7 | B85-8 | B86-10 | B87-9 |
| —$COCOOC_2H_4SCH_3$ | B83-7 | B84-8 | B85-9 | B86-11 | B87-10 |
| —$COCONHC_2H_4SCH_3$ | B83-8 | B84-9 | B85-10 | B86-12 | B87-11 |

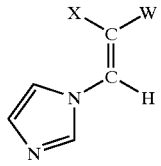

| X | W | | | | |
|---|---|---|---|---|---|
| | $-SO_2CF_3$ | $-C(=O)-CH_3$ | $-C(=N-SO_2-CH_3)-H$ | $-C(=C(CN)-CN)-H$ | 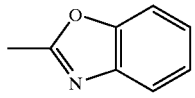 |
| $-COOC_2H_5$ | B88-1 | B89-1 | B90-1 | B91-1 | B92-1 |
| $-COCOOC_2H_5$ | B88-2 | B89-2 | B90-2 | B91-2 | B92-2 |
| $-COCH_3$ | — | B89-3 | B90-3 | B91-3 | — |
| $-COCF_3$ | — | B89-4 | B90-4 | B91-4 | — |
| $-CHO$ | — | B89-5 | B90-5 | B91-5 | — |
| $-SO_2CH_3$ | — | B89-6 | B90-6 | B91-6 | — |
| $-SO_2CF_3$ | B88-3 | B89-7 | B90-7 | B91-7 | B92-3 |
| $-COCH_2SCH_3$ | B88-4 | B89-8 | B90-8 | B91-8 | — |
| 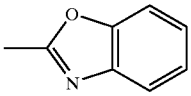 | B88-5 | B89-9 | B90-9 | B91-9 | B92-4 |
| $-COOC_2H_4SCH_3$ | B88-6 | B89-10 | B90-10 | B91-10 | B92-5 |
| $-COCOOC_2H_4SCH_3$ | B88-7 | B89-11 | B90-11 | B91-11 | B92-6 |
| $-COCONHC_2H_4SCH_3$ | B88-8 | B89-12 | B90-12 | B91-12 | B92-7 |

Any one of the compounds represented by formulas (H), (Pa), (Pb), (Pc) and (T) is preferably employed as a contrast-increasing agent in the photothermographic materials used in this invention.

Compounds represented by formulas (A-1) through (A-5) are also usable as a contrast-increasing agent.

Formula (A-1)

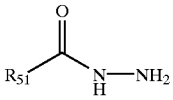

Formula (A-2)

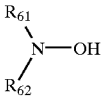

Formula (A-3)

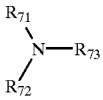

Formula (A-4)

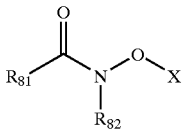

-continued

Formula (A-5)

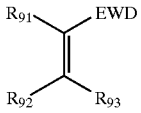

In formula (A-1), $R_{51}$ is an alkyl group, an alkenyl group, an alkoxy group, an alkylthio group, an amido group, an aryl group, an aralkyl group, an aryloxy group, an arylthio group, an anilino group or a heterocyclic group.

In formula (A-29, $R_{61}$ and $R_{62}$ are each a hydrogen atom, an alkyl group, an alkenyl group, an aryl group, an aralkyl group, an aliphatic or aromatic heterocyclic group or a cyclic aliphatic group.

In formula (A-3), $R_{71}$ is a hydroxyalkyl group; $R_{72}$ and $R_{73}$ are each a hydrogen atom, an alkyl group, $-(CH_2)n-N-R_{74}(R_{75})$, in which n is an integer of 1 to 10, and $R_{74}$ and $R_{75}$ are each a hydrogen atom or an alkyl group.

In formula (A-4), $R_{81}$ is a hydrazine group, an alkylamino group, a sulfonylamino group, a ureido group, an oxycarbonylamino group, an alkynyl group or an unsubstituted amino group; $R_{82}$ is a hydrogen atom, an alkyl group, an aryl group or a heterocyclic group; X is a hydrogen atom, an alkyl group, a carbamoyl group or an oxycarbonyl group, provided that $R_{81}$ and $R_{82}$ may combine together with each other to form a ring.

In formula (A-5), EWD represents an electron-withdrawing group; $R_{91}$, $R_{92}$ and $R_{93}$ are each a hydrogen atom, or a univalent substituent group, provided that at least one of $R_{92}$ and $R_{93}$ a univalent substituent group. The electron-withdrawing group represented by EWD is a substituent group exhibiting a positive value of Hammett substituent constant (σp) and examples thereof include cyano, an alkoxycarbonyl group, an aryloxycarbonyl group, a carbamoyl group, a sulfamoyl group, an alkylsulfamoyl group, an arylsulfonyl group, nitro, a halogen atom, a perfluoroalkyl group, an acyl groyp, a formyl group, a sulfolyl group, a carboxy group or its salt, a sulfo group or its salt, a saturated or unsaturated heterocyclic group, an alkenyl group, an alkynyl group, an acyloxy group, an acylthio group, a sulfonyloxy group, or an aryl group substituted by either of these groups. These groups may be further substituted.

Exemplary examples of the compounds represented by formulas (A-1) through (A-5) are shown below but are not limited to these.

(1)

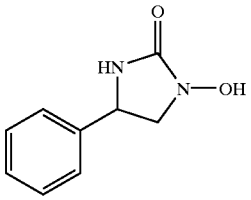

(2)

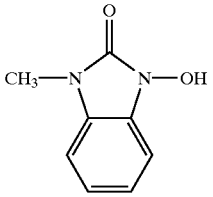

(3)

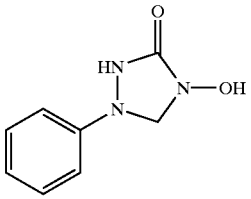

(4)

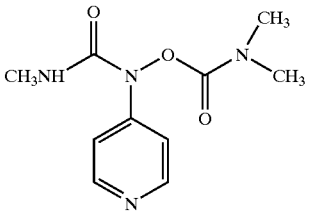

(5)

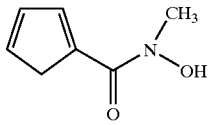

-continued (6)

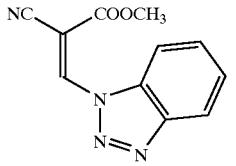

(7)

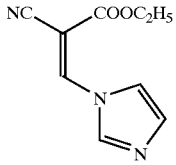

(8)

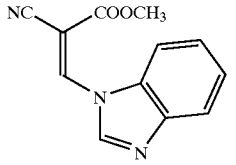

(9)

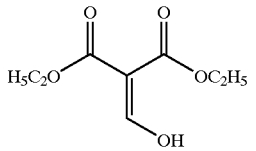

(10)

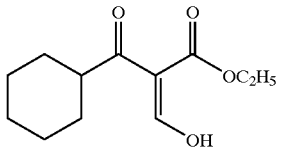

(11)

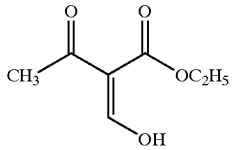

(12)

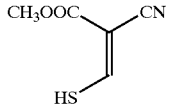

(13)

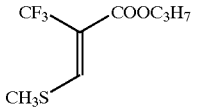

(14)

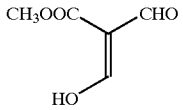

(15)

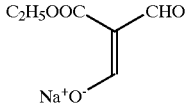

(16)

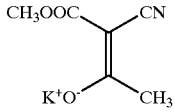

-continued (17)

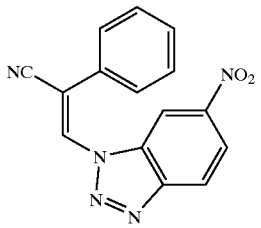

(18)

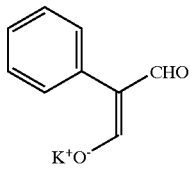

(19)

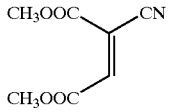

(20)

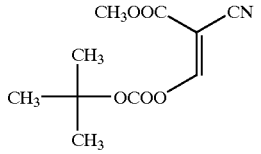

(21)

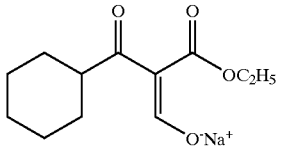

(22)

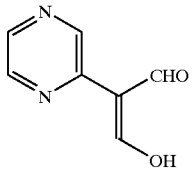

(23)

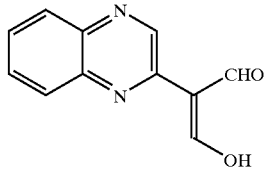

The compound is incorporated preferably in an amount of $1\times10^{-8}$ to 1 mol per mol of silver halide, and more preferably $1\times10^{-7}$ to $1\times10^{-1}$ mol per mol of silver halide. The compound can be incorporated according to the commonly known method.

A hydroxylamine compound, alkanolamine compound and ammonium phthalate compound described in U.S, Pat. No. 5,545,505; a hydroxamic acid described in U.S. Pat. No. 5,545.507; a N-acylhydrazine compound described in U.S. Pat. No. 5,558,983;an acrylonitrile compound described in U.S. Pat. No. 5,545,515; a hydrogen atom donor compound such as benzhydrol, diphenylphosphine, dialkylpiperidine or alkyl-β-ketoester described in U.S. Pat. No. 5,937,449 may also be incorporated, as a contrast-increasing agent, to the photothermographic material used in this invention.

Binders suitable for the photothermographic material used in the invention are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly (acrylic acid), poly(methyl methacrylic acid), poly(vinyl chloride), poly(methacrylic acid), copoly(styrene-maleic acid anhydride), copoly(styrene-acrylonitrile, copoly (styrene-butadiene, poly(vinyl acetal) series [e.g., poly(vinyl formal)and poly(vinyl butyral), polyester series, polyurethane series, phenoxy resins, poly(vinylidene chloride), polyepoxide series, polycarbonate series, poly(vinyl acetate) series, cellulose esters, poly(amide) series. Hydrophilic or hydrophobic binders are sable in this invention but hydrophobic transparent binders are preferred to reduce fogging caused after thermal development. Examples of preferred binders include polyvinyl butyral, cellulose acetate, cellulose acetate butyrate, polyester, polycarbonate, polyacrylic acid, and polyurethane. Of these, polyvinyl butyral, cellulose acetate, cellulose acetate butyral, and polyester are preferred.

A dry thickness of the layer containing light sensitive silver halide (hereinafter, also referred to as light sensitive layer) is preferably 2 to 20 μm, and more preferably 5 to 20 μm. The layer thickness of less than 2 μm is not preferred, which causes coating troubles such as uneven coating and pin-holes. The layer thickness of more than 20 μm deteriorates developablity. A dry thickness of the surface protective layer of the light sensitive layer side is preferably 0.1 to 10.0 μm, and more preferably 0.1 to 8.0 μm. There may be provided another layer between light sensitive layer or protective layer, and the support. The thinner layer other than the light sensitive layer is preferred. For example, the thicker A thick protective layer lowers heat transmission from the protective layer side to the light sensitive layer and layer between the light sensitive layer and the support also lowers heat transmission from the support side, resulting in deterioration in developability. The total dry layer thickness of the back side is preferably 2 to 20 μm. Since development is possible even by heat transmission from the back side, the thinner backing layer is preferred. however, the layer thickness of less than 2 μm causes uneven coating and the layer thickness of more than 20 μm deteriorates developability.

The light sensitive layer containing light sensitive silver halide may be formed by an aqueous coating solution containing at least 60% water, based on the weight of total solvents, or by coating a coating solution containing at least 60% organic solvent, based on the weight of total solvents. The coating solution containing at least 60% water, based on total solvents are exemplarily shown below.

Alternative preferred binder is a polymer which is soluble or dispersible in aqueous solvent (water solvent) and exhibits an equilibrium moisture content at 25° C. and 60% RH of not more than 2 wt %. Using such a polymer, a coating solution containing 30 wt % or more water solvent can be coated to form a light sensitive layer. However, in cases when the moisture content exceeds the above-described value, an increase of fog occurs after being stored in a high humid atmosphere. The aqueous solvent in which the polymer is soluble or dispersible is water or a mixture of water and a water-miscible organic solvent of 70 wt % or less. Examples of the water-miscible organic solvent include alcohols such as methyl alcohol, ethyl alcohol, and propyl alcohol; celllosolves such as methyl cellosolve, ethyl cellosolve and butyl cellosolve; ethyl acetate and dimethylformylamide.

In this invention, the expression, the aqueous solvent is employed even in cases where a polymer is not thermodynamically dissolved but exists in the form of a dispersion. The equilibrium moisture content at 25° C. and 60% RH is defined as below:

$$\text{Moisture content at 25° C. and 60\% RH}=\{(W_1-W_0)/W_0\}\times 100\ (\text{wt \%})$$

where $W_1$ is a weight of the polymer which has been equilibrated in an atmosphere of 25° C. and 60% RH and $W_0$ is a weight of the polymer which has been completely dried at 25° C. Of these polymers, a polymer dispersible in aqueous solvent is specifically preferred. Examples of the dispersion include a latex in which fine solid polymer particles are dispersed and a dispersion in which polymer molecules are in the molecular form or in the form of a micelle. A moisture content of the polymer described above is not more than 2% by weight preferably 0.01 to 1.5% by weight, and more preferably 0.02 to 1% by weight at 25° C. and 60% RH.

Polymers used for polymeric latexes include acryl resin, vinyl acetate resin, polyester resin, polyurethane resin, rubber type resin, vinyl chloride resin, vinylidene chloride resin, polyolefin resin and their copolymers. Polymers may be a straight-chained polymer or branched polymer, or a cross-linked polymer, including homopolymers and copolymers. The copolymer may be a random copolymer or a block copolymer. The number-averaged molecular weight of the copolymer is preferably 5,000 to 1000,000, and more preferably 10,000 to 100,000. In cases where the molecular weight is excessively small, mechanical strength of an image forming layer such as a light-sensitive layer is insufficient, excessively large molecular weight results in deterioration in film forming property.

Exemplary examples of polymeric latexes used as binder include the following:

—$(MMA)_{50}$-$(EA)_{45}$-$(AA)_5$-latex (MW=30,000) P-1

—$(2EHA)_{30}$-$(MMA)_{50}$-$(St)_{15}$-$(MAA)_5$-latex (MW50,000 P-2

—$(BR)_{50}$-$(St)_{47}$-$(AA)_3$-latex (MW=10,000) P-3

—$(BR)_{40}$-$(DVB)_{10}$-$(St)_{45}$-$(MAA)_5$-latex (MW=50,000) P-4

—$(VC)_{70}$-$(MMA)_{25}$-$(AA)_5$-latex (MW=50,000) P-5

—$(VDC)_{60}$-$(MMA)_{30}$-$(EA)_5$-$(MAA)_5$ latex (MW=80,000) P-6

In the above, the abbreviation represents a constitution unit derived from a monomer as shown below, and the number represents a weight percentage:

MMA: methylmethacrylate, EA: ethylacrylate,

AA: acrylic acid, 2EHA: 2-ethylhexylacrylate,

St: styrene, MAA: methacrylic acid,

BR: butadiene, DVB: divinylbenzene

VC: vinyl chloride, VDC: vinylidene chloride

Such polymers are commercially available, and examples of commercially available acryl-resin include Sevian A-4635, 46583, and 4601 (available from DAISEL CHEMICAL INd. Ltd.)Nipol Lx811, 814, 821, 820, and 857 (available from NIHON ZEON Co. Ltd. Examples of polyester rein include FINETEX ES650, 611, 675, 850 (available from DAINIPPON INK CHEMICAL Co. Ltd.), and WD-size WMS (available from Eastman Kodak Corp.). Examples of polyurethane resin include HYDRAN AP10, 20, 30, 40 (available from DAINIPPON INK CHEMICAL Co. Ltd.). Examples of rubber resin include LACSTAR 7310K, 3307, 4700H, 7132C (available from DAINIPPON INK CHEMICAL Co. Ltd.); and Nipol Lx416, 410, 438C and 2507 (available from NIHON ZEON Co. Ltd.). Examples of vinylidene chloride resin include L502, L513 (available from ASAHI CHEMICAL IND. Co. Ltd.). Examples of olefin resin include CHEMIPAL s120, SA100 (available from MITSUI PETROLEUM CHEMICAL IND. Co. Ltd.). These polymers can be used alone or may be blended.

Various surfactants can be employed as a coating aid in the photothermographic materials used in this invention. Specifically, fluorinated surfactants are preferably used to improve antistatic property and spot coating trouble.

Suitable image tone modifiers usable in the invention include those used in the invention b). Tone modifiers are preferably incorporated into the thermally developable photosensitive material used in the present invention. Examples of preferred tone modifiers, which are disclosed in Research Disclosure Item 17029. The photothermographic materials used in this invention may contain a mercapto compound, disulfide compound or thione compound to inhibit or accelerate development, to enhance spectral sensitization efficiency, or to enhance storage stability of the unprocessed photographic material.

Antifoggants may be incorporated into the thermally developable photothermographic material to which the present invention is applied.

There can be used sensitizing dyes in the photothermographic material. Particularly, there can advantageously be selected sensitizing dyes having the spectral.sensitivity suitable for spectral characteristics of light sources of various types of scanners.

Various kinds of additives can be incorporated into a photosensitive layer, a non-photosensitive layer or other construction layers. Except for the compounds mentioned above, surface active agents, antioxidants, stabilizers, plasticizers, UV (ultra violet rays) absorbers, covering aids, etc. may be employed in the thermally developable photosensitive material according to the present invention. These additives along with the above-mentioned additives are described in Research Disclosure Item 17029 (on page 9 to 15, June, 1978) and can be employed.

Next, the automatic thermal processor used in this invention will be explained. The automatic thermal processor is one used for heat-developing exposed photothermographic materials. The thermal processor comprises a heat-developing section in which heat-development is conducted. The heater in the heat-developing section is preferably heated to a temperature of 117° C. or more. The photothermographic material is transported at a speed of 22 to 40 mm/sec. in the heat-developing section. The interior of the heat-developing section is at a thermal atmosphere of a temperature of 117° C. or higher. In the thermal processor, a photothermographic material is allowed to pass through an atmosphere of 117° C. or higher in the heat-developing section, in at least 10 sec. Thus, heat-development is conducted by allowing the photothermographic material to be transported in an atmosphere of 117° C. or higher in at least 10 sec. Thereafter, the photothermographic material is brought into contact with a heating member having a surface temperature of 90 to 115° C. (and preferably 100 to 110° C.) or allowed to pass near the surface of the heating member.

The heating section preferably comprises a temperature-controllable heating member used for development, which is heated at a temperature of 117° C. or higher (preferably 117 to 145° C., and more preferably 117 to 140° C.). As the heating member are employed a conductive heating body, a halogen lamp, and a heating body described in JP-A No. 61-145544. Examples of concrete embodiments thereof include, for example, (1) holding within an oven maintained at a prescribed temperature, (2) transporting at a constant speed in an oven maintained at a prescribed temperature, and (3) bringing into contact with a heated medium (e.g., metallic roller, silicone rubber, urethane rubber, paper, fluorinated processing medium, etc.) maintained at a prescribed temperature, for a-prescribed period of time. Of these, (2) and (3) are preferred. The processing time in the heat-developing section is preferably 10 to 60 sec., more preferably 10 to 50 sec, and still more preferably 10 to 30 sec. Separately from the heat-developing section, a preheating section may be provided prior to the heat-developing section. The temperature of the preheating section is preferably maintained at from 100 to 1200 C and more preferably 100 to 115° C. The processing time of the preheating section is preferably 3 to 30 sec. and more preferably 5 to 25 sec. The total processing time is preferably 20 to 80 sec. and more preferably 30 to 70 sec.

The heat-developing section preferably comprises a transport member to transport a photothermographic material. Examples of such transport member include a transport roller and transport belt. The transport roller and transport belt may also used as a heating member used for development. Alternatively, a heating member used for development such as a planar heater may be separately provided. The planar heater may be opposed to a transport roller, transport rollers may be opposed with each other, or transport rollers may be arranged in a staggered form. However, such staggered roller system is not suitable. The photothermographic material is transported preferably under a tension of not more than 10 kg/cm$^2$.

The thermal processor used in this invention preferably comprises a cooling section to cool the heat-developed photothermographic material. The cooling section preferably comprises a cooling fan or a cooler.

The heating section exhibiting a surface temperature of 90 to 115° C. preferably is the final heating member which is temperature-controlled in the thermal processor. The heating member exhibiting a surface temperature of 90 to 1150 c may be provided at the final of heat-developing stage, at the top of the cooling section, or between the heat-developing and cooling sections.

A temperature-control mechanism is preferably provided to regulate the temperature of the heat-developing section or preheating section. It is preferred to control or regulate temperature using a thermostat or the like. There may be provided a temperature feed-back system. In the feed-back system, it is preferred to feed back information at any time or at regular intervals of an hour or a day and these can be freely regulated by the operator. The temperature control of the heating member include not only controlling the temperature to a precision of a 1° C. unit or 0.1° C. unit but also controlling the temperature roughly in such a way that it is operated to on whereupon exceeding a given temperature or to off whereupon falling below a given temperature.

In the thermal processor used in this invention, a photothermographic material is allowed to pass through the heat-developing section in at least 10 sec., thereafter, the photothermographic material is brought into contact with a heating member exhibiting a surface temperature of 90 to 115° C. or allowed to pass near the surface of the heating member.

The heating section is preferably provided with a napped material on the surface to be in contact with the photothermographic material. In cases where the heat-developing section is provided with a transport roller and an opposed planar heating member and a photothermographic material is transported by the transport roller between the transport roller and the planar heating member, the planar heating member preferably comprises a napped material. In the cases where the heat-developing section is provided with a transport belt, the transport belt preferably comprises a napped material surface.

The transport speed of the photothermographic material is preferably constant in the heat-developing step. In cases where a cooling step is provided, the transport speed in the former half of the cooling step is preferably 22 to 40 mm/sec., more preferably, the transport speed in the overall cooling step is 22. to 40 mm/sec., and still more preferably, the transport speed in the overall steps of the thermal processor is 22 to 40 mm/sec.

The thermal processor used in this invention may be combined with an exposure system. In. such a case, a transport system is combined via a bridge.

EXAMPLES

The present invention will be further explained based on examples but embodiments of the invention are by no means limited to these examples.

Example 1

Preparation of PET Support

After being dried at 130° C., PET pellets were melted at 300° C., extruded through T-type die and immediately thereafter cooled to prepare non-stretched film. Using rolls different in circumferential speed, the film is longitudinally stretched to 3.0 times and then laterally stretched to 4.5 times by means of a tenter, in which the temperature was 110° C. and 130° C., respectively. Thereafter, the stretched film was thermally fixed at 240° C. for 20 sec. and then subjected to relaxation in the lateral direction to 4%. Then, after the portion corresponding to the tenter chuck section was slitted and both edge portions were subjected to a knurling treatment and winded at 4 kg/cm$^2$. There was thus obtained a 2.4 m width, 800 m long and 100 $\mu$m thick PET film. A 125 $\mu$m thick PET film support was also obtained similarly to the 100 $\mu$m film support, provided that the film thickness was adjusted before being stretched. Both 100 $\mu$m and 125 $\mu$m thick PET exhibited a glass transition point of 79° C.

Both sides of each of biaxially stretched and fixed PET film supports of 100 $\mu$m, 110 $\mu$m, 125 $\mu$m and 175 $\mu$m thickness were subjected to corona discharge at 8 w/m$^2$.min. Onto the surface of one side thereof, the subbing coating composition a-1 descried below was applied so as to form a dried layer thickness of 0.8 $\mu$m, which was then dried. The resulting coating was designated Subbing Layer A-1. Onto the opposite surface, the subbing coating composition b-1 described below was applied to form a dried layer thickness of 0.8 $\mu$m. The resulting coating was designated Subbing Layer B-1.

| Subbing Coating Composition a-1 | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis(ethyleneurea) | 0.8 g |
| Polystyrene fine particles (av. Size 3 $\mu$m) | 0.05 g |
| Colloidal silica (av. size 90 $\mu$m) | 0.1 g |
| Water to make | 1 liter |

-continued

| Subbing Coating Composition b-1 | |
|---|---|
| $SnO_2$/Sb (9/1 by weight, av. Size 0.18 μm) | 200 mg/m$^2$ |
| Latex liquid (solid portion of 30%) | 270 g |
| of a copolymer consisting of | |
| butyl acrylate (30 weight %) | |
| styrene (20 weight %) | |
| glycidyl acrylate (40 weight %) | |
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharging with 8 w/m$^2$.minute. Onto the Subbing Layer A-1, the upper subbing layer coating composition a-2 described below was applied so as to form a dried layer thickness of 0.8 μm, which was designated Subbing Layer A-2, while onto the Subbing Layer B-1, the upper subbing layer coating composition b-2 was applied so at to form a dried layer thickness of 0.8 μm, having a static preventing function, which was designated Subbing Upper Layer B-2.

| Upper Subbing Layer Coating Composition a-2<br>Gelatin in an amount (weight) to make 0.4 g/m$^2$ | |
|---|---|
| (C-1) | 0.2 g |
| (C-2) | 0.2 g |
| (C-3) | 0.1 g |
| Silica particles (av. size 3 μm) | 0.1 g |
| Water to make | 1 liter |
| **Upper Subbing Layer Coating Composition b-2** | |
| (C-4) | 60 g |
| Latex solution (solid 20% comprising) | 80 g |
| (C-5) as a substituent | |
| Ammonium sulfate | 0.5 g |
| (C-6) | 12 g |
| Polyethylene glycol (average molecular weight of 600) | 6 g |
| Water to make | 1 liter |

(C-1)

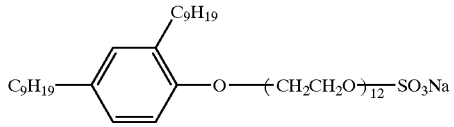

(C-2)

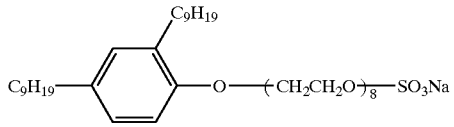

(C-3)

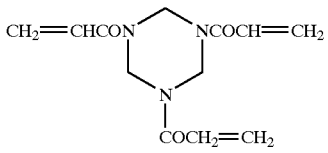

-continued (C-4)

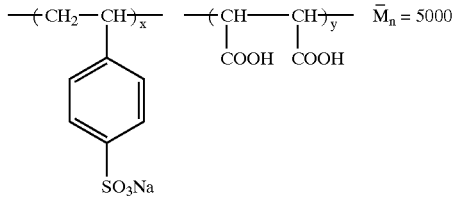

($\bar{M}n$ is a number average molecular weight)

x:y = 75:25 (weight ratio)

(C-5)

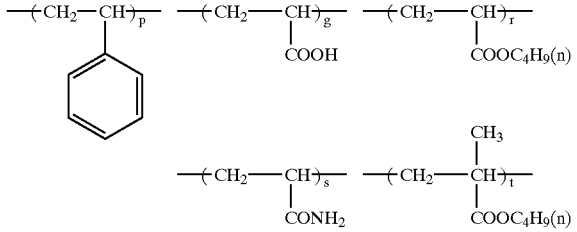

p:g:r:s:t = 40:5:10:5:40 (weight ratio)

(C-6)

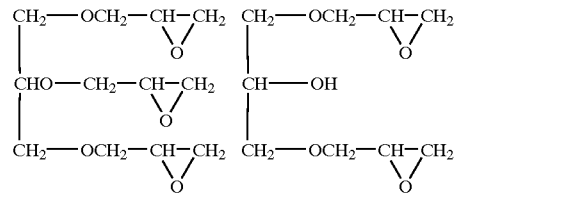

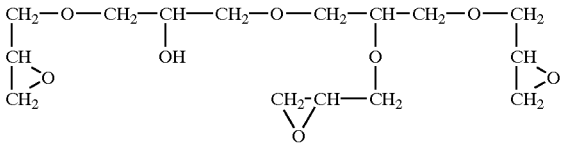

Mixture consisting of the three compounds illustrated above

Thermal Treatment of Support

In the subbing and drying process of the subbed support, the support was heated at 1400 C and then gradually cooled.

Preparation of Light-sensitive Silver Halide Emulsion A

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing sodium chloride, potassium bromide, potassium iodide (in a molar ratio of 60/38/2), and $1\times10^{-6}$ mol/mol Ag of $[Ir(NO)Cl_5]$ and $1\times10^{-6}$ mol/mol Ag of rhodium chloride were added by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromochloride grains having an average grain size of 0.06 μm, a variation coefficient of the projection area equivalent diameter of 10 percent, and the proportion of the {100} face of 87 percent. The resulting emulsion was flocculated-to remove soluble salts, employing a flocculating agent.

Preparation of Sodium Behenate Solution

In 945 ml water were dissolved 32.4 g of behenic acid, 9.9 g of arachidic acid and 5.6 g of stearic acid at 90° C. Then, after adding 98 ml of 1.5M aqueous sodium hydroxide solution with stirring and further adding 0.93 ml of concentrated nitric acid, the solution was cooled to a temperature of 55° C. to obtain an aqueous sodium behenate solution.

Preparation of Pre-formed Emulsion of Silver Behenate and Silver Halide Emulsion A.

To the aqueous sodium behenate solution described above was added silver halide emulsion A. After adjusting the pH to 8.1 with aqueous sodium hydroxide, 147 ml of aqueous 1M silver nitrate solution was added thereto in 7 min and after stirring for 20 min., soluble salts were removed by ultrafiltration. Thus obtained silver behenate was comprised of monodisperse particles having an average particle size of 0.8 $\mu$m and a monodispersibility (i.e., variation coefficient of particle size distribution) of 8%. After forming flock of the dispersion, water was removed therefrom and after washing and removal of water were repeated six times, drying was conducted.

Preparation of Light-sensitive Emulsion

To a half of the thus prepared pre-formed emulsion were gradually added 544 g of methyl ethyl ketone solution of 17 wt % polyvinyl butyral (average molecular weight of 3,000) and 107 g of toluene. Further, the mixture was dispersed by a media dispersing machine using 0.5 mm $ZrO_2$ beads mill and at 4,000 psi and 30° C. for 10 min.

On both sides of the support described above, the following layers were simultaneously coated to prepare photothermographic material sample. Drying was conducted at 60° C. for 15 min.

Back Coating

On the B-1 layer of the support, the following composition was coated.

| | |
|---|---|
| Cellulose acetate-butylate (10% methyl ethyl ketone solution) | 15 ml/m$^2$ |
| Dye-A in an amount giving absorbance of 0.8 at 780 nm | |
| Matting agent: monodisperse silica having a monodisperse degree of 15% and average size of 8 $\mu$m | 90 mg/m$^2$ |
| $C_8F_{17}(CH_2CH_2O)_{12}C_8H_{17}$ | 50 mg/m$^2$ |
| $C_9F_{19}$—$C_6H_4$—$SO_3Na$ | 10 mg/m$^2$ |

In Samples 1 through 4, Dye-A was not added.

Dye-A

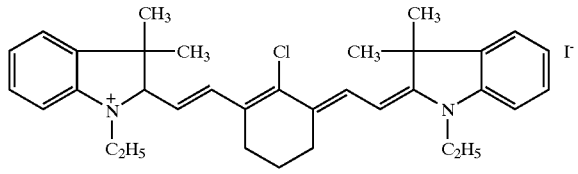

Coating on the Light-sensitive Layer Side

On the sub-layer A-1 side of the support, a photosensitive layer having the following composition was coated so as to have silver coverage of 1.5 g/m$^2$.

| | |
|---|---|
| Light-sensitive emulsion | 240 g |
| Sensitizing dye (0.1% methanol solution) | 1.7 ml |
| Pyridinium bromide perbromide (6% methanol solution) | 3 ml |
| Calcium bromide (0.1% methanol solution) | 1.7 ml |
| Oxidizing agent (10% methanol solution) | 1.2 ml |
| 2-(4-Chlorobenzoyl)-benzoic acid (12% methanol solution) | 9.2 ml |
| 2-Mercaptobenzimidiazole (1% methanol solution) | 11 ml |
| Tribromethylsulfoquinoline (5% methanol solution) | 17 ml |
| Contrast-increasing agent | |
| B-45-9 | 0.4 g |
| H-32 | 0.2 g |
| Phthalazinone | 0.6 g |
| 4-Methylphthalic acid | 0.25 g |
| Tetrachlorophthalic acid | 0.2 g |
| Calcium carbonate (av. size of 3 $\mu$m) | 0.1 g |
| 1,1-Bis(2-2-hydroxy-3,5-dimethylphenyl)-2-methylpropane (20% methanol solution) | 20.5 ml |
| Isocyanate compound (Desmodur N3300, Available from Movey Corp.) | 0.5 g |

Sensitizing dye

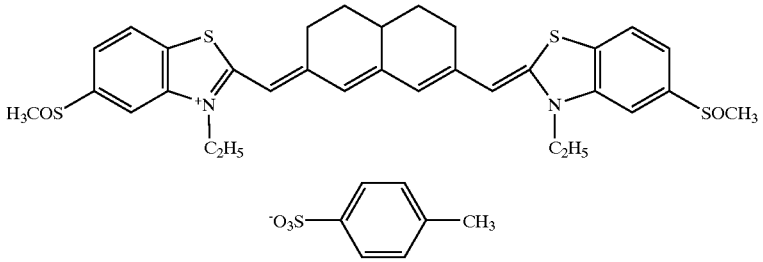

Oxidizing agent

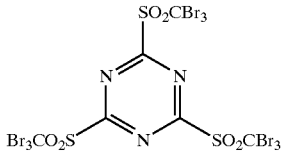

Surface Protective Layer Coating Solution

The following composition was coated on the photosensitive layer simultaneously therewith.

| | |
|---|---|
| Acetone | 5 ml/m2 |
| Methyl ethyl ketone | 21 ml/m$^2$ |
| Cellulose acetate | 2.3 g/m$^2$ |
| Methanol | 7 ml/m$^2$ |
| Phthalazinone | 250 mg/m$^2$ |
| Matting agent, monodisperse silica having monodispersity of 10% and a mean size of 4 $\mu$m | 5 mg/m$^2$ |
| $CH_2{=}CHSO_2CH_2CONHCH_2CH_2NHCOCH_2SO_2CH{=}CH_2$ | 35 mg/m$^2$ |
| Surfactant $C_{12}F_{25}(CH_2CH_2O)_{10}C_{12}F_{25}$ | 10 mg/m$^2$ |
| $C_8F_{17}$—$C_6H_4$—$SO_3Na$ | 10 mg/m$^2$ |

After removing binder of the coated sample, the electron-microscopic observation by the replica method proved that organic salt grains were monodisperse grains of a monodispersibility of 5% and 90% of the total grains were accounted for by tabular grains having a major axis of 0.5±0.05 $\mu$m, a minor axis of 0.4±0.05 $\mu$m and a thickness of 0.01 $\mu$m.

Supports which were prepared, after being biaxially stretched, under the conditions at a transport speed of 10 to 50 m/min, a tension of 1 to 8 kg/cm$^2$ and thermal treatment temperature/time of 120 to 210° C./1 to 15 min, were measured and using supports exhibiting a thickness and thermal dimensional change, as shown in Table 1, photothermographic material samples Nos. 1 through 20 were prepared.

Measurement of Thermal Dimensional Change

After photothermographic material samples were allowed to stand in an atmosphere at 230 C and 50% RH for 2 hrs, 10 cm square samples were cut, scratches of "+" were marked with a cutter at the corners of the 10 cm square and the diagonal length of the square was measured for each sample. The diagonal was arranged in the longitudinal/width direction. After being subjected to the thermal treatment, each sample was allowed to stand in an atmosphere at 23° C. and 50% RH for at least 2 hrs, and then the diagonal length was again measured. The dimensional change rate between before and after thermal treatment was represented as a percentage, provided that only a larger change in the longitudinal and width directions was shown in the Table. The thermal treatment was conducted in the following manner. Thus, two pieces of 3 mm thick aluminum plates (15 cm square) were placed in an oven maintained at 125° C., a measurement sample was laminated with the aluminum plates and allowed to stand 25 sec. Thereafter, the sample was taken out of the oven and allowed to cool. As a measurement instrument was employed Measurescope 20, DP-200, SC-102 (available from Nikon Corp.)

Exposure and Processing Condition

Exposure was conducted using an image setter, Panasonic KX-J237LZ (780 nm semiconductor laser, available from Matsushita Electric Industrial Co., Ltd.).

Thermal processing was conducted using a thermal processor, as illustrated in FIG. 1. Thus, as shown in FIG. 1, a photothermographic material transporting in the "→" direction is introduced to the pre-heating section through insertion rollers 1. The pre-heating section has a total length of 60 cm, comprising upper transport rollers 2 and lower heated rollers 2' with a built-in halogen lamp, in which the temperature is set to 110° C. The heat-developing section has a total length of 60 cm, comprising a group of transport rollers 2 and the temperature is set to 123° C. with ceramic heaters 3 provided under the transport rollers. In the gradual cooling section, roller 4 with a built-in ceramic heater is a final controlled heat source and the subsequent process is in an atmosphere of ambient temperature. The portion ranging from the pre-heating section to the roller with a built-in ceramic heater is insulated with insulation material.

Evaluation of Minimum Density (Dmin)

Processed samples each were densitometrically evaluateded with respect to unexposed areas (Dmin). Sensitivity was represented by a relative value of the reciprocal of exposure giving a density of Dmin plus 0.2, based on the sensitivity of sample No. 1 being 100.

Evaluation of Density Fluctuation

A 25×40 cm sample was processed, in which the 40 cm side was arranged so as to traverse the transport direction of the thermal processor and the light sensitive layer side was upwardly placed. Densities of nine portions of each sample, including left, right and central portions of each of the top, central and end portions were measured with a Macbeth densitometer and the difference between the maximum and minimum densities was determined.

Evaluation of Dot Percentage Fluctuation

A 25×40 cm sample was subjected to overall halftoning exposure at an output of 70% of the theoretical value and thermally processed according the conditions shown in the Table. The dot percentage of nine portions including left, right and central portions of each of the top, central and end portions were measured with a Macbeth densitometer and the difference between the maximum and minimum densities was determined.

Evaluation of Dimension Reproducibility

Similarly to the measurement of thermal dimensional change, the diagonal length before and after being subjected to a thermal treatment under the condition shown in the Table was measured, provided that only the larger change in the longitudinal and width directions was shown in the Table.

Results of the foregoing are shown in Table 1.

TABLE 1

| No. | Support Thickness ($\mu$m) | Thermal Dimensional Change (%) | Transport Speed (mm/sec) | Final Heat Source Temp. (° C.) | Sensitivity | Dmin | Density Fluctuation | Dot % fluctuation | Dimension Reproducibility | Remark |
|---|---|---|---|---|---|---|---|---|---|---|
| 1 | 100 | 0.06 | 20 | 80 | 100 | 0.27 | 0.8 | 4.0 | 0.04 | Comp. |
| 2 | 100 | 0.06 | 25 | 80 | 97 | 0.27 | 0.9 | 3.8 | 0.04 | Comp. |
| 3 | 100 | 0.06 | 45 | 80 | 93 | 0.27 | 1.0 | 3.7 | 0.04 | Comp. |
| 4 | 100 | 0.06 | 20 | 125 | 103 | 0.30 | 0.9 | 4.3 | 0.05 | Comp. |
| 5 | 100 | 0.06 | 25 | 125 | 100 | 0.30 | 0.8 | 4.1 | 0.05 | Comp. |
| 6 | 100 | 0.06 | 45 | 125 | 98 | 0.29 | 0.7 | 4.1 | 0.05 | Comp. |

TABLE 1-continued

| No. | Support Thickness (μm) | Thermal Dimensional Change (%) | Transport Speed (mm/sec) | Final Heat Source Temp. (° C.) | Sensitivity | Dmin | Density Fluctuation | Dot % fluctuation | Dimension Reproducibility | Remark |
|---|---|---|---|---|---|---|---|---|---|---|
| 7 | 100 | 0.06 | 22 | 90 | 104 | 0.27 | 0.4 | 1.8 | 0.03 | Inv. |
| 8 | 100 | 0.06 | 25 | 90 | 102 | 0.27 | 0.4 | 1.6 | 0.03 | Inv. |
| 9 | 100 | 0.06 | 40 | 90 | 100 | 0.27 | 0.4 | 1.8 | 0.03 | Inv. |
| 10 | 100 | 0.06 | 22 | 110 | 107 | 0.26 | 0.4 | 1.6 | 0.03 | Inv. |
| 11 | 100 | 0.06 | 25 | 110 | 105 | 0.26 | 0.4 | 1.4 | 0.03 | Inv. |
| 12 | 100 | 0.06 | 40 | 110 | 103 | 0.26 | 0.4 | 1.6 | 0.03 | Inv. |
| 13 | 100 | 0.06 | 25 | 115 | 106 | 0.26 | 0.4 | 1.7 | 0.03 | Inv. |
| 14 | 100 | 0.01 | 25 | 110 | 105 | 0.26 | 0.4 | 1.2 | 0.02 | Inv. |
| 15 | 100 | 0.04 | 25 | 110 | 105 | 0.26 | 0.4 | 1.2 | 0.02 | Inv. |
| 16 | 110 | 0.06 | 25 | 110 | 104 | 0.26 | 0.4 | 1.2 | 0.03 | Inv. |
| 17 | 125 | 0.06 | 25 | 110 | 103 | 0.26 | 0.3 | 1.2 | 0.02 | Inv. |
| 18 | 150 | 0.06 | 25 | 110 | 100 | 0.26 | 0.4 | 1.4 | 0.02 | Inv. |
| 19 | 175 | 0.06 | 25 | 110 | 99 | 0.26 | 0.4 | 1.4 | 0.03 | Inv. |
| 20 | 125 | 0.04 | 25 | 110 | 103 | 0.26 | 0.3 | 1.1 | 0.02 | Inv. |

Example 2

Figure 2:
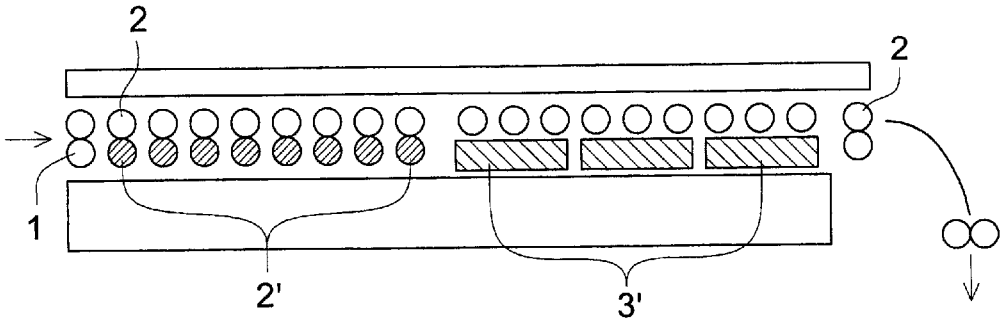
FIG. 2 also illustrates a thermal processor used in the invention.

Photothermograhic material samples were processed using a thermal processor having a heating section, as illustrated in FIG. 2, in which block heaters 3' having a velvet as a napped material on the surface thereof were used and the photothermographic material was transported to a gradual-cooling section by conventional transport rollers 2, and evaluated similarly to example 1.

Results thereof are shown in Table 2.

TABLE 2

| No. | Support Thickness (μm) | Thermal Dimensional Change (%) | Transport Speed (mm/sec) | Raising Length/ mm or Roller | Sensitivity | Dmin | Density Fluctuation | Dot % fluctuation | Dimension Reproducibility | Remark |
|---|---|---|---|---|---|---|---|---|---|---|
| 1 | 100 | 0.06 | 20 | Roller | 100 | 0.30 | 1.2 | 4.5 | 0.06 | Comp. |
| 2 | 100 | 0.06 | 25 | Roller | 95 | 0.30 | 1.3 | 4.7 | 0.06 | Comp. |
| 3 | 100 | 0.06 | 45 | Roller | 90 | 0.31 | 1.5 | 4.9 | 0.06 | Comp. |
| 4 | 100 | 0.06 | 45 | 0.5 | 91 | 0.28 | 1.0 | 4.2 | 0.05 | Comp. |
| 5 | 100 | 0.06 | 22 | 0.5 | 108 | 0.23 | 0.6 | 2.0 | 0.04 | Inv. |
| 6 | 100 | 0.06 | 25 | 0.5 | 105 | 0.23 | 0.6 | 1.9 | 0.04 | Inv. |
| 7 | 100 | 0.06 | 40 | 0.5 | 102 | 0.23 | 0.6 | 2.0 | 0.04 | Inv. |
| 8 | 100 | 0.06 | 25 | 1.5 | 107 | 0.23 | 0.6 | 1.9 | 0.04 | Inv. |
| 9 | 100 | 0.06 | 25 | 6.0 | 100 | 0.24 | 0.6 | 2.2 | 0.04 | Inv. |
| 10 | 100 | 0.04 | 25 | 1.5 | 107 | 0.23 | 0.6 | 1.9 | 0.04 | Inv. |
| 11 | 100 | 0.01 | 25 | 1.5 | 107 | 0.23 | 0.6 | 1.9 | 0.04 | Inv. |
| 12 | 110 | 0.06 | 25 | 1.5 | 106 | 0.23 | 0.6 | 1.9 | 0.03 | Inv. |
| 13 | 125 | 0.06 | 25 | 1.5 | 106 | 0.21 | 0.5 | 1.8 | 0.03 | Inv. |
| 14 | 150 | 0.06 | 25 | 1.5 | 105 | 0.23 | 0.6 | 1.9 | 0.03 | Inv. |
| 15 | 175 | 0.06 | 25 | 1.5 | 103 | 0.23 | 0.6 | 1.9 | 0.04 | Inv. |
| 16 | 125 | 0.04 | 25 | 1.5 | 107 | 0.22 | 0.5 | 1.8 | 0.03 | Inv. |

Example 3

Preparation of Organic Silver Salt

To a mixture of 4.4 g of arachidic acid, 39.4 g of behenic acid and 770 ml distilled water were added 103 ml of an aqueous 1N NaOH solution in 60 min. with stirring at 85° C. to allow to react for 240 min. and then the temperature was lowered to 75° C. Subsequently, 112.5 ml aqueous solution of 19.2 g silver nitrate was added thereto in 45 sec., the reaction mixture was allowed to stand for 20 min as it was and then the temperature was lowered to 30° C. Thereafter, the solid product was filtered by the absorption filtration and washed with water until the filtrate reached a conductivity of 30 μS/cm. The thus obtained solid was treated in the form of a wet cake, without being dried. To the wet cake of 100 solid, 10 g of polyvinyl alcohol (PVA-205, available from KURARAY Co. Ltd.) and water were added to make the total amount of 500 g and were preliminarily dispersed by a homomixer. The mixture was dispersed three times using a dispersing machine (Microfluidizer M-11 OS-EH, available from Microfluidex International Corp., in which G10Z interaction chamber was used), at a pressure of 1750 kg/cm2 to complete preparation of an organic silver salt microcrystal dispersion exhibiting a mean volume-weighted particle diameter of 0.93 μm. The particle size was measure using Master Sizer X, available from Malvern Instruments Ltd. Cooling procedure was made by installation of coiled heat exchangers before and after the interaction chamber to adjust the temperature of a refrigerant to an intended value.

Preparation of Light-sensitive Layer Coating Solution

To the organic silver salt fine crystal dispersion (silver/mole equivalent), silver halide of 3.7 mol %, based on silver of the organic silver salt and the following binder and materials used for thermal development were used to prepare an emulsion.

| | |
|---|---|
| Binder; Laxter 3307B (available from Dainippon Chemical Ind. Co. Ltd., comprised of SBR latex exhibiting a glass transition temperature of 17° C.) | solid 470 g |
| 1,1-bis(2-hydroxy-3,5-dimethylphenyl)-3,5,5-trimethylhexane | solid 110 g |
| Tribromomethylphenylsulfone | solid 25 g |
| 3,4-Dihydroxy4-oxo-1,2,3-benzotriazine | solid 5.2 g |
| Contrast-increasing agent | |
| B93-1 | 0.1 g/m$^2$ |
| B93-2 | 0.2 g/m$^2$ |
| Compound ZN | 0.1 g/m$^2$ |

3,4-Dihydroxy-4-oxo-1,2,3-benzotriazine, 1,1-bis(2-hydroxy-3,5-dimethylphenyl)-3,5,5-trimethylhexane, and tribromomethylphenylsulfon wereprepared in the form of a fine solid particle dispersion, according to the conventional method.

B93-1

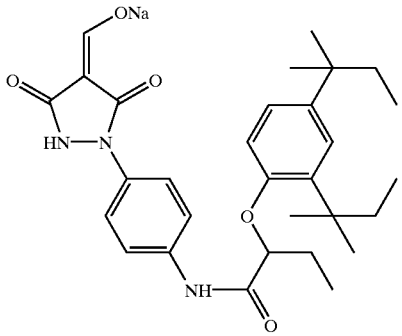

B93-2

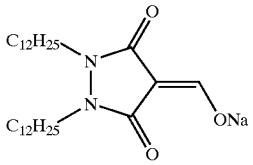

Compound ZN

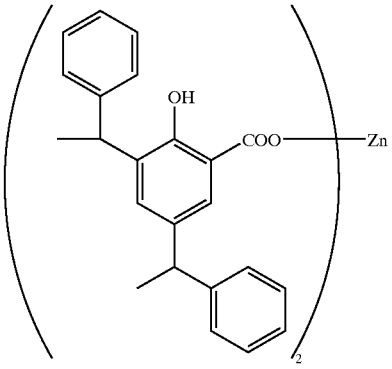

Coating solution of Protective Layer for Light Sensitive Layer or Backing Layer

To 500 g of a polymer latex comprised of methyl methacrylate/styrene/2-ethylhexyl acrylate/2-hydroxyethyl methacrylate/methacrylic acid (59/9/26/5/1) copolymer, 262 g of $_2O_2$ was added and further thereto were successively added 14 g of benzyl alcohol as a film-making agent, 2.5 g of Compound D, 3.6 g of cellosol 524 (available from Chukyo Yushi Co., Ltd.), 12 g of Compound E, 1 g of Compound F, 2 g of Compound G, 7.5 g of Compound H, 2.0 g of Compound I and 3.4 g of polymethyl methacrylate fine particles of an average size of 3 $\mu$m, as a matting agent; and water was added to make 1000 g. A coating solution was thus prepared, having a viscosity of 5 cp (at 25° C.) and a pH of 3.4 (at 25° C.).

Compound D

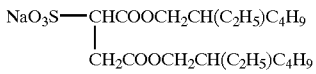

Compound E

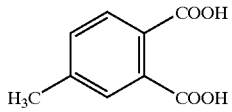

Compound F

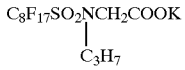

Compound G

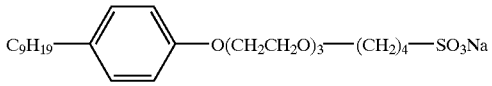

Compound H

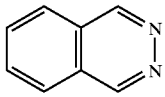

Compound I

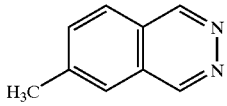

Preparation of Backing Layer Coating Solution

To the protective layer coating solution described above, Dye-C was added in an amount giving 0.8 of absorbance at 780 nm to prepare a coating solution of a backing layer. The thus prepared coating solutions were coated on a PET support so that a binder coverage of the backing protective layer and the light sensitive layer-side protective layer was 0.8 g/m$^2$ and 1.2 g/m$^2$, respectively, and a silver coverage of the light sensitive layer was 1.6 g/m$^2$.

On a support exhibiting a thickness and a thermal dimensional change, as shown in Table 3, coating solutions were coated to prepare a photothermographic material sample. The thus prepared samples were evaluated in the same manner as in Example 1 and the results thereof are shown in Table 3.

Dye-C

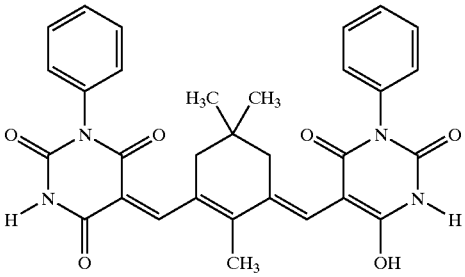

TABLE 3

| No. | Support Thickness (μm) | Thermal Dimensional Change (%) | Transport Speed (mm/sec) | Final Heat Source Temp. (° C.) | Sensitivity | Dmin | Density Fluctuation | Dot % fluctuation | Dimension Reproducibility | Remark |
|---|---|---|---|---|---|---|---|---|---|---|
| 1 | 100 | 0.06 | 20 | 80 | 100 | 0.22 | 1.0 | 4.2 | 0.04 | Comp. |
| 2 | 100 | 0.06 | 25 | 80 | 95 | 0.22 | 1.2 | 4.1 | 0.04 | Comp. |
| 3 | 100 | 0.06 | 45 | 80 | 90 | 0.22 | 1.4 | 4.0 | 0.05 | Comp. |
| 4 | 100 | 0.06 | 20 | 125 | 106 | 0.25 | 1.1 | 4.5 | 0.05 | Comp. |
| 5 | 100 | 0.06 | 25 | 125 | 103 | 0.25 | 1.0 | 4.3 | 0.05 | Comp. |
| 6 | 100 | 0.06 | 45 | 125 | 95 | 0.24 | 1.0 | 4.4 | 0.06 | Comp. |
| 7 | 100 | 0.06 | 22 | 90 | 108 | 0.21 | 0.5 | 1.5 | 0.03 | Inv. |
| 8 | 100 | 0.06 | 25 | 90 | 106 | 0.21 | 0.4 | 1.1 | 0.03 | Inv. |
| 9 | 100 | 0.06 | 40 | 90 | 103 | 0.21 | 0.5 | 1.4 | 0.03 | Inv. |
| 10 | 100 | 0.06 | 22 | 110 | 110 | 0.20 | 0.5 | 1.2 | 0.03 | Inv. |
| 11 | 100 | 0.06 | 25 | 110 | 107 | 0.20 | 0.4 | 1.1 | 0.03 | Inv. |
| 12 | 100 | 0.06 | 40 | 110 | 105 | 0.20 | 0.5 | 1.2 | 0.03 | Inv. |
| 13 | 100 | 0.06 | 25 | 115 | 109 | 0.20 | 0.5 | 1.3 | 0.03 | Inv. |
| 14 | 100 | 0.01 | 25 | 110 | 108 | 0.20 | 0.4 | 0.8 | 0.02 | Inv. |
| 15 | 100 | 0.04 | 25 | 110 | 108 | 0.20 | 0.4 | 0.7 | 0.02 | Inv. |
| 16 | 110 | 0.06 | 25 | 110 | 107 | 0.20 | 0.4 | 0.8 | 0.03 | Inv. |
| 17 | 125 | 0.06 | 25 | 110 | 106 | 0.21 | 0.3 | 0.7 | 0.02 | Inv. |
| 18 | 150 | 0.06 | 25 | 110 | 103 | 0.21 | 0.4 | 0.9 | 0.02 | Inv. |
| 19 | 175 | 0.06 | 25 | 110 | 101 | 0.22 | 0.4 | 0.9 | 0.03 | Inv. |
| 20 | 125 | 0.04 | 25 | 110 | 105 | 0.21 | 0.3 | 0.7 | 0.02 | Inv. |

Example 4

Photothermographic material samples prepared in Example were processed using the thermal processor shown in FIG. 2 under the conditions shown in Table 4 and evaluated. Results thereof are shown in Table 4.

TABLE 4

| No. | Support Thickness (μm) | Thermal Dimensional Change (%) | Transport Speed (mm/sec) | Raising Length/ mm or Roller | Sensitivity | Dmin | Density Fluctuation | Dot % fluctuation | Dimension Reproducibility | Remark |
|---|---|---|---|---|---|---|---|---|---|---|
| 1 | 100 | 0.06 | 20 | Roller | 100 | 0.31 | 1.4 | 4.4 | 0.06 | Comp. |
| 2 | 100 | 0.06 | 25 | Roller | 93 | 0.31 | 1.5 | 4.6 | 0.06 | Cqmp. |
| 3 | 100 | 0.06 | 45 | Roller | 89 | 0.31 | 1.6 | 5.0 | 0.07 | Comp. |
| 4 | 100 | 0.06 | 45 | 0.5 | 92 | 0.29 | 1.1 | 4.1 | 0.05 | Comp. |
| 5 | 100 | 0.06 | 22 | 0.5 | 107 | 0.22 | 0.6 | 1.8 | 0.04 | Inv. |
| 6 | 100 | 0.06 | 25 | 0.5 | 104 | 0.22 | 0.5 | 1.7 | 0.04 | Inv. |
| 7 | 100 | 0.06 | 40 | 0.5 | 103 | 0.22 | 0.6 | 1.9 | 0.04 | Inv. |
| 8 | 100 | 0.06 | 25 | 1.5 | 108 | 0.22 | 0.5 | 1.6 | 0.04 | Inv. |
| 9 | 100 | 0.06 | 25 | 6.0 | 101 | 0.23 | 0.6 | 1.9 | 0.03 | Inv. |
| 10 | 100 | 0.04 | 25 | 1.5 | 108 | 0.22 | 0.5 | 1.6 | 0.04 | Inv. |
| 11 | 100 | 0.01 | 25 | 1.5 | 108 | 0.22 | 0.5 | 1.6 | 0.04 | Inv. |
| 12 | 110 | 0.06 | 25 | 1.5 | 107 | 0.22 | 0.5 | 1.5 | 0.03 | Inv. |
| 13 | 125 | 0.06 | 25 | 1.5 | 108 | 0.20 | 0.4 | 1.4 | 0.03 | Inv. |
| 14 | 150 | 0.06 | 25 | 1.5 | 106 | 0.22 | 0.5 | 1.6 | 0.03 | Inv. |
| 15 | 175 | 0.06 | 25 | 1.5 | 102 | 0.22 | 0.6 | 1.6 | 0.04 | Inv. |
| 16 | 125 | 0.04 | 25 | 1.5 | 108 | 0.21 | 0.4 | 1.4 | 0.02 | Inv. |

Example 5

Thermal processing was conducted in a manner similar to Examples 2 and 4, provided that the upper roller in the gradual-cooling section of the thermal processor was replaced by a roller with a built-in ceramic heater. As a result, it was proved that both density fluctuation and dot percentage fluctuation were further reduced.

Example 6

Photothermographic material samples were prepared and evaluated in the same manner as Example 3, except that contrast-increasing agents B93-1 and B93-2 of the light sensitive layer were replaced by contrast-increasing agents V-1, V-2 and V-3, each of 0.1 g/m$^2$, and compound H was replaced by the following compound. Samples were further evaluated in the following manner.

Contrast-increasing agent V-1

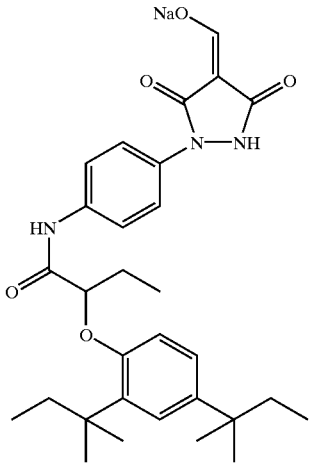

Contrast-increasing agent V-2

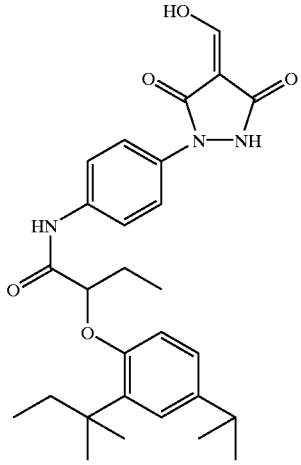

-continued

Contrast-increasing agent V-3

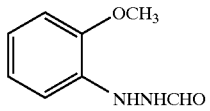

Compound H'

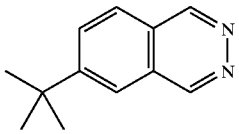

Sample No. 1 through 24 were each brought into contact with the surface of a heating member within 10 sec. after passing through the step in which samples each transported in an atmosphere of not less than 117° C. in 10 sec.

Evaluation of Linearity

Roll samples were each charged into image setter ECRM Mako 4650 and subjected to exposure giving a 10% halftone dots theoretically without correction of linearity, under the exposure condition in which a halftone dot of 90% as a theorretical value became the dot of 90% as observed value. In this case, the exposure condition was the standard development condition of Kodak Dry View Processor 2771. The closer to 1 the linearity, the better.

Results are shown in Table 5.

TABLE 5

| No. | Support Thickness (μm) | Thermal Dimensional Change (%) | Transport Speed (mm/sec) | Final Heat Source Temp. (° C.) | Sensitivity | Dmin | Density Fluctuation | Dot % fluctuation | Linearity | Dimension Reproducibility | Remark |
|---|---|---|---|---|---|---|---|---|---|---|---|
| 1 | 100 | 0.06 | 20 | 80 | 100 | 0.28 | 0.9 | 4.0 | 6.5 | 0.04 | Comp. |
| 2 | 100 | 0.06 | 25 | 80 | 90 | 0.28 | 0.9 | 3.7 | 6.3 | 0.04 | Comp. |
| 3 | 100 | 0.06 | 45 | 80 | 88 | 0.28 | 1.1 | 3.8 | 6.0 | 0.04 | Comp. |
| 4 | 100 | 0.06 | 20 | 125 | 104 | 0.31 | 1.0 | 4.2 | 6.9 | 0.05 | Comp. |
| 5 | 100 | 0.06 | 25 | 125 | 98 | 0.31 | 0.9 | 4.0 | 7.0 | 0.05 | Comp. |
| 6 | 100 | 0.06 | 45 | 125 | 95 | 0.30 | 0.7 | 4.0 | 6.8 | 0.05 | Comp. |
| 7 | 100 | 0.06 | 22 | 90 | 106 | 0.27 | 0.5 | 1.7 | 7.9 | 0.03 | Inv. |
| 8 | 100 | 0.06 | 25 | 90 | 105 | 0.27 | 0.4 | 1.6 | 8.4 | 0.03 | Inv. |
| 9 | 100 | 0.06 | 40 | 90 | 104 | 0.27 | 0.4 | 1.7 | 8.2 | 0.03 | Inv. |
| 10 | 100 | 0.06 | 22 | 110 | 110 | 0.27 | 0.4 | 1.6 | 8.3 | 0.03 | Inv. |
| 11 | 100 | 0.06 | 25 | 110 | 107 | 0.26 | 0.4 | 1.4 | 8.5 | 0.03 | Inv. |
| 12 | 100 | 0.06 | 40 | 110 | 106 | 0.26 | 0.4 | 1.5 | 8.3 | 0.03 | Inv. |
| 13 | 100 | 0.06 | 25 | 115 | 107 | 0.26 | 0.5 | 1.7 | 8.0 | 0.03 | Inv. |
| 14 | 100 | 0.01 | 25 | 110 | 105 | 0.26 | 0.4 | 1.2 | 8.3 | 0.02 | Inv. |
| 15 | 100 | 0.04 | 25 | 110 | 105 | 0.26 | 0.4 | 1.3 | 8.3 | 0.02 | Inv. |
| 16 | 110 | 0.06 | 25 | 110 | 106 | 0.26 | 0.4 | 1.2 | 8.1 | 0.03 | Inv. |
| 17 | 125 | 0.06 | 25 | 110 | 104 | 0.26 | 0.4 | 1.2 | 8.2 | 0.02 | Inv. |
| 18 | 150 | 0.06 | 25 | 110 | 102 | 0.26 | 0.4 | 1.4 | 8.4 | 0.02 | Inv. |

TABLE 5-continued

| No. | Support Thickness (μm) | Thermal Dimensional Change (%) | Transport Speed (mm/sec) | Final Heat Source Temp. (° C.) | Sensitivity | Dmin | Density Fluctuation | Dot % fluctuation | Linearity | Dimension Reproducibility | Remark |
|---|---|---|---|---|---|---|---|---|---|---|---|
| 19 | 175 | 0.06 | 25 | 110 | 101 | 0.26 | 0.4 | 1.3 | 8.2 | 0.03 | Inv. |
| 20 | 125 | 0.04 | 25 | 110 | 104 | 0.26 | 0.3 | 1.0 | 8.5 | 0.02 | Inv. |
| 21 | 100 | 0.06 | 20 | 90 | 101 | 0.28 | 0.9 | 4.1 | 6.6 | 0.04 | Inv. |
| 22 | 100 | 0.06 | 20 | 110 | 102 | 0.29 | 1.0 | 4.1 | 6.8 | 0.05 | Inv. |
| 23 | 100 | 0.06 | 45 | 90 | 90 | 0.29 | 1.0 | 3.9 | 6.4 | 0.04 | Inv. |
| 24 | 100 | 0.06 | 45 | 110 | 92 | 29.00 | 0.9 | 3.9 | 6.5 | 0.05 | Inv. |
| 25 | 100 | 0.06 | 25 | 110 | 109 | 0.27 | 0.5 | 1.8 | 8.1 | 0.03 | Inv. |

Example 7

Preparation of Emulsion 1

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 11 percent, and the proportion of the {100} face of 86 percent. The resulting emulsion was flocculated to remove soluble salts, employing a flocculating agent and after desalting, 0.1 g of phenoxyethanol was added and the pH and pAg were adjusted to 5.9 and 7.5. The emulsion was raised to 60° C. and chemically ripened with 2 mg of sodium thiosulfate for a period of 100 min. and thereafter was cooled to 38° C. to complete chemical sensitization to obtain silver halide emulsion 1.

Preparation of Organic Silver salt Emulsion

To 300 ml water, 10.6 g of behenic acid was added and dissolved with heating at 90° C.; 31.1 ml of IN sodoim hydroxide was added thereto an allowed to stand for 1 hr. After cooling to 30° C., 7.0 ml of 1N phosphoric acid was added and 0.01 g of N-bromosuccinic acid imide was further added with sufficiently stirring. Thereafter, the previously prepared silver halide emulsion was added in an amount of 10 mol%, based on silver of silver behenate, while stirring at 40° C. Further, 25 ml of aqueous 1N silver nitrate was added in 2 min. and allowed to stand with stirring.

To this emulsion, polyvinyl butyral dissolved in ethyl acetate was added with stirring, and after allowed to stand, a ethyl acetate phase containing silver behenate particles and silver halide grains was separated from an aqueous phase. After removing the aqueous phase, silver behenate particles and silver halide grains were taken out through centrifugal separation. Then, 20 g of Synthetic Zeolite A-3 (spherical form, available from TOSO Co., Ltd.) and 22 cc of isopropyl alcohol were added thereto and after being allowed to stand, the mixture was filtered. Furthermore, 3.4 g of polyvinyl butyral and 23 cc of isopropyl alcohol were added and dispersed with stirring at 35° C. to complete preparation of an organic fatty acid silver salt emulsion. Light sensitive layer composition

| | |
|---|---|
| Organic fatty acid silver salt emulsion | 1.75 g (based on silver)/$m^2$ |
| Pyridinium hydrobromide perbromide | $1.5 \times 10^{-4}$ mol/$m^2$ |
| Calcium bromide | $1.8 \times 10^{-4}$ mol/$m^2$ |
| 2-(4-Chlorobenzoyl)benzoic acid | $1.5 \times 10^{-3}$ mol/$m^2$ |
| Sensitizing dye | $4.2 \times 10^{-6}$ mol/$m^2$ |
| 2-Mercaptobenzimidiazole | $3.2 \times 10^{-3}$ mol/$m^2$ |
| 2-tribromomethylsulfonylquinoline | $6.0 \times 10^{-4}$ mol/$m^2$ |

Contrast-increasing agent, as shown in Table 1

Methyl ethyl ketone, acetone, and methanol were optimally used as a solvent.

Sensitizing dye

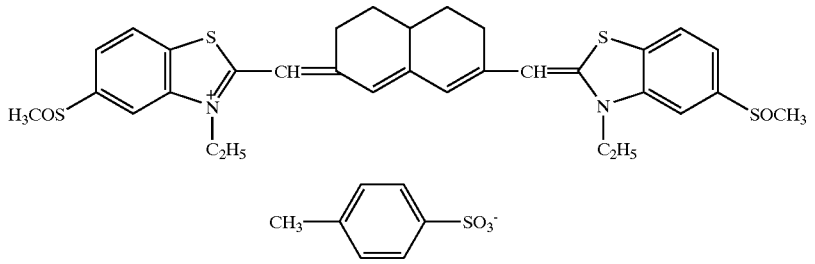

Surface Protective Layer Composition

A coating solution of a surface protective layer was prepared as follows.

| | |
|---|---|
| Cellulose acetate | 4 g/$m^2$ |
| 1,1-Bis(2-hydroxy-3,5-dimethylphenyl)- | $4.8 \times 10^{-3}$ mol/$m^2$ |

-continued

| | |
|---|---|
| 3,5,5-trimethylhexane | |
| Phthalazinone | $3.2 \times 10^{-3}$ mol/m$^2$ |
| 4-Methylphthalic acid | $1.6 \times 10^{-3}$ mol/m$^2$ |
| Tetrachlorophthalic acid | $7.9 \times 10^{-4}$ mol/m$^2$ |
| Tetrachlorophthalic acid anhydride | $9.1 \times 10^{-4}$ mol/m$^2$ |
| Silicon dioxide | 20 mg/m$^2$ |

Methyl ethyl ketone, acetone and methanol were optimally used as a solvent.

Backing Layer Composition

A coating solution of a backing layer was prepared as follows.

| | |
|---|---|
| Cellulose acetate | 4 g/m$^2$ |
| Dye-A | 0.06 g/m$^2$ |
| Dye-B | 0.018 g/m$^2$ |
| Silicon dioxide (particle size of 10 $\mu$m) | 50 mg/m$^2$ |

Methyl ethyl ketone, acetone and methanol were optimally used as a solvent.

Dye-A

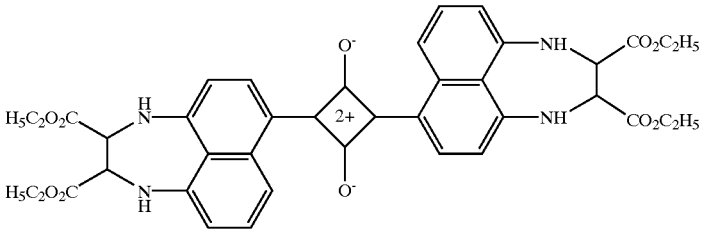

Dye-B

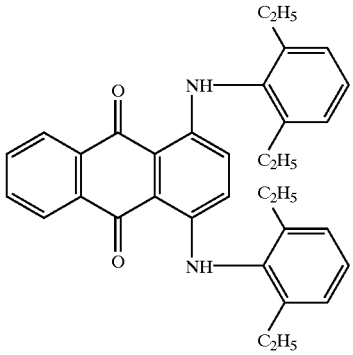

The compositions described above were coated on a biaxially stretched, 120 $\mu$m thick polyethylene terephthalate film and dried to obtain a coating sample. The obtained sample was exposed, thermally processed and evaluated with respect to a sensitivity, contrast (gamma) and fog density (Dmin).

Sensitivity

After exposed with a 780 nm laser sensitometer, the photothermographic materials were processed at 120° C. for 10 sec. and then were brought into contact with a heating member exhibiting a surface temperature of 90 to 115° C., in 5 sec. The processed samples were subjected to densitometry using a densitometer (PDA-65, available from Konica Corp.). Sensitivity was represented by a relative value, based on the sensitivity of Sample 1 being 100.

Gamma

A tangent of a line connecting densities of 0.1 and 3.0 of the processed sample was defined as a gamma. A gamma of less than 6.0 is unacceptable in practical use.

Dmin

Using a transmission densitometer, 361T (available from X-Rite Corp.), unexposed samples were measured with respect to a UVdensity.

Results are shown in Table 6.

TABLE 6

| Sample No. | Contrast-increasing Agent | Amount (mol/molAg) | Line-speed (mm/sec) | Gamma | Sensitivity | Dmin | Remark |
|---|---|---|---|---|---|---|---|
| 1 | — | — | 13.5 | 2 | 100 | 0.30 | Comp. |
| 2 | — | — | 20 | 2.5 | 90 | 0.27 | Comp. |
| 3 | H-1-1 | $1.0 \times 10^{-4}$ | 13.5 | 4 | 105 | 0.28 | Comp. |
| 4 | H-1-1 | $1.0 \times 10^{-4}$ | 20 | 5 | 110 | 0.26 | Comp. |
| 5 | H-1-1 | $1.5 \times 10^{-1}$ | 25 | 15 | 145 | 0.15 | Inv. |
| 6 | H-2-4 | $2.5 \times 10^{-1}$ | 22 | 14 | 130 | 0.14 | Inv. |
| 7 | H-3-6 | $3.0 \times 10^{-1}$ | 23 | 13 | 135 | 0.16 | Inv. |
| 8 | H-4-4 | $2.74 \times 10^{-1}$ | 24.5 | 15 | 125 | 0.17 | Inv. |
| 9 | H-27 | $0.5 \times 10^{-1}$ | 30 | 16 | 140 | 0.15 | Inv. |
| 10 | H-35 | $0.5 \times 10^{-2}$ | 27 | 12 | 150 | 0.18 | Inv. |
| 11 | H-30 | $0.5 \times 10^{-1}$ | 22 | 10 | 110 | 0.14 | Inv. |
| 12 | H-36 | $1.5 \times 10^{-1}$ | 28 | 12.5 | 125 | 0.15 | Inv. |
| 13 | (16) | $0.5 \times 10^{-1}$ | 30 | 13 | 115 | 0.16 | Inv. |
| 14 | (23) | $1.5 \times 10^{-1}$ | 22 | 15 | 130 | 0.13 | Inv. |

Example 8

Preparation of Emulsion 2

In 700 ml of deionized water were dissolved 22 g of phthalated gelatin and 30 mg of potassium bromide. After adjusting the temperature and the pH to 35° C. and 5.0, respectively, 159 ml of an aqueous solution containing 18.6 g silver nitrate and an equimolar aqueous solution containing potassium bromide, potassium iodide (in a molar ratio of 98 to 2) were added over a period of 10 min. by the controlled double jet method, while the pAg was maintained at 7.7. Subsequently, a 476 ml aqueous solution containing 55.4 g of silver nitrate and an aqueous solution containing 9 μmol/l of dipotassium hexachloroiridate and 1 mol/l of potassium bromide were added over a period of 30 minutes by the controlled double-jet method. Thereafter, the pH was lowered and flocculated to remove soluble salts and 0.1 g of phenoxyethanol was added and the pH and pAg were adjusted to 5.9 and 7.5. There was obtained cubic silver iodobromide grains comprising a core containing 8 mol % iodide and having an average grain size of 0.05 μm, a variation coefficient of the projection area equivalent diameter of 8 percent, and the proportion of the {100} face of 79 percent.

The thus obtained silver halide grain emulsion was heated to 60° C. After adding 60 mg of dye 1, 30 mg of dye 2, 2 g of 2-mercapto-5-methylbenzimidazole and 21.5 g of 4-chlorobenzophenone-2-carboxylic acid (each per mol of silver), 85 μmol of sodium thiosulfate, 11 μmol of 2,3,4,5,6-pentafluorophenyldiphenylphosphineselenide, 15 μmol of tellurium compound, 3.4 μmol of chloroauric acid and 260 μmol of thiocyanic acid were added thereto and after chemical ripening the emulsion was cooled to 30° C. to obtain intended silver halide emulsion 2.

Preparation of Organic Fatty Acid Salt Emulsion

Stearic acid of 1.3 g, 0.5 g of arachidic acid, 8.5 g of behenic acid and 300 ml distilled water were mixed at 90° C. for 15 min, and to the mixture was added 31.1 ml of an aqueous 1N NaOH solution in 30 min. and the temperature was lowered to 30° C. Subsequently, 7 ml of an aqueous 1N phosphoric acid solution was added thereto and 0.02 g of N-bromosuccinic acid imide was further added with vigorously stirring. Further thereto, 25 ml of an aqueous IN silver nitrate solution was added in 2 min. and allowed to react for 90 min. Thereafter, the solid product was filtered by the absorption filtration and washed with water until the filtrate reached a conductivity of 30 μS/cm.

Thereafter, the product was vacuum dried to obtain a solid organic fatty acid silver salt. To 10 g of the solid, 40 g of an aqueous 10 wt % hydroxypropylcellulose solution was added, then, 0.1 mole of pyridinium bromide perbromide and 0.15 mole of calcium bromide dihydrate were further added. Further thereto, previously prepared silver halide grains were added in an amount of 2.5 mmole, based on silver was added and dispersed by a media dispersing machine employing 0.5 mm $ZrO_2$ beads at 4,000 psi to obtain an aqueous dispersion of silver halide/organic acid silver salt having an average particle size of 1 μm. After removing binder from the coated sample, at least 500 particles which were selected at random were observed by am electron microscope based on the replica method to measure the projected area, thickness, number and monodisperse degree of the particles.

Preparation of Light Sensitive Layer Coating Solution

Separately, 10 mg of phenylthiosulfonic acid, 8 g of 5-tribromomethylsulfonyl-2-methylthiadiazole, 6 g of 2-tribromomethylsulfonylbenzothiazole, 150 g of 1,1-bis(2-hydroxy-3,5-dimethylphenyl)-3,5,5-trimethylhexane,5 g of 4,6-ditrichloromethyl-2-phenyltriazine, 2 g of disulfide compound, and 5 g of tetrachlorophthalic acid were mixed with 250 g of aqueous hydroxypropyl cellulose solution (10% by weight) and dispersed by a homogenizer to obtain an aqueous dispersion of the above compounds. A contrast-increasing agent was also used as shown in Table 2.

This dispersion of 10.3 g was mixed with 50 g of the aqueous dispersion described above, then, 10 g of binder P-3 and 3 mg of sodium p-dodecylbenzenesulfonate were added, and 200 ml distilled water was further added to make a coating solution. In this case, PVA is polyvinyl alcohol. Adenda used above are as follows:

Tellurium compound

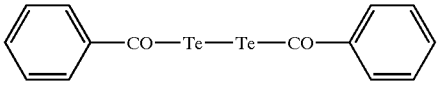

Disulfide compound 1

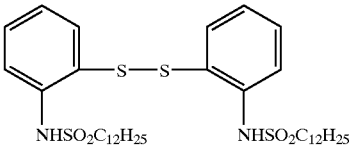

Dye 1

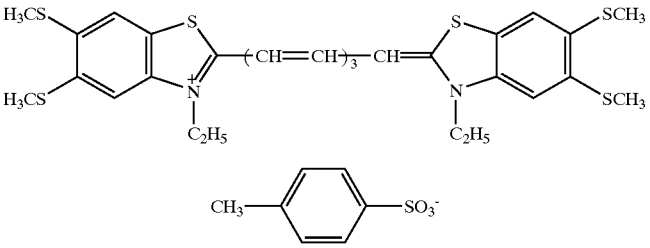

Dye 2

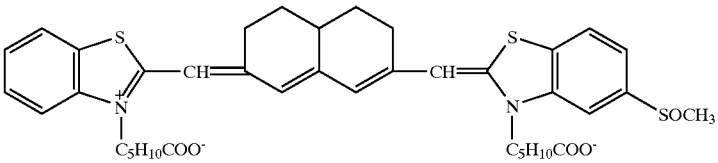

Preparation of Surface Protective Layer Coating Solution

| | |
|---|---|
| Alkali-processed gelatin | 4 g |
| Phthalazinone (5 wt %, water/methanol = 1/1 by weight solution) | 480 mg |
| Sodium 4-methylphthalate (4% aqueous solution) | 240 mg |
| Polymethyl methacrylate fine particles (average particle size 5 $\mu$m) | 80 mg |
| $C_7F_{15}COONa$ | 20 mg |
| Sodium p-dodecylbebzenesulfonate | 20 mg |
| Distilled water to make | 1 lit. |

Preparation of Backing Layer coating Solution

| | |
|---|---|
| Binder (P-3) | 15 g |
| Distilled water | 1000 g |
| Sodium p-dodecybenzenesulfonate | 30 mg |
| Epoxy compound (Dinacol EX313, available from Nagase Kasei Kogyo Co., Ltd) | 100 mg |
| Dye a | 50 mg |
| Dye b | 110 mg |
| Dye c | 40 mg |
| Dye d | 50 mg |
| Polymethyl methacrylate fine particles (average particle size 5 $\mu$m) | 20 mg |

Dye a

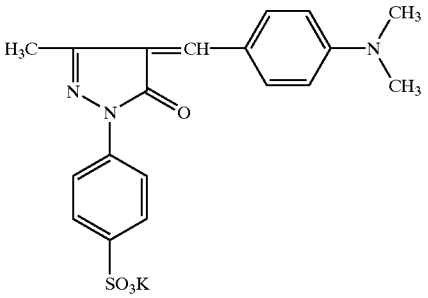

Dye b

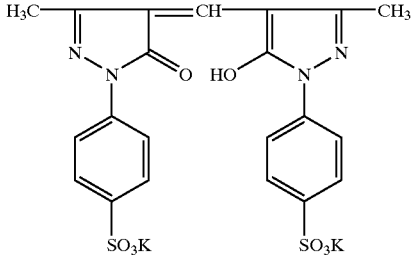

-continued

Dye c

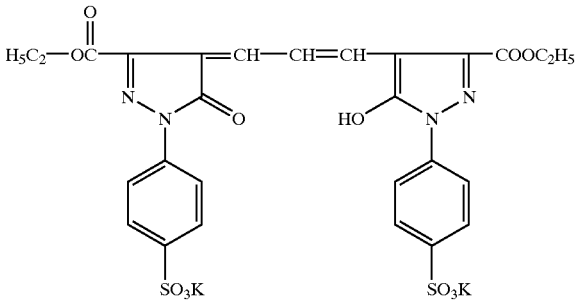

Dye d

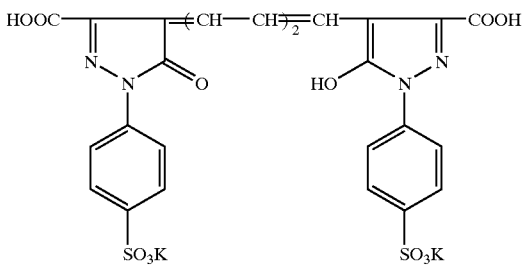

Samples which were obtained by coating the composition described above, were evaluated in the same manner as in Example 1. Results thereof are shown in Table 7.

TABLE 7

| Sample No. | Contrast-increasing Agent | Amount (mol/molAg) | Line-speed (mm/sec) | Gamma | Sensitivity | Dmin | Remark |
|---|---|---|---|---|---|---|---|
| 1 | — | — | 15 | 3 | 100 | 0.31 | Comp. |
| 2 | — | — | 20 | 4 | 105 | 0.28 | Comp. |
| 3 | (12) | $1.0 \times 10^{-4}$ | 14 | 5 | 90 | 0.29 | Comp. |
| 4 | (12) | $1.5 \times 10^{-1}$ | 24 | 13 | 145 | 0.15 | Inv. |
| 5 | (23) | $3.0 \times 10^{-1}$ | 25 | 15 | 135 | 0.16 | Inv. |
| 6 | H-1-1 | $2.74 \times 10^{-1}$ | 28 | 14 | 125 | 0.17 | Inv. |
| 7 | H-1-5 | $0.5 \times 10^{-1}$ | 22 | 13 | 140 | 0.15 | Inv. |
| 8 | H-35 | $0.5 \times 10^{-2}$ | 27 | 13 | 150 | 0.18 | Inv. |
| 9 | H-36 | $0.5 \times 10^{-1}$ | 25 | 14 | 110 | 0.14 | Inv. |
| 10 | H-30 | $1.5 \times 10^{-1}$ | 24 | 15 | 125 | 0.15 | Inv. |
| 11 | H-27 | $0.5 \times 10^{-1}$ | 30 | 16 | 115 | 0.16 | Inv. |
| 12 | H-31 | $1.5 \times 10^{-1}$ | 23 | 13 | 130 | 0.13 | Inv. |

EFFECT OF THE INVENTION

According to the processing method of othermographic materials of this invention, variation of ographic performance and dimensional change were reduced, even when subjected to rapid processing. Disclosed embodiment can be varied by a skilled person without departing from the spirit and scope of the invention.

What is claimed is:

1. A method of developing a photothermographic material comprising the steps of:

exposing a photothermographic material to light, and heat-developing the photothermographic material by the use of an automatic thermal processor, wherein the photothermographic material comprises a support, a light-sensitive silver halide, an organic silver salt, a reducing agent and a contrast-increasing agent, and wherein in the step of heat-developing, the photothermographic material is transported at a speed of 22 to 40 mm/sec,; the photothermographic material is subjected to heat development at a temperature of not less than 117° C. in not less than 10 sec., and then the photothermographic material is brought into contact with the surface of a heating member exhibiting a surface temperature of 90 to 115° C.

2. The method of claim 1, wherein the heating member exhibiting a surface temperature of 90 to 115° C. is a final temperature-controlled heating member in the thermal processor.

3. The method of claim 1, wherein the photothermographic material is subjected to heat development at a temperature of not less than 1170C in not less than 10 sec., and then the photothermographic material is brought into contact with the surface of a heating member exhibiting a surface temperature of 90 to 115° C. within 10 sec.

4. The method of claim 1, wherein the thermal processor comprises a heat-developing section, the heat-developing section being provided with a napped material.

5. The method of claim 1, wherein the support exhibits a thermal dimensional change of 0.001 to 0.04% at 125° C. for 25 sec.

6. The method of claim 1, wherein the support has a thickness of 110 to 150 $\mu$m.

7. An automatic thermal processor for heat-developing an exposed photothermographic material comprising a heat-developing section, wherein in the heat-developing section, the photothermographic material is transported at a speed of 22 to 40 mm/sec. and a temperature of the heat-developing section is not less than 117° C.; the photographic material passes through the heat-developing section in not less than 10 sec., and then the photothermographic material is brought into contact with the surface of a heating member exhibiting a surface temperature of 90 to 115° C.

8. The thermal processor of claim 7, wherein the heating member exhibiting a surface temperature of 90 to 115° C. is a final temperature-controlled heating member in the thermal processor.

9. The thermal processor of claim 7, wherein the photothermographic material passes through the heat-developing section at a temperature of not less than 117° C. in not less than 10 sec., and then the photothermographic material is brought into contact with the surface of a heating member exhibiting a surface temperature of 90 to 115° C.

10. The thermal processor of claim 7, wherein the thermal processor comprises a heat-developing section, the heat-developing section provided with a napped material.

* * * * *